US010631101B2

(12) United States Patent
Von Brasch et al.

(10) Patent No.: US 10,631,101 B2
(45) Date of Patent: Apr. 21, 2020

(54) ADVANCED SCENE CLASSIFICATION FOR PROSTHESIS

(71) Applicant: Cochlear Limited, Macquarie University, NSW (AU)

(72) Inventors: Alex Von Brasch, Macquarie University (AU); Stephen Fung, Macquarie University (AU); Kieran Reed, Macquarie University (AU)

(73) Assignee: Cochlear Limited, Macquarie University, NSW (AU)

( * ) Notice: Subject to any disclaimer, the term of this patent is extended or adjusted under 35 U.S.C. 154(b) by 596 days.

(21) Appl. No.: 15/177,868

(22) Filed: Jun. 9, 2016

(65) Prior Publication Data

US 2017/0359659 A1 Dec. 14, 2017

(51) Int. Cl.
*H04R 25/00* (2006.01)

(52) U.S. Cl.
CPC ..... *H04R 25/30* (2013.01); *H04R 25/505* (2013.01); *H04R 25/558* (2013.01); *H04R 2225/41* (2013.01); *H04R 2460/07* (2013.01)

(58) Field of Classification Search
CPC .... H04R 25/30; H04R 25/505; H04R 25/558; H04R 2225/41; H04R 2460/07
USPC ..... 381/312
See application file for complete search history.

(56) References Cited

U.S. PATENT DOCUMENTS

| | | | | |
|---|---|---|---|---|
| 8,335,332 | B2 | 12/2012 | Aboulnasr et al. | |
| 2006/0126872 | A1* | 6/2006 | Allegro-Baumann | H04R 25/70 381/312 |
| 2010/0290632 | A1* | 11/2010 | Lin | G01S 3/8006 381/56 |
| 2011/0137656 | A1* | 6/2011 | Xiang | G10L 25/78 704/270 |
| 2014/0105433 | A1* | 4/2014 | Goorevich | H04R 25/554 381/312 |
| 2015/0003652 | A1* | 1/2015 | Bisgaard | H04R 25/50 381/314 |
| 2015/0172831 | A1* | 6/2015 | Dittberner | H04R 25/70 381/314 |
| 2016/0078879 | A1* | 3/2016 | Lu | G10L 25/81 381/56 |

* cited by examiner

*Primary Examiner* — Sean H Nguyen
(74) *Attorney, Agent, or Firm* — Pilloff Passino & Cosenza LLP; Martin J. Cosenza

(57) ABSTRACT

A method, including capturing first sound with a hearing prosthesis, classifying the first sound using the hearing prosthesis according to a first feature regime, capturing second sound with the hearing prosthesis, and classifying the second sound using the hearing prosthesis according to a second feature regime different from the first feature regime.

24 Claims, 41 Drawing Sheets

142
136
100

10
132
130
120
126
118
119
108
109
111
112
114
146
148
140
147
134
103
123
122
121
116
104
106
110
102
105
107
101

CLASSIFICATION ALGORIGHM FOR STATIC FEATURE REGIME BASED SOLELY ON AUDIO FEATURES

CLASSIFICATION ALGORIGHM FOR DYNAMIC FEATURE REGIME

ADVANCED SCENE CLASSIFICATION FOR PROSTHESIS

People suffer from sensory loss, such as, for example, eyesight loss. Such people can often be totally blind or otherwise legally blind. So called retinal implants can provide stimulation to a recipient to evoke a sight percept. In some instances, the retinal implant is meant to partially restore useful vision to people who have lost their vision due to degenerative eye conditions such as retinitis pigmentosa (RP) or macular degeneration.

Typically, there are three types of retinal implants that can be used to restore partial sight: epiretinal implants (on the retina), subretinal implants (behind the retina), and suprachoroidal implants (above the vascular choroid). Retinal implants provide the recipient with low resolution images by electrically stimulating surviving retinal cells. Such images may be sufficient for restoring specific visual abilities, such as light perception and object recognition.

Still further, other types of sensory loss entail somatosensory and chemosensory deficiencies. There can thus be somatosensory implants and chemosensory implants that can be used to restore partial sense of touch or partial sense of smell, and/or partial sense of taste.

Another type of sensory loss is hearing loss, which may be due to many different causes, generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. One example of a hearing prosthesis is a cochlear implant.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from hearing loss typically receive an acoustic hearing aid. Conventional hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea, causing motion of the perilymph and stimulation of the auditory nerve. Cases of conductive hearing loss typically are treated by means of bone conduction hearing aids. In contrast to conventional hearing aids, these devices use a mechanical actuator that is coupled to the skull bone to apply the amplified sound.

In contrast to hearing aids, which rely primarily on the principles of air conduction, certain types of hearing prostheses, commonly referred to as cochlear implants, convert a received sound into electrical stimulation. The electrical stimulation is applied to the cochlea, which results in the perception of the received sound.

Many devices, such as medical devices that interface with a recipient, have functional features where there is utilitarian value in adjusting such features for different scenarios of use.

SUMMARY

In accordance with an exemplary embodiment, there is a method, comprising capturing first sound with a hearing prosthesis; classifying the first sound using the hearing prosthesis according to a first feature regime; capturing second sound with the hearing prosthesis; and classifying the second sound using the hearing prosthesis according to a second feature regime different from the first feature regime.

In accordance with another exemplary embodiment, there is a method, comprising classifying a first sound scene to which a hearing prosthesis is exposed according to a first feature subset during a first temporal period and classifying the first sound scene according to a second feature subset different from the first feature subset during a second temporal period of exposure of the hearing prosthesis to the first sound scene.

In accordance with another exemplary embodiment, there is a method, comprising adapting a scene classifier system of a prosthesis configured to sense a range of data based on input based on data external to the range of data.

BRIEF DESCRIPTION OF THE DRAWINGS

Embodiments are described below with reference to the attached drawings, in which.

DETAILED DESCRIPTION

At least some of the teachings detailed herein can be implemented in retinal implants. Accordingly, any teaching herein with respect to an implanted prosthesis corresponds to a disclosure of utilizing those teachings in/with a retinal implant, unless otherwise specified. Still further, at least some teachings detailed herein can be implemented in somatosensory implants and/or chemosensory implants. Accordingly, any teaching herein with respect to an implanted prosthesis can correspond to a disclosure of utilizing those teachings with/in a somatosensory implant and/or a chemosensory implant. That said, exemplary embodiments can be directed towards hearing prostheses, such as cochlear implants. The teachings detailed herein will be described for the most part with respect to cochlear implants or other hearing prostheses. However, in keeping with the above, it is noted that any disclosure herein with respect to a hearing prosthesis corresponds to a disclosure of utilizing the associated teachings with respect to any of the other prostheses detailed herein or other prostheses for that matter. Herein, the phrase "sense prosthesis" is the name of the genus that captures all of the aforementioned types of prostheses and any related types to which the art enables the teachings detailed herein applicable.

Figure 1:
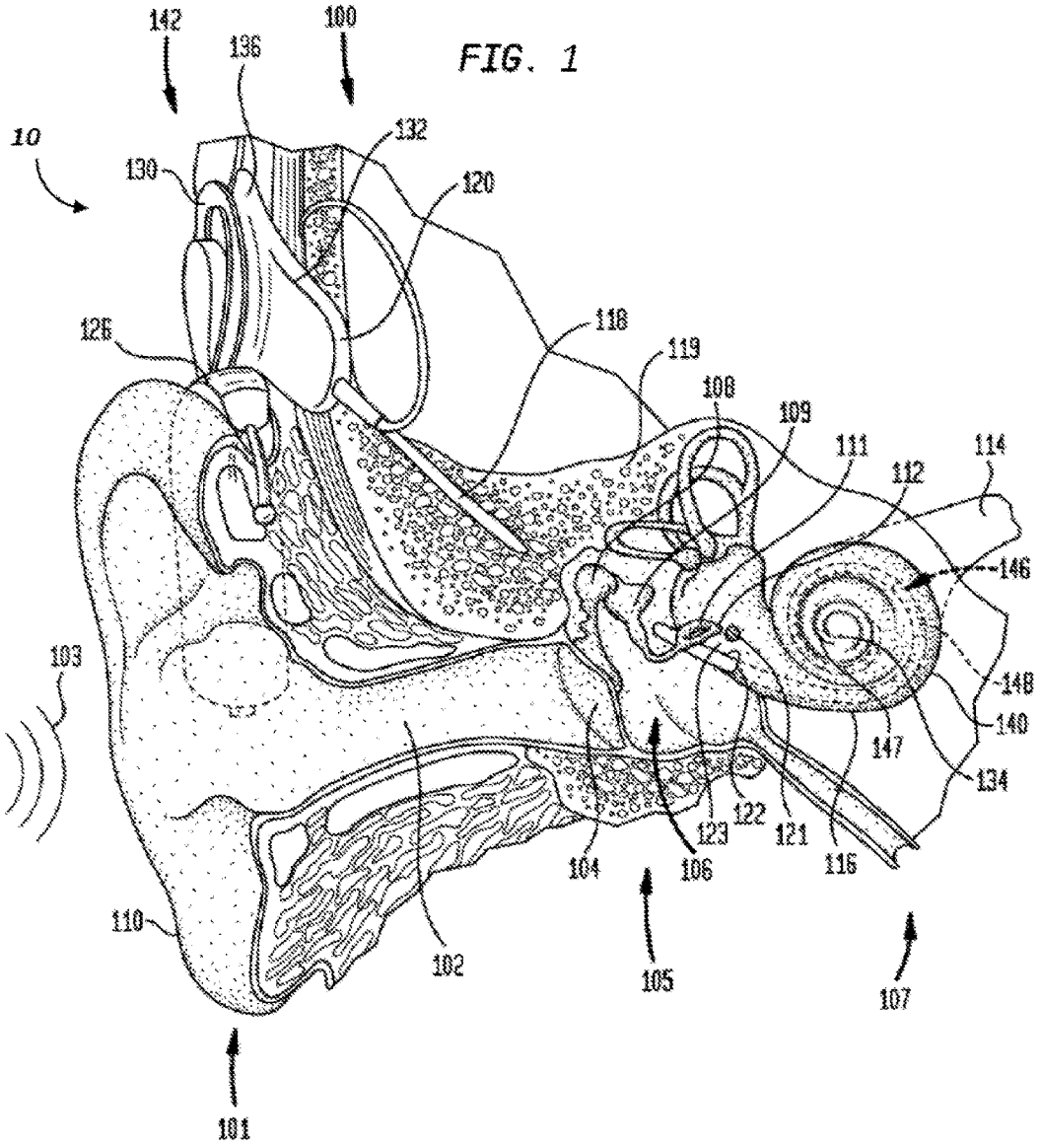
FIG. 1 is a perspective view of an exemplary hearing prosthesis in which at least some of the teachings detailed herein are applicable.

FIG. 1 is a perspective view of a cochlear implant, referred to as cochlear implant 100, implanted in a recipient, to which some embodiments detailed herein and/or variations thereof are applicable. The cochlear implant 100 is part of a system 10 that can include external components in some embodiments, as will be detailed below. It is noted that the teachings detailed herein are applicable, in at least some embodiments, to partially implantable and/or totally implantable cochlear implants (i.e., with regard to the latter, such as those having an implanted microphone). It is further noted that the teachings detailed herein are also applicable to other stimulating devices that utilize an electrical current beyond cochlear implants (e.g., auditory brain stimulators, pacemakers, etc.). Additionally, it is noted that the teachings detailed herein are also applicable to other types of hearing prostheses, such as by way of example only and not by way of limitation, bone conduction devices, direct acoustic cochlear stimulators, middle ear implants, etc. Indeed, it is noted that the teachings detailed herein are also applicable to so-called hybrid devices. In an exemplary embodiment, these hybrid devices apply electrical stimulation and/or acoustic stimulation and/or mechanical stimulation, etc., to the recipient. Any type of hearing prosthesis to which the teachings detailed herein and/or variations thereof can have utility can be used in some embodiments of the teachings detailed herein.

The recipient has an outer ear 101, a middle ear 105, and an inner ear 107. Components of outer ear 101, middle ear 105, and inner ear 107 are described below, followed by a description of cochlear implant 100.

In a fully functional ear, outer ear 101 comprises an auricle 110 and an ear canal 102. An acoustic pressure or sound wave 103 is collected by auricle 110 and channeled into and through ear canal 102. Disposed across the distal end of ear canal 102 is a tympanic membrane 104 which vibrates in response to sound wave 103. This vibration is coupled to oval window or fenestra ovalis 112 through three bones of middle ear 105, collectively referred to as the ossicles 106, and comprising the malleus 108, the incus 109, and the stapes 111. Bones 108, 109, and 111 of middle ear 105 serve to filter and amplify sound wave 103, causing oval window 112 to articulate, or vibrate, in response to vibration of tympanic membrane 104. This vibration sets up waves of fluid motion of the perilymph within cochlea 140. Such fluid motion in turn activates tiny hair cells (not shown) inside of cochlea 140. Activation of the hair cells causes appropriate nerve impulses to be generated and transferred through the spiral ganglion cells (not shown) and auditory nerve 114 to the brain (also not shown) where they are perceived as sound.

As shown, cochlear implant 100 comprises one or more components which are temporarily or permanently implanted in the recipient. Cochlear implant 100 is shown in FIG. 1 with an external device 142, that is part of system 10 (along with cochlear implant 100), which, as described below, is configured to provide power to the cochlear implant, where the implanted cochlear implant includes a battery that is recharged by the power provided from the external device 142.

In the illustrative arrangement of FIG. 1, external device 142 can comprise a power source (not shown) disposed in a Behind-The-Ear (BTE) unit 126. External device 142 also includes components of a transcutaneous energy transfer link, referred to as an external energy transfer assembly. The transcutaneous energy transfer link is used to transfer power and/or data to cochlear implant 100. Various types of energy transfer, such as infrared (IR), electromagnetic, capacitive, and inductive transfer may be used to transfer the power and/or data from external device 142 to cochlear implant 100. In the illustrative embodiments of FIG. 1, the external energy transfer assembly comprises an external coil 130 that forms part of an inductive radio frequency (RF) communication link. External coil 130 is typically a wire antenna coil comprised of multiple turns of electrically insulated single-strand or multi-strand platinum or gold wire. External device 142 also includes a magnet (not shown) positioned within the turns of wire of external coil 130. It should be appreciated that the external device shown in FIG. 1 is merely illustrative, and other external devices may be used with embodiments of the present invention.

Cochlear implant 100 comprises an internal energy transfer assembly 132 which can be positioned in a recess of the temporal bone adjacent auricle 110 of the recipient. As detailed below, internal energy transfer assembly 132 is a component of the transcutaneous energy transfer link and receives power and/or data from external device 142. In the illustrative embodiment, the energy transfer link comprises an inductive RF link, and internal energy transfer assembly 132 comprises a primary internal coil 136. Internal coil 136 is typically a wire antenna coil comprised of multiple turns of electrically insulated single-strand or multi-strand platinum or gold wire.

Cochlear implant 100 further comprises a main implantable component 120 and an elongate electrode assembly 118. In some embodiments, internal energy transfer assembly 132 and main implantable component 120 are hermetically sealed within a biocompatible housing. In some embodiments, main implantable component 120 includes an implantable microphone assembly (not shown) and a sound processing unit (not shown) to convert the sound signals received by the implantable microphone in internal energy transfer assembly 132 to data signals. That said, in some alternative embodiments, the implantable microphone assembly can be located in a separate implantable component (e.g., that has its own housing assembly, etc.) that is in signal communication with the main implantable component 120 (e.g., via leads or the like between the separate implantable component and the main implantable component 120). In at least some embodiments, the teachings detailed herein and/or variations thereof can be utilized with any type of implantable microphone arrangement.

Main implantable component 120 further includes a stimulator unit (also not shown) which generates electrical stimulation signals based on the data signals. The electrical stimulation signals are delivered to the recipient via elongate electrode assembly 118.

Elongate electrode assembly 118 has a proximal end connected to main implantable component 120, and a distal end implanted in cochlea 140. Electrode assembly 118 extends from main implantable component 120 to cochlea 140 through mastoid bone 119. In some embodiments electrode assembly 118 may be implanted at least in basal region 116, and sometimes further. For example, electrode assembly 118 may extend towards apical end of cochlea 140, referred to as cochlea apex 134. In certain circumstances, electrode assembly 118 may be inserted into cochlea 140 via a cochleostomy 122. In other circumstances, a cochleostomy may be formed through round window 121, oval window 112, the promontory 123, or through an apical turn 147 of cochlea 140.

Electrode assembly 118 comprises a longitudinally aligned and distally extending array 146 of electrodes 148, disposed along a length thereof. As noted, a stimulator unit generates stimulation signals which are applied by electrodes 148 to cochlea 140, thereby stimulating auditory nerve 114.

In at least some exemplary embodiments of various sense prostheses (e.g., retinal implant, cochlear implant, etc.), such prostheses have parameters, the values of which determine the configuration of the device. For example, with respect to a hearing prosthesis, the value of the parameters may define which sound processing algorithm and recipient-preferred functions within a sound processor are to be implemented. In some embodiments, parameters may be freely adjusted by the recipient via a user interface, usually for improving comfort or audibility dependent on the current listening environment, situation, or prosthesis configuration. An example of this type of parameter with respect to a hearing prosthesis is a sound processor "sensitivity" setting, which is usually turned up in quiet environments or turned down in loud environments. Depending on which features are available in each device and how a sound processor is configured, the recipient is usually able to select between a number of different settings for certain parameters. These settings are provided in at least some embodiments in the form of various selectable programs or program parameters stored in the prostheses. The act of selecting a given setting to operate the hearing prostheses can in some instances be more involved than that which would be the case if some form of automated or semi-automated regime were utilized. Indeed, in some scenarios of use, recipients do not always understand or know which settings to use in a particular sound environment, situation, or system configuration.

Still with respect to the cochlear implant to FIG. 1, the sound processor thereof processes audio signals received by the implanted. The audio signals received by the cochlear implant are received while the recipient is immersed in a particular sound environment/sound scene. The sound processor processes that received audio signal according to the rules of a particular current algorithm, program, or whatever processing regime to which the cochlear implant is set at that time. When the recipient moves into a different sound environment, the current algorithm or settings of the sound processing unit may not be suitable for this different environment, or more accurately, another algorithm where the setting or some other processing regime may be more utilitarian with respect to this different sound environment relative to that which was the case for the prior sound environment. Analogous situations exist for the aforementioned retinal implant. The processor thereof receives video signals that are processed according to a given rule of a particular algorithm or whatever processing regime to which the retinal implant is set at that time. When the implant moves into a different light environment, the current processing regime may not be as utilitarian for that different light environment as another type of processing regime. According to the exemplary embodiments to which the current teachings are directed, embodiments include a sense prosthesis that includes a scene analysis/scene classifier, which analyzes the input signal (e.g., the input audio signal to the hearing prosthesis, or the input video signal to the visual prosthesis, etc.) the analysis classifies the current environment (e.g., sound environment, light environment, etc.) in which the recipient is located. On the basis of the analysis, a utilitarian setting for operating the prosthesis is automatically selected and implemented.

Figure 2:
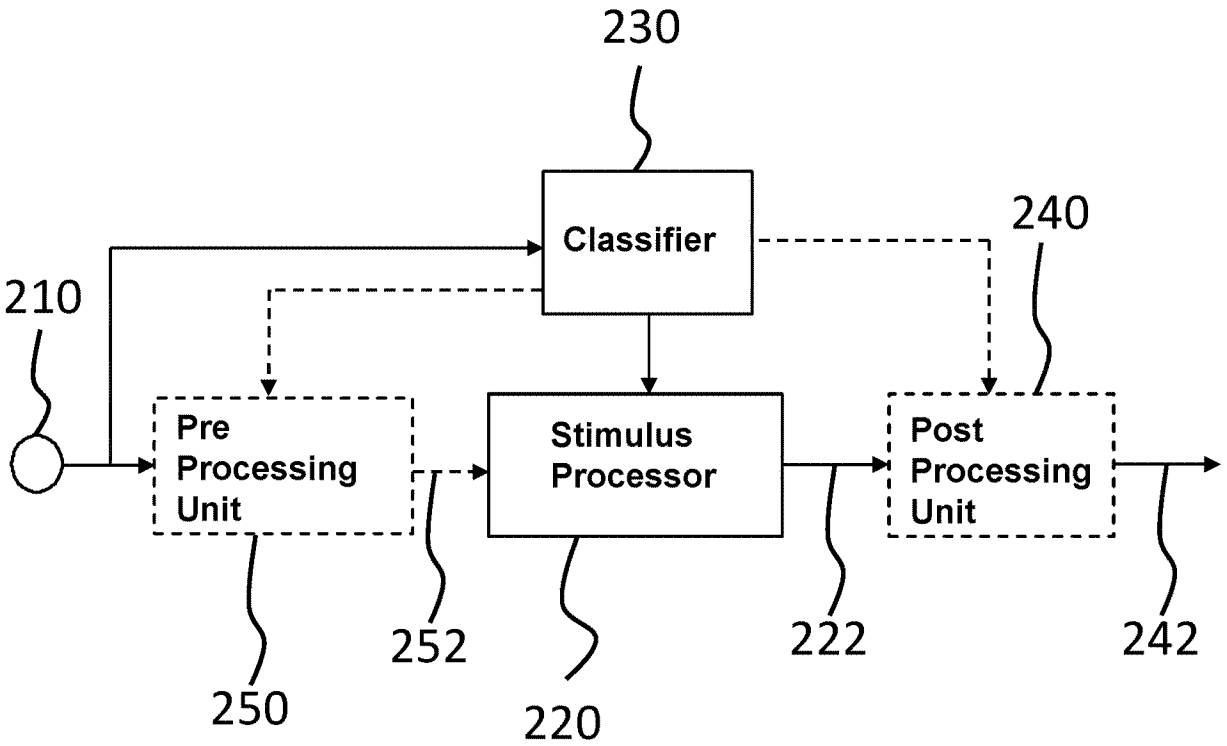
FIG. 2 presents an exemplary functional schematic according to an exemplary embodiment.

FIG. 2 presents an exemplary high level functional schematic of an exemplary embodiment of a prosthesis. As can be seen, the prosthesis includes a stimulus capture device 210, which can correspond to an image sensor, such as a digital image sensor (e.g., CCD, CMOS), or a sound sensor, such as a microphone, etc. The transducer of device 210 outputs a signal that is ultimately received directly or indirectly by a stimulus processor 220, such as by way of example only and not by way of limitation, a sound processor in the case of a hearing prosthesis. The processor 220 processes the output from device 210 in traditional manners, at least in some embodiments. The processor 220 outputs a signal 222. In an exemplary embodiment, such as by way of example only and not by way of limitation, with respect to a cochlear implant, output signal 222 can be output to a stimulator device (in the case of a totally implantable prosthesis) that converts the output into electrical stimulation signals that are directed to electrodes of the cochlear implant.

As seen in FIG. 2, some embodiments include a preprocessing unit 250 that processes the signal output from device 210 prior to receipt by the stimulus processor 220. By way of example only and not by way of limitation, preprocessing unit 250 can include an automatic gain control (AGC). In an exemplary embodiment, preprocessing unit 250 can include amplifiers, and/or pre-filters, etc. This preprocessing unit 250 can include a filter bank, while in alternative embodiments, the filter bank is part of the processor 220. The filter bank splits the light or sound, depending on the embodiment, into multiple frequency bands. With respect to embodiments directed towards hearing prostheses, the splitting emulates the behavior of the cochlea in a normal ear, where different locations along the length of the cochlea are sensitive to different frequencies. In at least some exemplary embodiments, the envelope of each filter output controls the amplitude of the stimulation pulses delivered to a corresponding electrode. With respect to hearing prostheses, electrodes positioned at the basal end of the cochlea (closer to the middle ear) are driven by the high frequency bands, and electrodes at the apical end are driven by low frequencies. In at least some exemplary embodiments, the outputs of processor 220 are a set of signal amplitudes per channel or plurality of channels, where the channels are respectively divided into corresponding frequency bands.

In an exemplary embodiment, again with respect to a cochlear implant, output signal 222 can be output to a post processing unit 240, which can further process or otherwise modify the signal 222, and output a signal 242 which is then provided to the stimulator unit of the cochlear implant (again with respect to a totally implantable prosthesis—in an alternate embodiment where the arrangement of FIG. 2 is utilized in a system including an external component and an implantable component, where the processor 220 is part of the external component, signal 242 (or 222) could be output to an RF inductance system for transcutaneous induction to a component implanted in the recipient).

The processor 220 is configured to function in some embodiments such as some embodiments related to a cochlear implant, to develop filter bank envelopes, and determine the timing and pattern of the stimulation on each electrode. In general terms, the processor 220 can select certain channels as a basis for stimulation, based on the amplitude and/or other factors. Still in general terms, the processor 220 can determine how stimulation will be based on the channels corresponding to the divisions established by the filter bank.

In some exemplary embodiments, the processor 220 varies the stimulation rates on each electrode (electrodes of a cochlear electrode array, for example). In some exemplary embodiments, the processor 220 determines the currents to be applied to the electrodes (while in other embodiments, this is executed using the post processing unit 240, which can be a set of electronics with logic that can set a given current based on input, such as input from the classifier 230).

As can be seen, the functional block diagram of FIG. 2 includes a classifier 230. In an exemplary embodiment, the classifier 230 receives the output from the stimulus capture device 210. The classifier 230 analyzes the output, and determines the environment in which the prosthesis is in based on the analysis. In an exemplary embodiment, the classifier 230 is an auditory scene classifier that classifies the sound scene in which the prosthesis is located. As can be seen, in an exemplary embodiment, the analysis of the classifier can be output to the stimulus processor 220 and/or can be output to the preprocessing unit 250 and/or the post processing unit 240. The output from the classifier 230 can be utilized to adjust the operation of the prosthesis as detailed herein and as would have utilitarian value with respect to any sense prosthesis. While the embodiment depicted in FIG. 2 presents the classifier 230 as a separate component from the stimulus processor 220, in alternate embodiment, the classifier 230 is an integral part of the processor 220.

More specifically, in the case of the hearing prosthesis, the classifier 230 can implement environmental sound classification to determine, for example, which processing mode to enable the processor 220. In one exemplary embodiment, environment classification as implemented by the classifier 230 can include a four step process. A first step of environmental classification can include feature extraction. In the feature extraction step, a processor may analyze an audio signal to determine features of the audio signal. In an exemplary embodiment, this can be executed by processor 220 (again, in some embodiments, classifier 230 is an integral part of the processor 220). For example, to determine features of the audio signal in the case of a hearing prosthesis, the sound processor 220 can measure the mel-frequency cepstral coefficients, the spectral sharpness, the zero-crossing rate, the spectral roll-off frequency, and other signal features.

Next, based on the measured features of the audio signal, the sound processor 220 can perform scene classification. In the scene classification action, the classifier will determine a sound environment (or "scene") probability based on the features of the audio signal. More generically, in the scene classifying action, the classifier will determine whether or not to commit to a classification. In this regard, various triggers or enablement qualifiers can be utilized to determine whether or not to commit to a given sound scene. In this regard, because of the utilization of automated algorithms and the like, the algorithms utilized in the scene classification actions can utilize triggers that, when activated, results in a commitment to a given classification. For example, an exemplary algorithm can utilize a threshold of a 70% confidence level that will trigger a commitment to a given scene classification. If the algorithm does not compute a confidence level of 70%, the scene classification system will not commit to a given scene classification. Alternatively and/or in addition to this, general thresholds can be utilized. For example, for a given possible scene classification, the algorithm can be constructed such that there will only be a commitment if, for example, 33% of a total sound energy falls within a certain frequency band. Still further by example, for a given possible scene classification, the algorithm can be constructed such that there will not be commitment if, for example, 25% of the total sound energy falls within another certain frequency band. Alternatively and/or in addition to this, a threshold volume can be established. Note also that there can be interplay between these features. For example, there will be no commitment if a confidence is less than 70% if the volume of the captured sound is X dB, and no commitment in a confidence is less than 60% if the volume of the captured sound is Y dB (and there will be commitment if the confidence is greater than 70% irrespective of the volume).

Is briefly noted that various teachings detailed herein enable, at least with respect to some embodiments, increasing the trigger levels for a given scene classification. For example, whereas currents scene classification systems may commit to a classification upon a confidence of 50%, some embodiments enable scene classification systems to only commit upon a confidence of 60%, 65%, 70%, 75%, 80%, 85%, 90% or more. Indeed, in some embodiments, such as those utilizing the reference classifier, these confidence levels can approach 100% and/or can be at 100%.

Some example environments are speech, noise, speech and noise, and music. Once the environment probabilities have been determined, the classifier 230 can provide a signal to the various components of the prosthesis so as to implement preprocessing, processing, or post processing algorithms so as to modify the signal.

Based on the output from the classifier 230, in an exemplary embodiment, the sound processor can select a sound processing mode based thereon (where the output from the classifier 230 is indicative of the scene classification). For example, if the output of classifier 230 corresponds to a scene classification corresponding to music, a music-specific sound processing mode can be enabled by processor 220.

Some exemplary functions of the classifier 230 and the processor 220 will now be described. It is noted that these are but exemplary and, in some instances, as will be detailed below, the functionality can be shared or performed by the other of the classifier 230 and the processor 220.

The classifier 230 can be configured to analyze the input audio signal from microphone 210 in the case of a hearing prosthesis. In some embodiments, the classifier 230 is a specially designed processor configured to analyze the signal according to traditional sound classification algorithms. In an exemplary embodiment, the classifier 230 is configured to detect features from the audio signal output by a microphone 210 (for example amplitude modulation, spectral spread, etc.). Upon detecting features, the classifier 230 responsively uses these features to classify the sound environment (for example into speech, noise, music, etc.). The classifier 230 makes a classification of the type of signal present based on features associated with the audio signal.

The processor 220 can be configured to perform a selection and parameter control based on the classification data from the classifier 230. In an exemplary embodiment, the processor 220 can be configured to select one or more processing modes based on this classification data. Further, the processor 220 can be configured to implement or adjust control parameters associated with the processing mode. For example, if the classification of the scene corresponds to a noise environment, the processor 220 can be configured to determine that a noise-reduction mode should be enabled, and/or the gain of the hearing prosthesis should be reduced, and implement such enablement and/or reduction.

Figure 3:
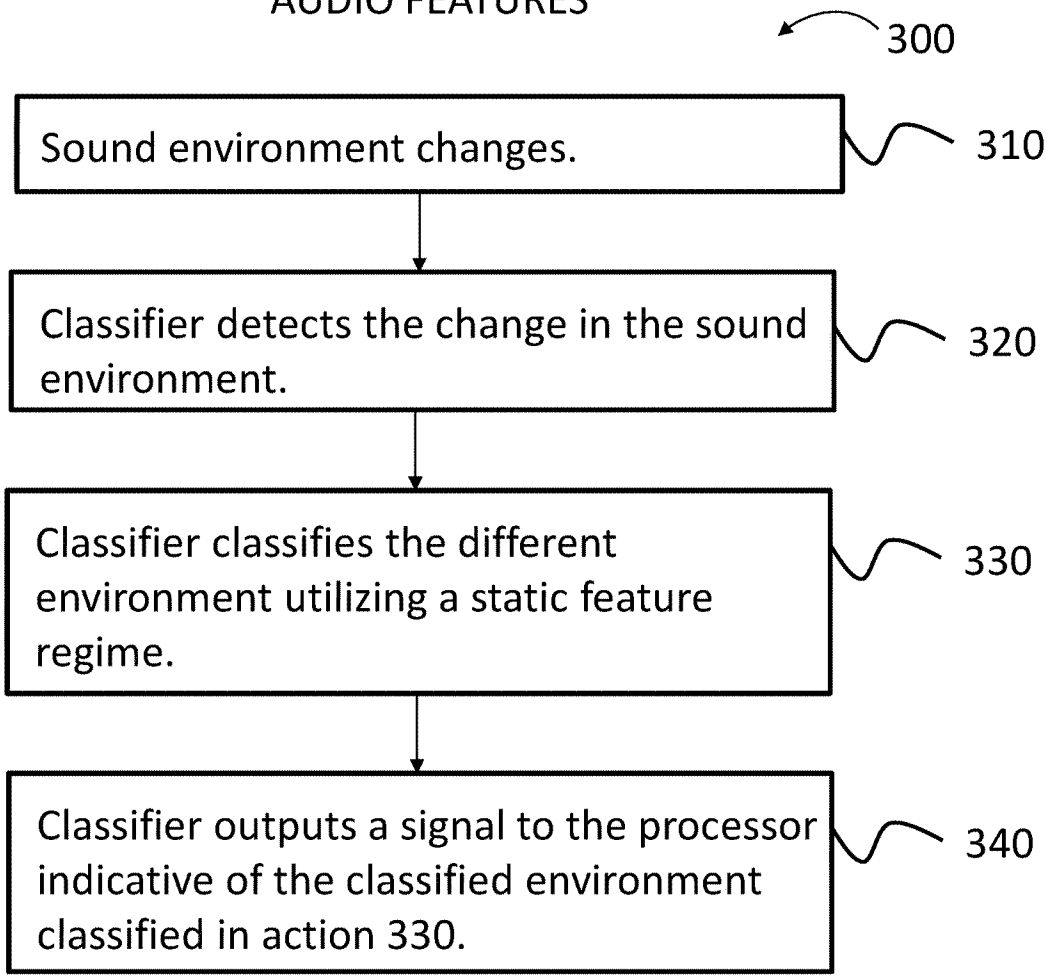
FIG. 3 presents another exemplary algorithm.

FIG. 3 presents an exemplary algorithm 300 used by classifier 230 according to an exemplary embodiment. This algorithm is a classification algorithm for a static feature regime based solely on audio features. That is, the feature regime is always the same. More specifically, at action 310, the sound environment changes. At action 320, the classifier 230 detects the change in the sound environment. In an exemplary embodiment, this is a result of a preliminary analysis by the classifier of the signal output by the microphone 210. For example, leading indicators can be utilized to determine that the sound environment has changed. Next, at action 330, the classifier classifies the different environment. According to action 330, the classifier classifies the different environment utilizing a static feature regime. In this regard, for example, a feature regime may utilize three or four or five or more or less features as a basis to classify the environment. For example, the classifier can make a classification of the type of signal received, and thus the environment in which the signal was generated, based on features associated with the audio signal and only the audio signal. For example, such features include the mel-frequency cepstral coefficients, spectral sharpness, zero-crossing rate, and spectral roll-off frequency. In the embodiment of FIG. 3, the classifier uses these same features, and no others, and always uses these features.

It is noted that action 320 can be skipped in some embodiments. In this regard, the classifier can be configured to continuously execute action 330 based on the input. At action 340, the classifier outputs a signal to the processor 220 indicative of the newly classified environment.

It is noted that the exemplary algorithm of FIG. 3 is just that, exemplary. In some embodiments, a more complex algorithm is utilized. Also, while the embodiment of FIG. 3 utilizes only sound input as the basis of classifying the environments, different embodiments utilize additional or alternate forms of input as the basis of classifying the environments. Further, while the embodiment of FIG. 3 is executed utilizing a static classifier, some embodiments can utilize an adaptive classifier that adapts to new environments. By "new environments," and "new scenes," it is meant an environment/a scene that has not been experienced by the classifier prior to the experience. This is differentiated from a changed environment which results from the environment changing from one environment to another environment.

Some exemplary embodiments of these different classifiers will now be described.

Figure 4:
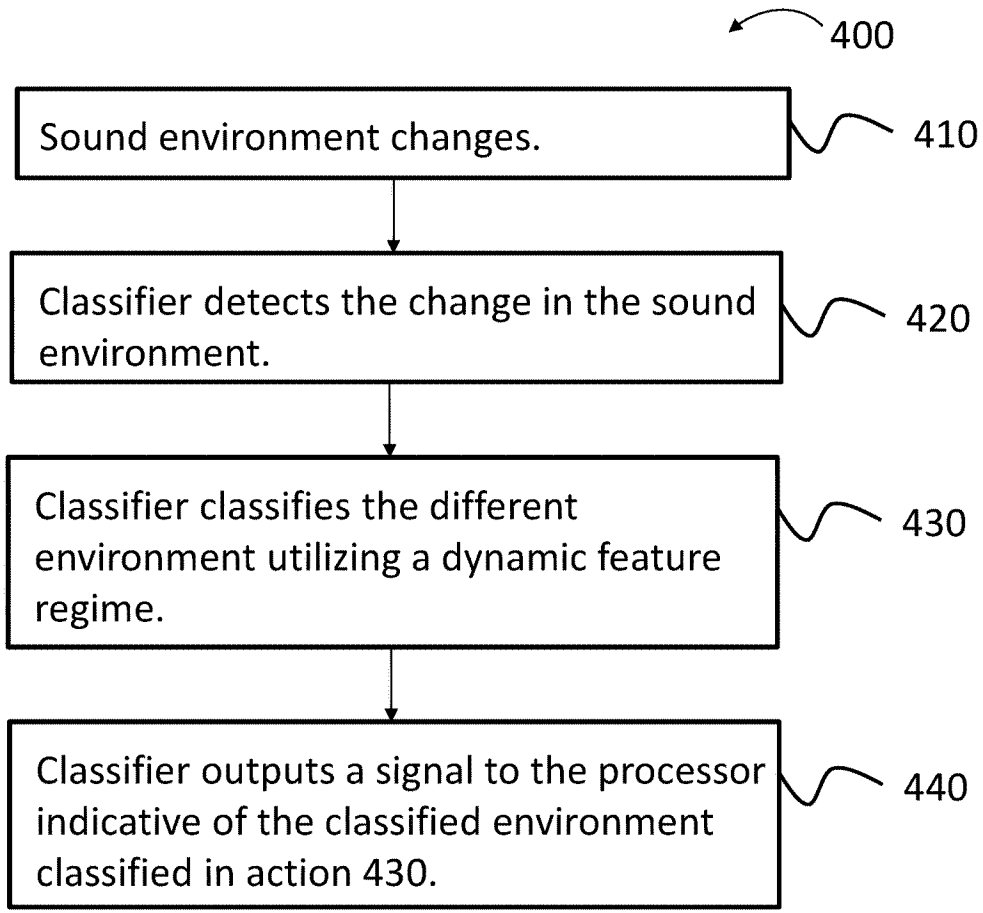
FIG. 4 resents another exemplary algorithm.

In embodiments of classifiers that follow the algorithm of FIG. 3, the feature regime utilized by the algorithm is static. In an exemplary embodiment, a feature regime utilized by the classifier is instead dynamic. FIG. 4 presents an exemplary algorithm for an exemplary classifier according to an exemplary embodiment. This algorithm is a classification algorithm for a dynamic feature regime. That is, the feature regime can be different/changed over time. More specifically, at action 410, the sound environment changes. At action 420, the classifier 230 detects the change in the sound environment. In an exemplary embodiment, this is a result of a preliminary analysis by the classifier of the signal output by the microphone 210. For example, leading indicators can be utilized to determine that the sound environment has changed. Next, at action 430, the classifier classifies the different environment. According to action 430, the classifier classifies the different environment utilizing a dynamic feature regime. In this regard, for example, a feature regime may utilize 3, 4, 5, 6, 7, 8, 9 or 10 or more or less features as a basis to classify the environment. For example, the classifier can make a classification of the type of signal received, and thus the environment in which the signal was generated, based on features associated with the audio signal or other phenomena. For example, the feature regime can include mel-frequency cepstral coefficients, and spectral sharpness, whereas a prior feature regime utilized by the classifier included the zero-crossing rate.

It is noted that action 420 can be skipped in some embodiments. In this regard, the classifier can be configured to continuously execute action 430 based on the input. At action 440, the classifier outputs a signal to the processor 220 indicative of the newly classified environment.

Figure 5:
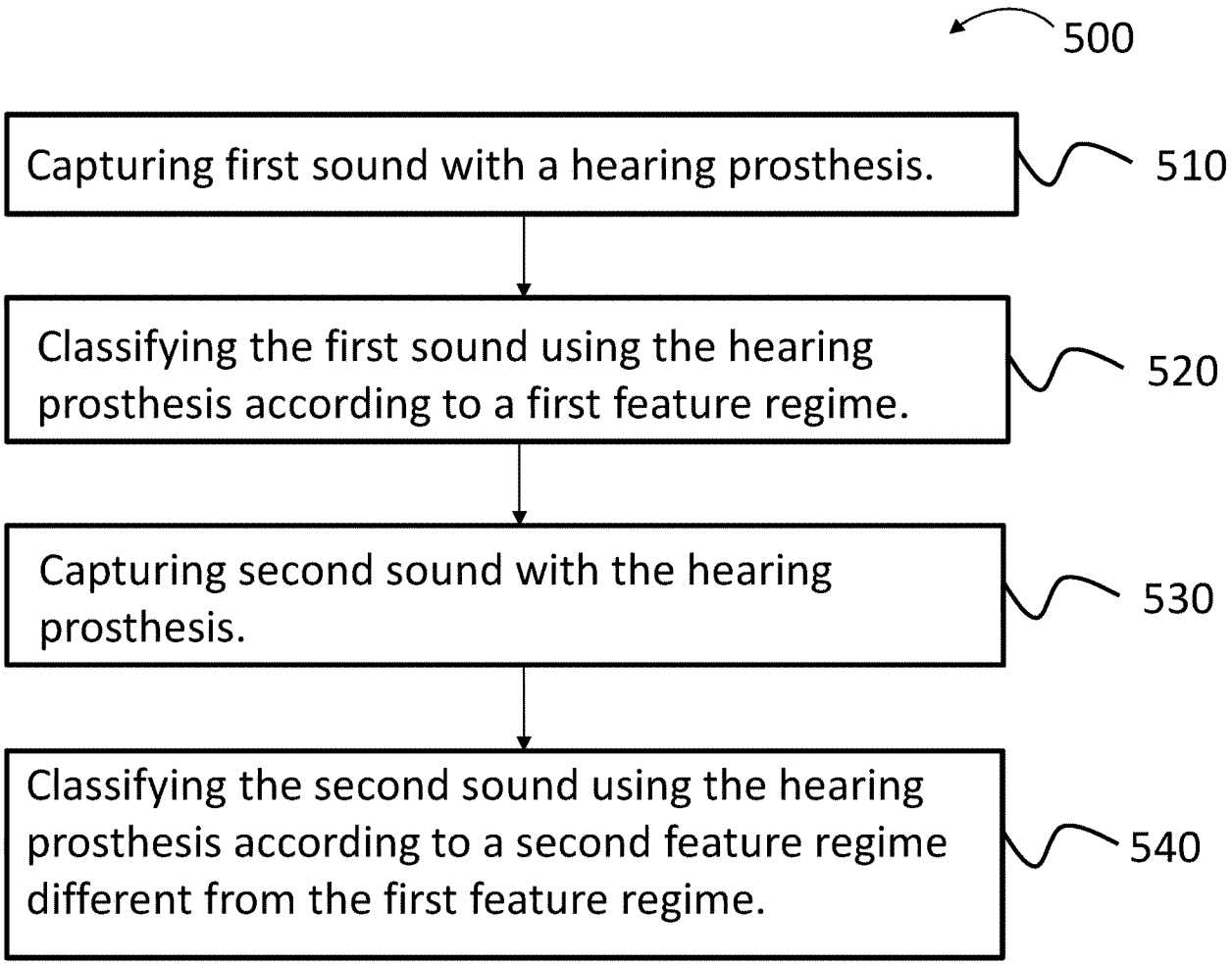
FIG. 5 presents an exemplary flowchart for an exemplary method according to an exemplary embodiment.

Thus, in view of the above, it is to be understood that an exemplary embodiment includes an adaptive classifier. In this regard, FIG. 5 depicts an exemplary method of using such adaptive classifier. It is noted that these exemplary embodiments are depicted in terms of a scene classifier used for a hearing prosthesis. It is to be understood that in alternate embodiments, the algorithms and methods detailed herein are applicable to other types of sense prostheses, such as for example, retinal implants, where the stimulus input is applicable for that type of prosthesis (e.g., capturing light instead of capturing sound, etc.). FIG. 5 depicts a flowchart for method 500, which includes method action 510, which entails capturing first sound with a hearing prosthesis. In an exemplary embodiment, this is executed utilizing a device such as microphone 210 of a hearing prosthesis (but with respect to a retinal implant, would be executed utilizing a light capture device thereof). Method 500 further includes method action 520, which entails classifying the first sound utilizing the hearing prosthesis according to a first feature regime. By way of example only and not by way of limitation, the first feature regime is a regime that utilizes the mel-frequency cepstral coefficients, spectral sharpness and the zero-crossing rate. It is briefly noted that the action of capturing sound can include the traditional manner of utilizing a microphone or the like. The action of capturing sound can also include the utilization of wireless transmission from a remote sound source, such as a radio, where no pressure waves are generated. The action of capturing sound can also include the utilization of a wire transmission utilizing an electrical audio signal, again where no pressure waves in the era generated.

Subsequent to method action 520, the hearing prosthesis is utilized to capture second sound in method action 530. By "second sound," it is meant that the sound is captured during a temporally different period than that of the capture of the first sound. The sound could be virtually identical/identical to that previously captured. In method action numeral 540, the second sound is classified utilizing the hearing prosthesis according to a second feature regime different from the first feature regime. By way of example only and not by way of limitation, the second feature regime is a regime that utilizes the mel-frequency cepstral coefficients, spectral sharpness, zero-crossing rate, and spectral roll-off frequency, whereas, as noted above, the first feature regime is a regime that utilized utilizes the mel-frequency cepstral coefficients, spectral sharpness and the zero-crossing rate. That is, the second feature regime includes the addition of the spectral roll-off frequency feature to the regime. As will be described in greater detail below, in an exemplary embodiment of method 500, in between method actions 520 and 530, an event occurs that results in a determination that operating the classifier 230 according to an algorithm that utilizes the first feature regime may not have as much utilitarian value as otherwise might be desired. Hence, the algorithm of the classifier is adapted such that the classification of the environment by the classifier is executed according to a regime that is different than that first feature regime (i.e., the second regime), where it is been determined that this different feature regime is believed to impart more utilitarian value with respect to the results of the classification process.

Thus, as can be seen above, in an exemplary method, between classification of the first sound and the classification of the second sound, there is the action of creating the second feature regime by adding a feature to the first feature regime (e.g., spectral roll-off frequency) in the above). Corollary to this is that in at least some alternate embodiments, the first feature regime can utilize more features than the second feature regime. That is, in an exemplary method, between classification of the first sound and the classification of the second sound, there is the action of creating the second feature regime by eliminating a feature from the first feature regime. For example, in an embodiment where the first feature regime included the mel-frequency cepstral coefficients, spectral sharpness, zero-crossing rate, the second feature regime could include the mel-frequency cepstral coefficients, zero-crossing rate, or the mel-frequency cepstral coefficients and spectral sharpness, or the mel-frequency cepstral coefficients, or spectral sharpness and zero-crossing rate. Note that the action of eliminating a feature from the first feature regime is not mutually exclusive to the action of adding a new feature. For example, in the aforementioned embodiment where the first feature regime included the mel-frequency cepstral coefficients, spectral sharpness and zero-crossing rate, the second feature regime could include the mel-frequency cepstral coefficients, spectral sharpness and spectral roll-off frequency, or spectral sharpness, zero-crossing rate and spectral roll-off frequency, or the mel-frequency cepstral coefficients, zero-crossing rate and spectral roll-off frequency. Corollary to this is that the action of adding a feature to the first regime is not mutually exclusive to the action of removing a feature from the first regime. That is, in some embodiments, the first feature regime includes a feature set utilizing a first number of features and the second feature regime includes a feature set utilizing a second number of features that in some instances can be the same as the first number and in other instances can be different from the first number. Thus, in some embodiments, the first feature regime is qualitatively and/or quantitatively different than the second feature regime.

It is noted that in an exemplary embodiment, the method of FIG. 5 is executed such that method actions 510, 520, 530, and 540 are executed during a temporal period free of sound classifier system (whether that be a system that utilizes a dedicated sound classifier or the system of a sound processor that also includes classifier functionality) changes not based on recipient activity. For example, if the temporal period is considered to begin at the commencement of action 510, and end at the ending of method action 540, the classifier system operates according to a predetermined algorithm that is not adjusted beyond that associated with the ability of the classifier system to learn and adapt by itself based on the auditory diet of the recipient. For example, the temporal period encompassing method 500 is one where the classifier system and/or the hearing prosthesis in general is not adjusted, for example, by an audiologist or the like, beyond that which results from the adaptive abilities of the classifier system itself. Indeed, in an exemplary embodiment, method 500 is executed during a temporal period where the hearing prosthesis has not retrieved any software and/or firmware updates/modifications from an outside source (e.g., an audiologist can download a software update to the prosthesis, the prosthesis can automatically download a software update—any of these could induce a change to the classifier system algorithm, whereas with respect to the embodiments just detailed excluding the changes not based on recipient activity, it is the prosthesis itself that is causing operation of the sound classifier system to change). In some exemplary embodiments, the algorithm that is utilized by the sound classifier system is adaptive and can change over time, but those changes are a result of a machine learning process/algorithm tied solely to the hearing prosthesis. In some exemplary embodiments, the algorithm that supports the machine learning process that changes the sound classifier system algorithm remains unchanged, even though the sound classifier system algorithm is changed by that machine learning algorithm. Additional details of how such a classifier system operates to achieve such functionality will be described below.

Figure 6:
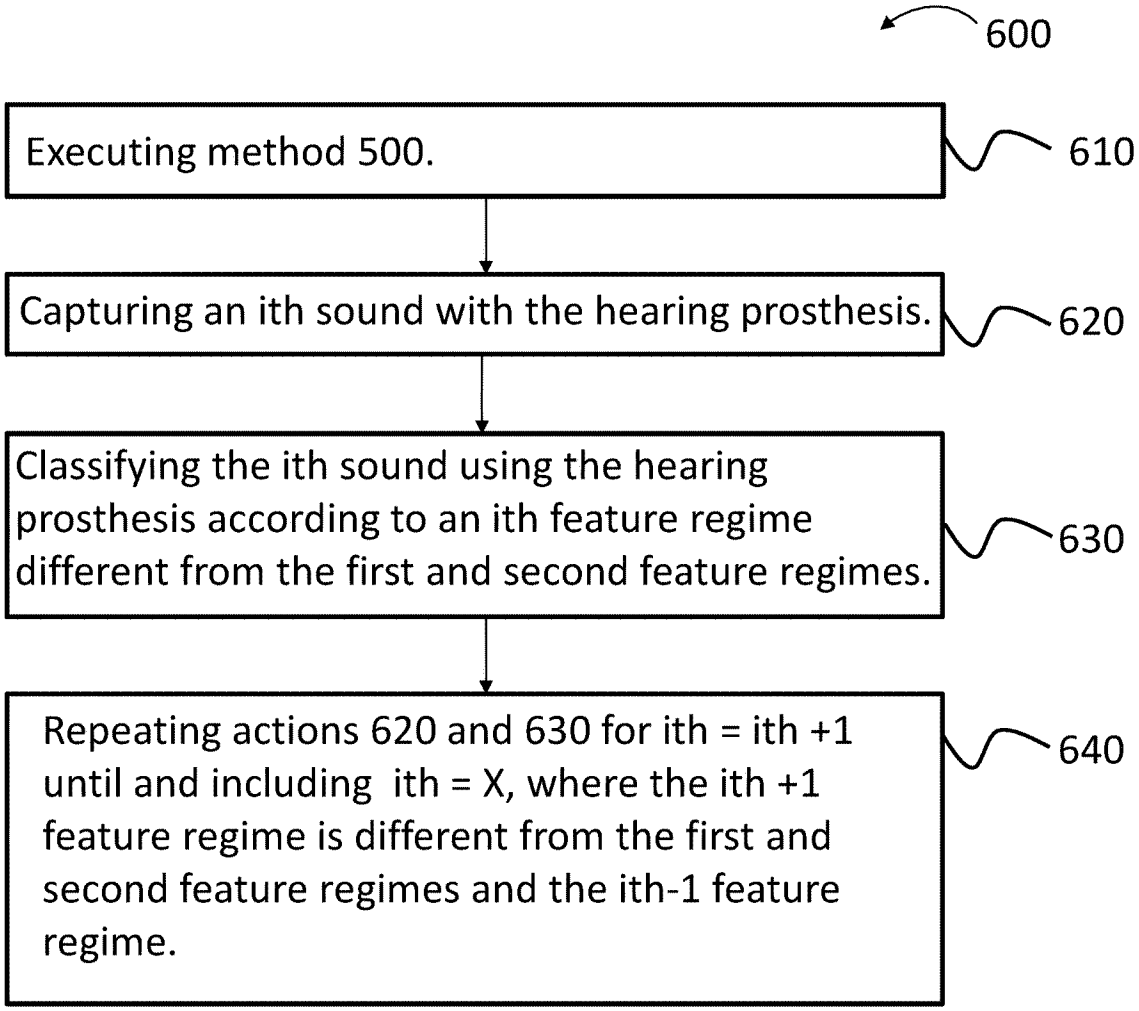
FIG. 6 presents another exemplary flowchart for an exemplary method according to an exemplary embodiment.

It is to be understood that the method 500 of FIG. 5 can be expanded to additional iterations thereof. That is, some exemplary methods embodying the spirit of the above-noted teachings include executing the various method actions of method 500 more than two times. In this regard, FIG. 6 depicts another exemplary flowchart for an exemplary method, method 600. Method action 610 entails executing method 500. Subsequent to method action 610, method 600 proceeds to method action 620, which entails capturing an "i"th sound with the hearing prosthesis (where "i" is used as a generic name that is updated as seen below for purposes of "book keeping"/"accounting"). Method 600 proceeds to method action 630, which entails classifying the ith sound using the hearing prosthesis according to an ith feature regime different from the first and second feature regimes. For purposes of description, the ith of the method action 620 and 630 can be the word "third." Method 600 further includes method action 640, which entails repeating method actions 620 and 630 for ith=ith+1 until ith equals a given integer "X" and including X, where the ith+1 feature regime is different from the first and second feature regimes of method 500 and the ith−1 feature regime (the ith of method actions 630 and 640: e.g., if ith+1=5, ith−1=3). In an exemplary embodiment, the integer X equals 3, which means that there will be a first, second, third, fourth, and fifth feature regime, all different from one another. In an exemplary embodiment, X can equal 1, 2, 3, 4, 5, 6, 7, 8, 9, 10, 11, 12, 13, 14, 15, 16, 17, 18, 19, 20, 21, 22, 23, 24, or 25, or more. In some embodiments, X can be any integer between 1 and 1000 or any range therebetween in some exemplary embodiments. Moreover, X can be even larger. In some embodiments, at least some of the method actions detailed herein are executed in a continuous and/or essentially continuous manner. By way of example, in an exemplary embodiment, method action 640 is executed in a continual manner, where X has not upper limit, or, more accurately, the upper limit of X is where the method actions are no longer executed due to failure of some sort or deactivation of a system that executes the method actions. In this regard, in some embodiments, X can be considered a counter.

The rate at which the feature regimes change can depend, in some exemplary embodiments, when a particular auditory diet of a given recipient. In some embodiments, X can be increased on a weekly or daily or hourly basis, depending on the auditory diet of the given recipient.

Figure 7:
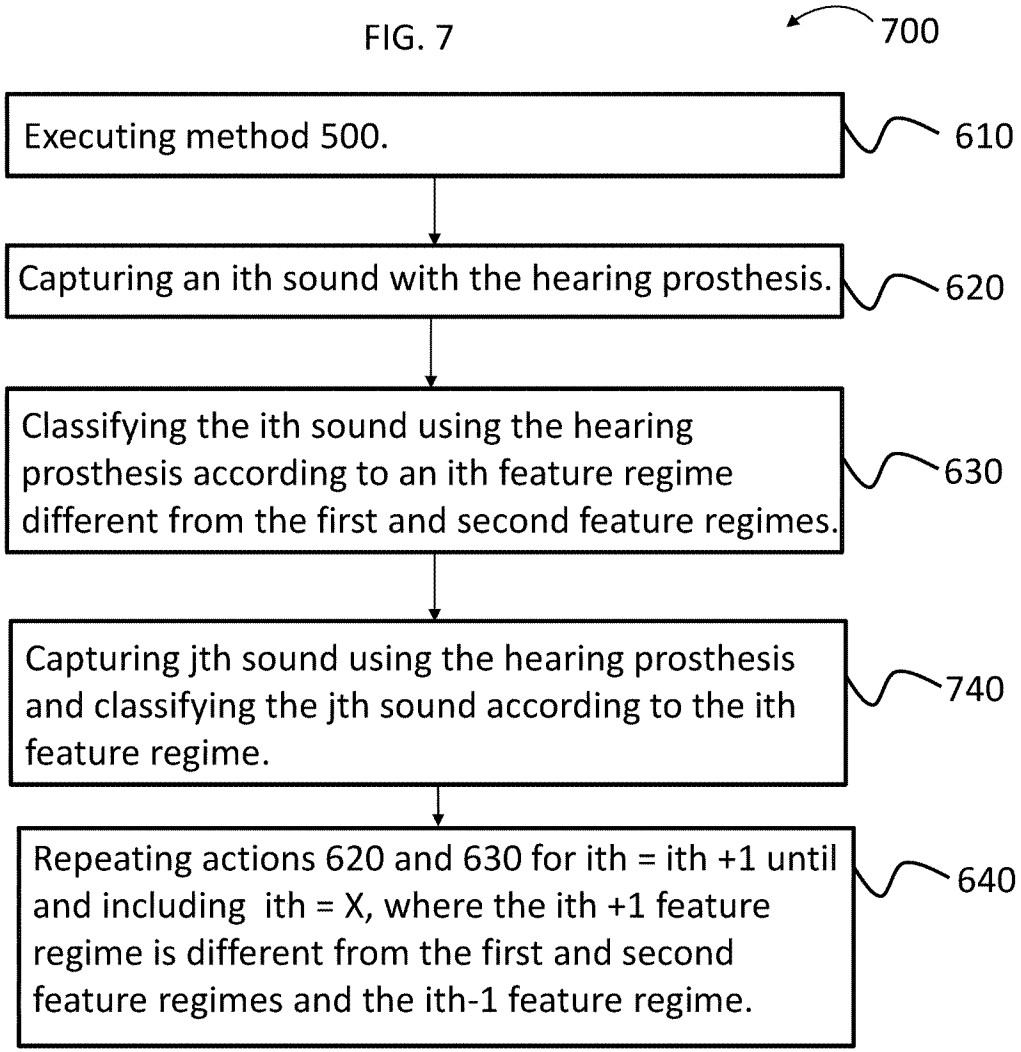
FIG. 7 presents another exemplary flowchart for an exemplary method according to an exemplary embodiment.

It is further noted that method 600 is not mutually exclusive with a scenario where a sound is captured and classified according to a regime that is the same as one of the prior regimes. By way of example only and not by way of limitation, the flowchart of FIG. 7 is an expanded version of the method of FIG. 6. In particular, method 700 includes the method actions 610, 620, and 630, as can be seen. Method 700 further includes method action 740, which entails capturing a jth sound using the hearing prosthesis and classifying the jth sound according to the ith feature regime (e.g., the feature regime utilized in method action 630). As can be seen, method 700 further includes method action 640. Note further that method action 740 can be executed a plurality of times before reaching method action 640, each for j=j+1. Note also that the jth sounds can correspond to the same type of sound as that of the ith sound. Note further that in an exemplary embodiment, while the ith feature regimes and the first and second feature regimes are different from one another, the ith sounds and the first and second sounds are not necessarily different types of sounds. That is, in an exemplary embodiment, one or more of the ith sounds and the first and second sounds is the same type of sound as another of the ith sounds and the first and second sounds. In this regard, method 600 corresponds to a scenario where the sound classifier system adapts itself to classify the same type of sound previously captured by the hearing prosthesis utilizing a different feature regime. Some additional details of this will be described below. That said, in an alternate embodiment, the ith sounds and the first and second sounds are all of a different type.

In an exemplary embodiment, method 600 is executed, from the commencement of method action 610 to the time at the completion of the repeat of actions 620 and 630 are repeated for ith=X, over a temporal period spanning a period within 15 days, within 30 days, within 60 days, within 3 months, within 4 months, within 5 months, within 6 months, within 9 months, within 12 months, within 18 months, within 2 years, within 2.5 years, within 3 years, within 4 years. Indeed, as noted above, in some embodiments, the temporal period spans until the device that is implementing the given methods fails or otherwise is deactivated. Moreover, in some embodiments, as will be described in greater detail below, the temporal period spans implementation in two or more prostheses that are executing the methods. Briefly, in an exemplary embodiment, at least some of the method actions detailed herein can be executed utilizing a first prostheses (e.g., X from 1 to 1,500 is executed using prostheses 1), and then the underlying algorithms that have been developed based on the executions of the methods (e.g., the algorithms using the adapted portions thereof) can be transferred to a second prosthesis, and utilized in that second prostheses (e.g., X from 1,501 to 4,000). This can go on for a third prostheses (e.g., X from 4,001-8,000), a fourth prostheses (X from 8,001 to 20,000), etc. Again, some additional details of this will be described below. In this regard, in an exemplary embodiment, any of the teachings detailed herein and/or variations thereof associated with a given prostheses relating to the scene classification regimes and/or the sound processing regimes can be transferred from one prostheses to another prostheses, and so on, as a given recipient obtains a new prostheses. In this regard, devices and systems and/or methods detailed herein can enable actions analogous to transferring a user's profile with respect to a speech recognition system (e.g., DRAGON™) that updates itself/updates a user profile based on continued use thereof, which user's profile can be transferred from one personal computer to a new personal computer so that the updated user profile is not lost/so that the updated user's profile can be utilized in the new computer. While the above embodiment has focused on transferring algorithms developed based on the methods detailed above, other embodiments can include transferring any type of data and/or operating regimes and/or algorithms detailed herein from one prosthesis to another prosthesis and so on, so that a scene classification system and/or a sound processing system will operate in the same manner as that of the prior prostheses other than the differences in hardware and/or software that make the new prostheses unique relative to the old prostheses. In this regard, in an exemplary embodiment, the adapted scene classifier of the prosthesis can be transferred from one prosthesis to another prostheses. In an exemplary embodiment, the algorithm for adaptively classifying a given scene that was especially developed or otherwise developed that is unique to a given recipient can be transferred from one prosthesis to another prosthesis. In an exemplary embodiment, the algorithm utilized to classify a given sound that was developed that is unique to a given recipient can be transferred from one prosthesis to another prosthesis.

In view of the above, there is a method, such as method 500, that further comprises, subsequent to the actions of capturing first sound, classifying the first sound, capturing the second sound and classifying the second sound (e.g., method actions 510, 520, 530, and 540), executing an "i"th action including capturing ith sound with the hearing prosthesis and classifying the ith sound using the hearing prosthesis according to an ith feature regime different from the first and second feature regimes. This exemplary method further includes the action of re-executing the ith action for ith=ith+1 at least 1-600 times at any integer value or range of integer values therebetween (e.g., 50, 1-50, 200, 100-300), where the ith+1 feature regime is different from the first and second feature regimes and the ith feature regime, within a period of 1 day to 2 years, and any value therebetween in 1 day increments or any range therein established by one day increments.

Figure 8:
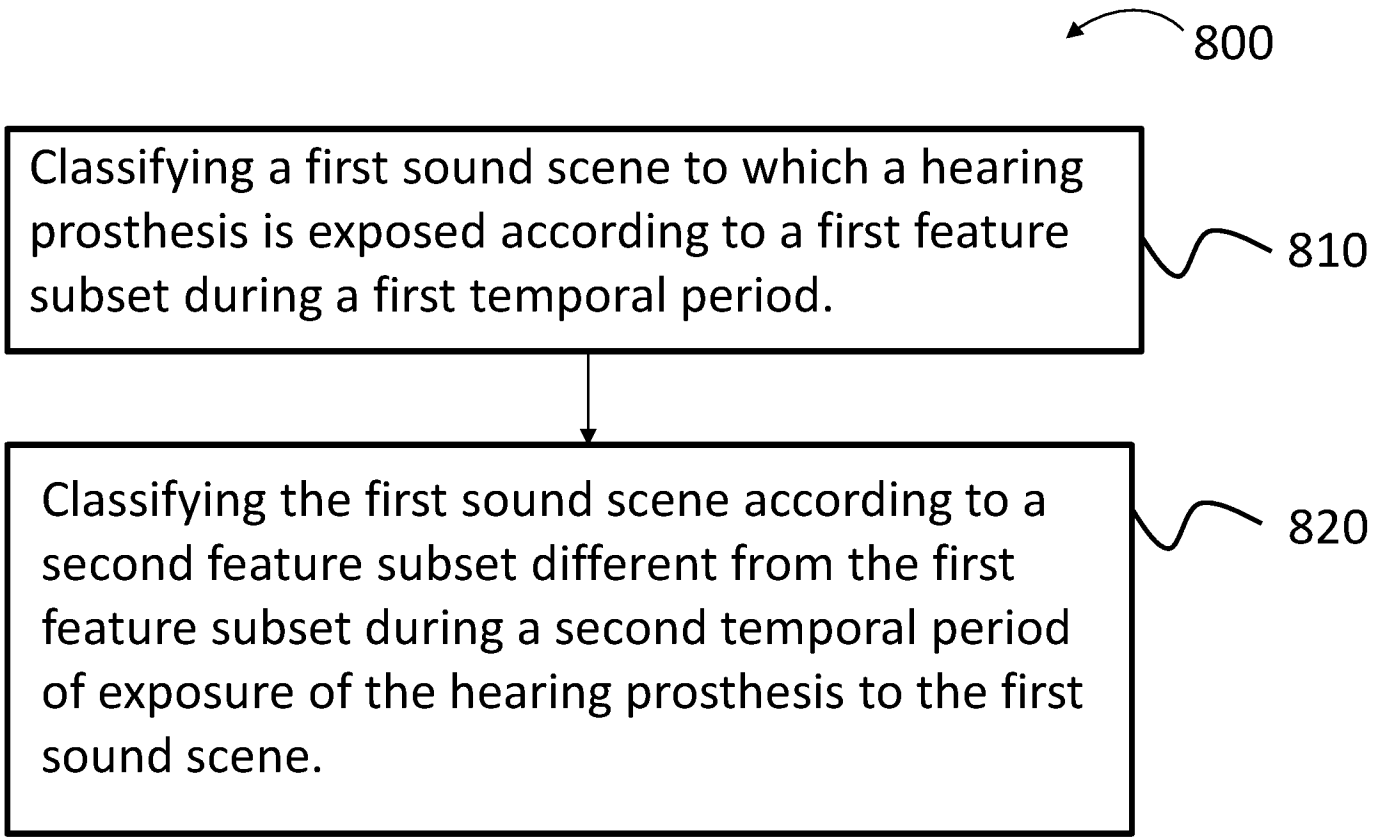
FIG. 8 presents another exemplary flowchart for an exemplary method according to an exemplary embodiment.

FIG. 8 presents another exemplary another flowchart for another exemplary method, method 800, according to an exemplary embodiment. Method 800 includes method action 810, which entails classifying a first sound scene to which a hearing prosthesis is exposed according to a first feature subset during a first temporal period. By way of example only and not by way of limitation, in an exemplary embodiment, the first sound scene can correspond to a type of music, which can correspond to a specific type of music (e.g., indigenous Jamaican reggae as distinguished from general reggae, the former being a more narrower subset than the commercialized versions even with respect to those artists originating from the island of Jamaica; bossa nova music, which is, statistically speaking, a relatively rare sound scene with respect to the population of recipients using a hearing prosthesis with a sound classifier system, Prince (and the Artist Formerly Known As) as compared to other early, mid- and/or late 1980s music), Wagner (as compared to general classical music), etc.), or can correspond to a type of radio (e.g., talk radio vs. news radio), or a type of noise (machinery vs. traffic). Any exemplary sound scene can be utilized with respect to this method. Additional ramifications of this are described in greater detail below. This paragraph simply sets the framework for an exemplary scenario that will be described according to an exemplary embodiment.

In an exemplary embodiment, the first feature subset (which can be a first feature regime in the parlance of method 500—note also that a feature set and a feature subset are not mutually exclusive—as used herein, a feature subset corresponds to a particular feature set from a genus that corresponds to all possible feature sets (hereinafter, often referred to the feature superset)) can be a feature subset that includes the mel-frequency cepstral coefficients, spectral sharpness and zero-crossing rate, etc. In this regard, by way of example only and not by way of limitation, the first feature subset can be a standard feature subset that is programmed into the hearing prosthesis at the time that the hearing prosthesis is fitted to the recipient/at the time that the hearing prosthesis is first used by the recipient.

Method 800 further includes method action 820, which entails classifying the first sound scene according to a second feature subset (which can be, in the parlance of method 500, the second feature regime) different from the first feature subset during a second temporal period of exposure of the hearing prosthesis to the first sound scene.

By way of example only and not by way of limitation, with respect to the exemplary sound scene corresponding to bossa nova music, during method action 810, the hearing prosthesis might classify the sound scene in a first manner. In an exemplary embodiment, the hearing prosthesis is configured to adjust the sound processing, based on this classification, so as to provide the recipient with a hearing percept that is tailored to the sound scene (e.g., certain features are more emphasized than others with respect to a sound scene corresponding to music vs. speech or television, etc.). In this regard, such is conventional in the art and will not be described in greater detail except to note that any device, system, and/or method of operating a hearing prosthesis based on the classification of a sound scene can be utilized in some exemplary embodiments. In an exemplary embodiment, the hearing prosthesis is configured to first provide an indication to the recipient that the hearing prosthesis intends to change the sound processing based on action 810. This can enable the recipient to perhaps override the change. In an exemplary embodiment, the hearing prosthesis can be configured to request authorization from the recipient to change the sound processing based on action 810. In an alternate embodiment, the hearing prosthesis does not provide an indication to the recipient, but instead simply adjusts the sound processing upon the completion of method action 810 (of course, presuming that the identified sound scene of method action 810 would prompt a change).

Figure 9:
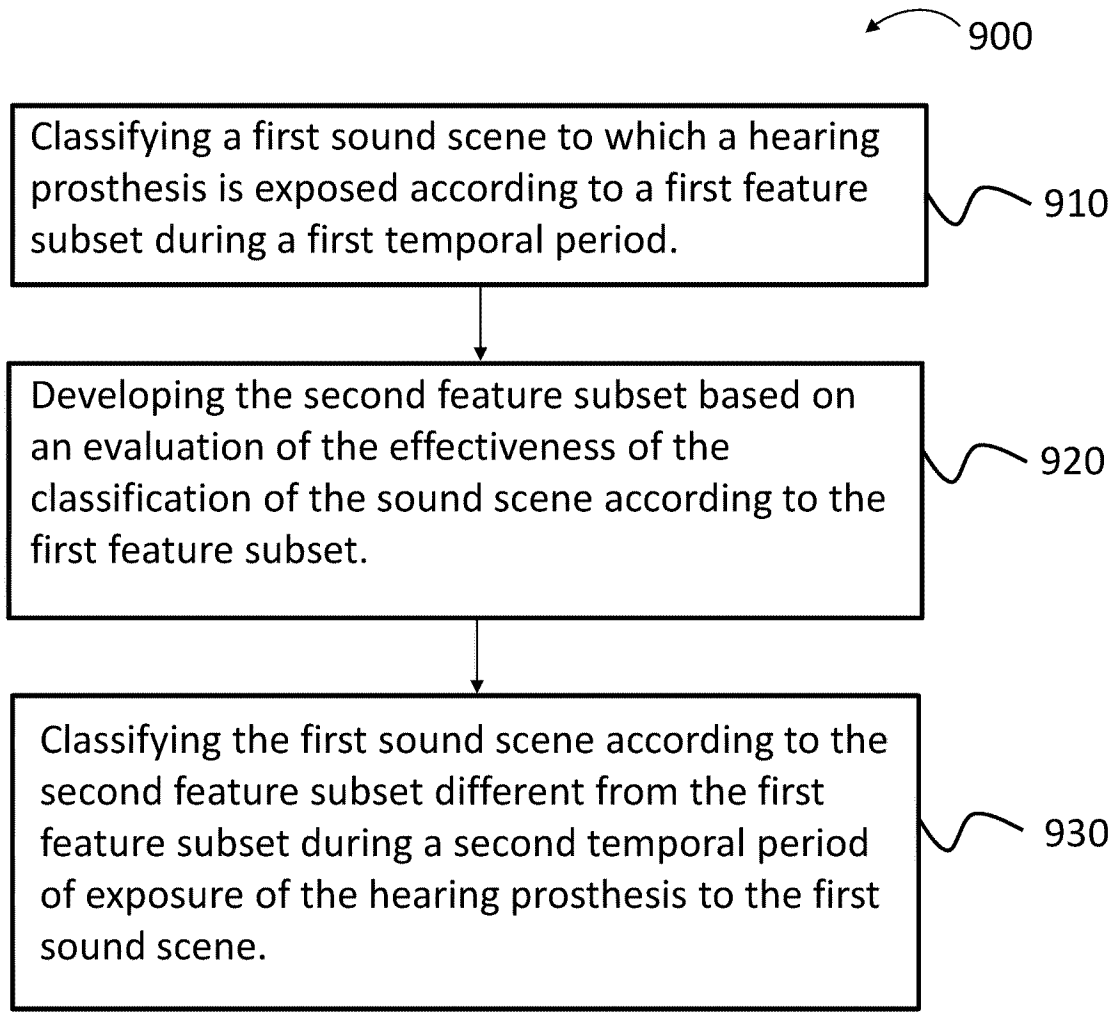
FIG. 9 presents another exemplary flowchart for an exemplary method according to an exemplary embodiment.

Subsequent to method action 810, the hearing prosthesis changes the sound processing based on the classification of method action 810. In an exemplary embodiment, the recipient might provide input into the hearing prosthesis that the changes to the sound processing were not to his or her liking. (Additional features of this concept and some variations thereof are described below.) In an exemplary embodiment, this is "interpreted" by the hearing prosthesis as an incorrect/less than fully utilitarian sound scene classification. Thus, in a dynamic hearing prosthesis utilizing a dynamic sound classifier system, when method action 820 is executed, the hearing prosthesis utilizes a different feature subset (e.g., the second feature subset) in an attempt to better classify the sound scene. In an exemplary embodiment, the second feature subset can correspond to any one of the different feature regimes detailed above and variations thereof (just as can be the case for the first feature subset). Corollary to this is the flowchart presented in FIG. 9 for an exemplary method, method 900. Method 900 includes method action 910, which corresponds to method action 810 detailed above. Method 900 further includes method action 920, which entails developing the second feature subset based on an evaluation of the effectiveness of the classification of a sound scene according to the first feature subset. In an exemplary embodiment, this can correspond to the iterative process noted above, whereupon at the change in the sound processing, the user provides feedback with respect to whether he or she likes/dislikes the change (herein, absence of direct input by the recipient that he or she dislikes a change constitutes feedback just as if the recipient provided direct input indicating that he or she liked the change and/or did not like the change). Any device, system, and/or method of ascertaining, automatically or manually, whether or not a recipient likes the change can be utilized in at least some embodiments. Note further that the terms "like" and "dislike" and "change" collectively have been used as proxies for evaluating the accuracy of the classification of the sound scene. That is, the above has been described in terms of a result oriented system. Note that any such disclosure also corresponds to an underlying disclosure of determining or otherwise evaluating the accuracy of the classification of the scene. In this regard, in an exemplary embodiment, in the scenario where the recipient is exposed to a sound scene corresponding to bossa nova music, the hearing prosthesis can be configured to prompt the recipient indicating a given classification, such as the sound scene corresponds to jazz music (which in this case is incorrect), and the recipient could provide feedback indicating that this is an incorrect classification. Alternately, in addition to this, the hearing prosthesis can be configured to change to the sound processing, and the recipient can provide input indicative of dissatisfaction with respect to the sound processing (and hence by implication, the scene classification). Based on this feedback, the prosthesis (or other system, such as a remote system, more on this below) can evaluate the effectiveness of the classification of the sound scene according to the first feature subset.

Note that in an exemplary embodiment, the evaluation of the effectiveness of the classification of the sound scene can correspond to that which results from utilization of a so-called override button or an override command. For example, if the recipient dislikes a change in the signal processing resulting from a scene classification, the recipient can override that change in the processing. That said, the teachings detailed herein are not directed to the mere use of an override system, without more. Here, the utilization of that override system is utilized so that the scene classifier system can learn or otherwise adapted based on that override input. Thus, the override system is a tool of the teachings detailed herein vis-à-vis scene classifier adaptation. This is a utilitarian difference between a standard scene classification system. That said, this is not to say that all prostheses utilizing the teachings detailed herein utilize the override input to adapt the scene classifier in all instances. Embodiments can exist where the override is a separate and distinct component from the scene classifier system or at least the adaptive portion thereof. Corollary to this is that embodiments can be practiced where in only some instances the inputs of an override is utilized to adapt the scene classifier system, while in other instances the override is utilized in a manner limited to its traditional purpose. Accordingly, in an exemplary embodiment, the method 900 of FIG. 9 can further include actions of overriding a change in the signal processing without developing or otherwise changing any feature subsets, even though another override of the signal processing corresponded or will correspond to the evaluation of the effectiveness of the classification of the sound scene in method action 920.

It is briefly noted that feedback can constitute the utilization of latent variables. By way of example only and not by way of limitation, the efficacy evaluation associated with method action 920 need not necessarily require an affirmative answer by the recipient whether or not the classification and/or the processing is acceptable. In an exemplary embodiment, the prosthesis (or other system, again more on this below) is configured to extrapolate that the efficacy was not as utilitarian as otherwise could be, based on latent variables such as the recipient making a counter adjustment to one or more of the features of the hearing prosthesis. For example, if after executing method action 910, the prosthesis adjusts the processing based on the classification of the first sound scene, which processing results in an increase in the gain of certain frequencies, and then the recipient reduces the volume in close temporal proximity to the increase in the gain of those certain frequencies and/or in a statistically significant manner the volume that the recipient utilizes the prostheses when listening in such a sound scene is repeatedly lowered when experiencing that sound scene (i.e., the recipient is making changes to the prosthesis in a recurring manner that that he or she did not previously make in such a recurring manner), the prosthesis (or other system) can determine that the efficacy of the classification of the first sound scene in method 910 could be more utilitarian, and thus develop the second feature subset. It is to be understood that embodiments relying on latent variables are not limited to simply volume adjustment. Other types of adjustments, such as balance and/or directionality adjustments and/or noise reduction adjustments and/or wind noise adjustments can be utilized as latent variables to evaluate the effectiveness of the classification of the sound scene according to the first feature subset. Any device, system, and/or method that can enable the utilization of latent variables to execute an evaluation of the effectiveness of the classification of sound scene according to the first feature subset can be utilized in at least some exemplary embodiments.

With respect to methods 800 and 900, the pretext is that the first classification was less than ideal/not as accurate as otherwise could be the case, and thus the second subset is developed in an attempt to classify the first sound scene differently than that which was the case in method action 910 (thus 810) in a manner having more utilitarian value with respect to the recipient. Accordingly, method action 930, which corresponds to method action 820, is a method action that is executed based on a determination that the effectiveness of the classification of the sound scene according to the first feature subset did not have a level of efficacy meeting a certain standard.

All of this is contrasted to an alternative scenario where, for example, if the recipient makes no statistically significant changes after the classification of the first sound scene, the second feature subset might never be developed for that particular sound scene. (Just as is the case with respect to the embodiment that only utilizes user feedback—if the user feedback is indicative of a utilitarian classification of the first sound scene, the second feature subset might never be developed for the particular classification.) Thus, an exemplary embodiment can entail the classification of a first, second, and a third sound scene (all of which are different), according to a first feature subset during a first temporal period. A second feature subset is never developed for the first and second sound scenes because the evaluation of the effectiveness of those classifications has indicated that the classification is acceptable/utilitarian. Conversely, a second feature subset is developed on account of a third scene, because an evaluation of the effectiveness of the classification for that third sound scene was deemed to be not as effective as otherwise might be the case.

Figure 10:
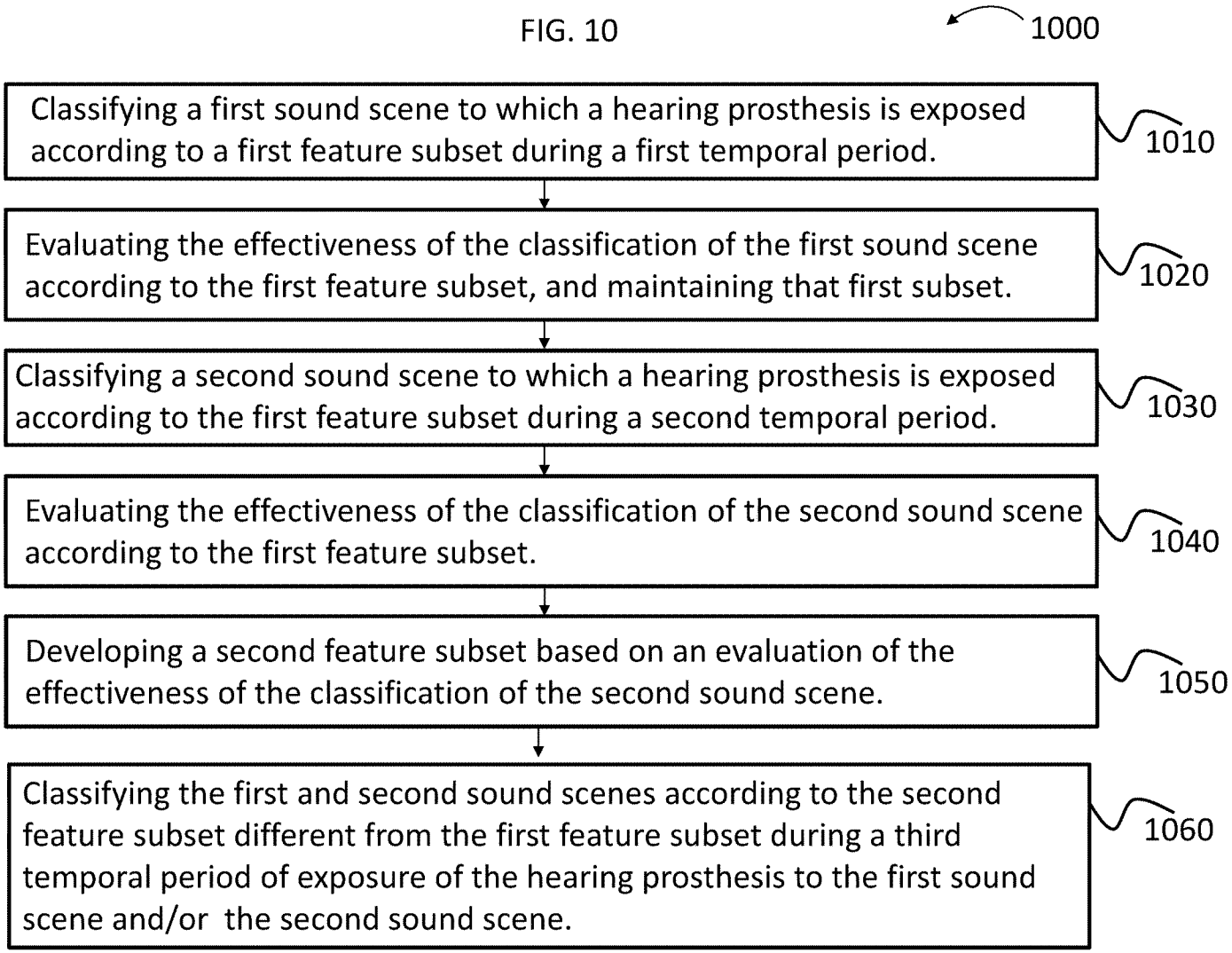
FIG. 10 presents another exemplary flowchart for an exemplary method according to an exemplary embodiment.

Thus, in an exemplary embodiment, there is a method 1000, as represented by the flowchart of FIG. 10, which entails classifying a first sound scene to which a hearing prosthesis is exposed according to a first feature subset during a first temporal period (method action 1010), and evaluating the effectiveness of the classification of the first sound scene according to the first feature subset, and maintaining that first subset (method action 1020). In an exemplary embodiment, the first sound scene can correspond to classical music in which Bach is played by the city of X orchestra. Subsequently, method actions 1030 and 1040 are executed, which respectively entail classifying a second sound scene to which a hearing prosthesis is exposed according to the first feature subset during a second temporal period (method action 1030), and evaluating the effectiveness of the classification of the second sound scene according to the first feature subset (method action 1040). However, in this exemplary embodiment, the second sound scene is a specific variation of classical music, Wagner. The evaluation of the effectiveness of the classification of the second sound scene in method action 1040 results in a determination that the classification is not as utilitarian as otherwise might be the case. Accordingly, at method action 1050, a second feature subset based on an evaluation of the effectiveness of the classification of the second sound scene is developed. Subsequently, at method action 1060, during a third temporal period separate from and after the first and second temporal periods noted above, the first and second sound scenes are classified according to the second feature subset (which is different from the first feature subset) during a third temporal period of exposure of the hearing prosthesis to the first sound scene and/or the second sound scene. In an exemplary embodiment, the first sound scene, which corresponds to the classical music of Bach, which occurs during the third temporal period, is classified utilizing the second feature subset which was developed in response to the evaluation of the classification of the Wagner music. In an exemplary embodiment, after method action 1060, an evaluation of the effectiveness of the classification of the first sound scene according to the second feature subset is executed (e.g., method action 1020, except for the second feature subset instead of the first feature subset). In this exemplary embodiment, upon a determination that the second feature subset is acceptable or otherwise has efficacy, the second feature subset is continued to be utilized by the hearing prosthesis/the sound classification system (e.g., maintaining the second subset). Alternatively, and/or in addition to this, in an exemplary embodiment, after method action 1060, an evaluation of the effectiveness of the classification of the second sound scene according to the second feature subset is executed. If a determination is made that the second feature subset has efficacy with respect to classifying the second sound scene, that second feature subset is maintained for use by the hearing prosthesis.

Corollary to the above is that in an exemplary embodiment, after method action 1060, a scenario can exist where the efficacy of the second feature subset is not utilitarian with respect to the classification of the first and/or second sound scenes. Accordingly, in an exemplary embodiment, after method action 1060, there could be a scenario where a third feature subset is developed based on the evaluation of the effectiveness of the classification of the first and/or second sound scenes utilizing the second feature subset. For example, it might be determined that the second feature subset has efficacy with respect to the first sound scene, but not for the second sound scene. Still further by example, it might be determined that the second feature subset has efficacy with respect to the second sound scene, but not for the first sound scene.

Figure 11:
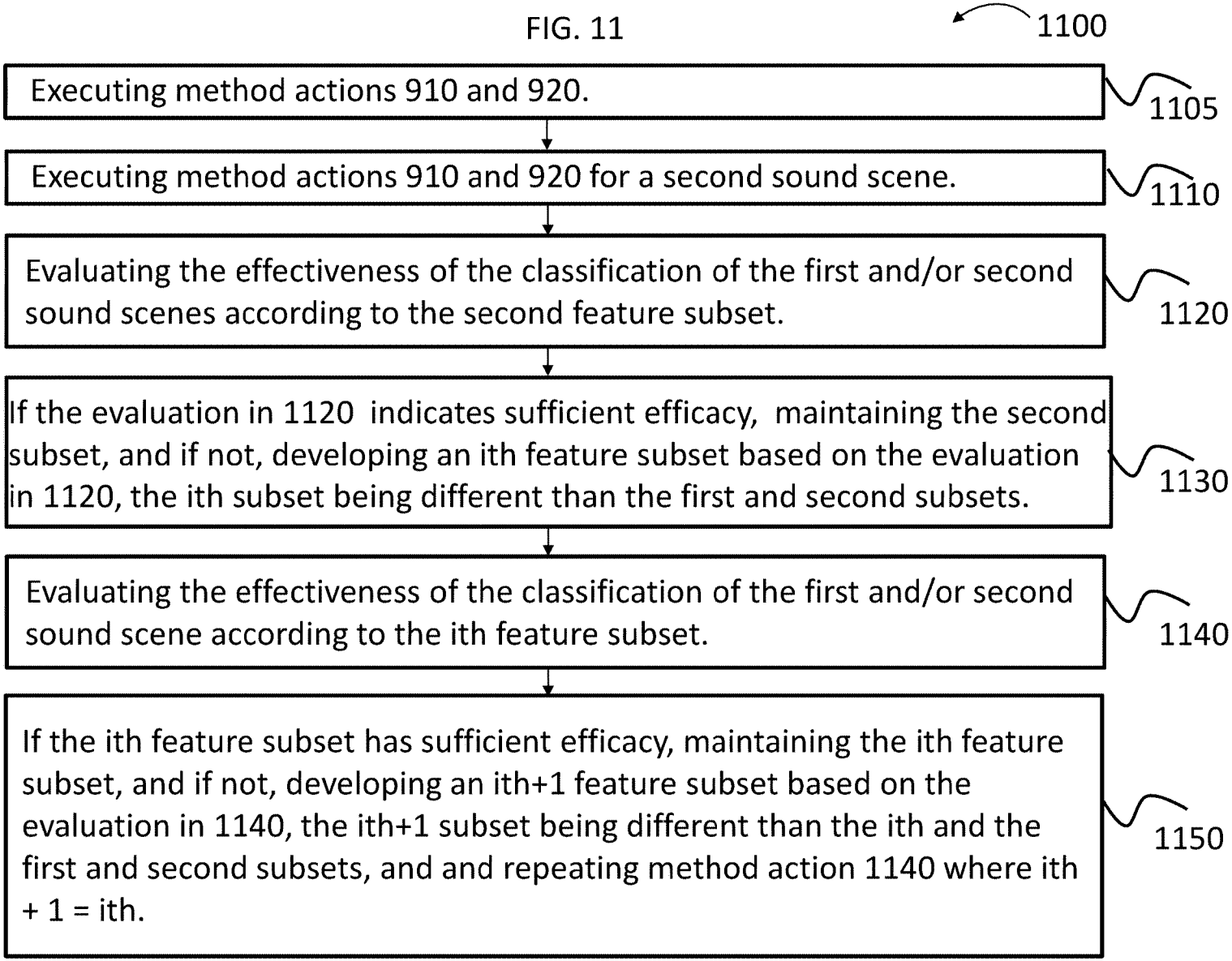
FIG. 11 presents another exemplary flowchart for an exemplary method according to an exemplary embodiment.

In view of the above, FIG. 11 presents an exemplary flowchart for an exemplary method 1100. Method 1100 includes method action 1105, which entails executing method actions 910 and 920. Method 1110 further includes method action 1110, which entails executing method actions 910 and 920 for a respective second sound scene (i.e., replace the words "first sound scene" with the words "second sound scene"). Here, the second sound scene is different than the first sound scene. Method action 1120 entails evaluating the effectiveness of the classification of the first and/or second sound scenes according to the second feature subset. With respect to method action 1130, if the evaluation of method action 1120 indicates sufficient efficacy of the classification of the first and/or second sound scenes according to the second feature subset, the second subset is maintained, and if not, an ith feature subset is developed based on the evaluation in method action 1120. The ith subset is different than the first and second subsets. At method action 1140, the evaluation of the effectiveness of the classification of the first and/or second sound scenes according to the ith feature subset is executed. At method action 1150, if the ith feature subset has sufficient efficacy, the ith feature subset is maintained and utilized for future classification. If the ith feature subset is not found to be sufficiently efficacious, and ith+1 feature subset is developed based on the evaluation and method action 1140. In this exemplary embodiment, the ith+1 subset is different than the ith and the first and second subsets. This is repeated until a subset is found to be sufficiently efficacious.

Figure 12A:
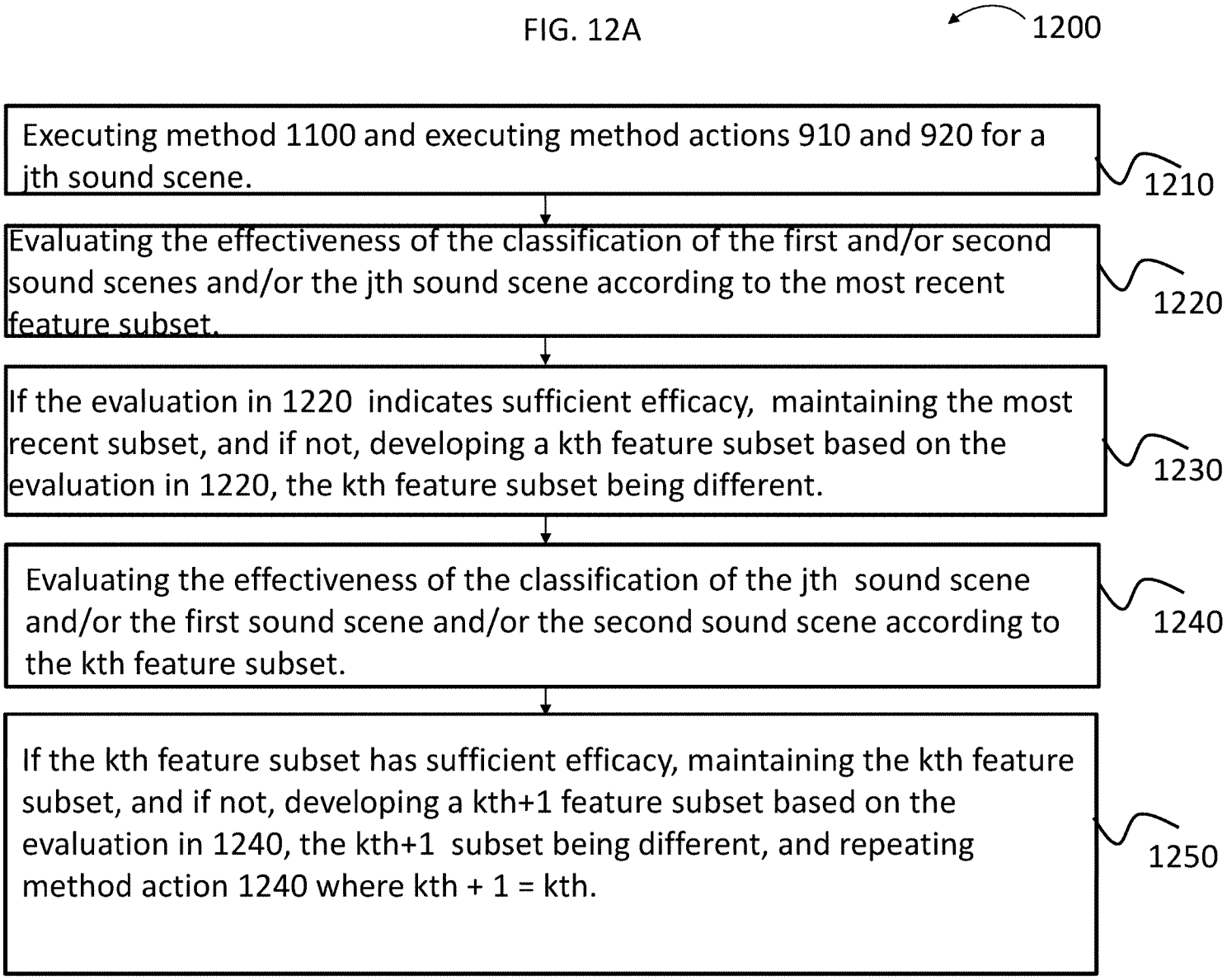
FIG. 12A presents another exemplary flowchart for an exemplary method according to an exemplary embodiment.
Figure 12B:
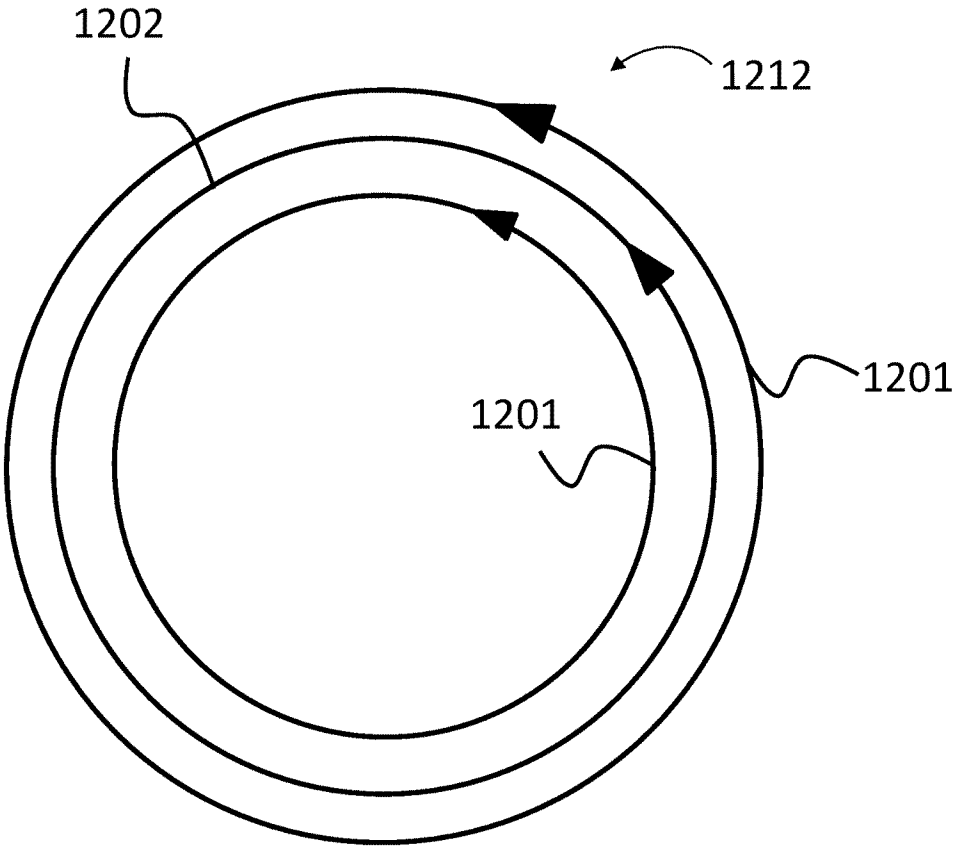
FIG. 12B presents a conceptual schematic according to an exemplary embodiment.

Note further that in an exemplary embodiment, method 1100 can be expanded for a third sound scene, a fourth sound scene, a fifth sound scene, a sixth sound scene, a seventh sound scene, an eighth sound scene, a ninth sound scene, a $10^{th}$ sound scene, an $11^{th}$ sound scene, a $12^{th}$ sound scene, a $13^{th}$ sound scene, a $14^{th}$ sound scene, or a $15^{th}$ sound scene, or more sound scenes, where each of the aforementioned sound scenes in this paragraph is cumulative of the prior sound scenes (e.g., the 5th sound scene is not just for book keeping/naming convention, but represents that there are five (5) different sound scenes being managed by the sound classification system). Accordingly, in an exemplary embodiment, after method 1100 is executed, and a feature subset is identified that has efficacy for the first and second sound scenes, method 1110 is executed for a third sound scene. Corollary to this is that FIG. 12A represents an exemplary flowchart 1200 for an exemplary algorithm, which includes method action 1210. Method action 1210 includes executing method 1100 and executing method actions 910 and 920 for a jth sound scene different than the first and second sound scenes. Method 1220 entails evaluating the effectiveness of the classification of the first and/or second sound scenes and/or the jth sound scene according to the most recent feature subset (e.g., the subset resulting from the conclusion of method 1100). At method action 1230, if the evaluation in method action 1220 indicates sufficient efficacy, the most recent subset is maintained. If not, a kth feature subset is developed based on the evaluation in 1220, this kth feature subset being different (e.g., different from the most recent subset, different from all prior subsets, etc.). At method action 1240, the efficacy of the classification of the jth sound scene and/or the first sound scene and/or the second sound scene according to the kth feature subset is evaluated. At method action 1250, if the kth feature subset has sufficient efficacy, the kth feature subset is maintained for purposes of sound scene classification. If the kth feature subset does not have sufficient efficacy, a jth+1 feature subset based on the evaluation at method action 1240 is developed, the jth+1 feature subset being different than the jth (and, in some embodiments, the prior subsets (all or some of them). Method action 1250 further includes repeating method action 1240 (returning to method action 1240). This is repeated until an effective kth feature subset is determined.

As noted above, embodiments can include the classification of a fourth sound scene, a fifth sound scene, a sixth sound scene, etc. Accordingly, in an exemplary embodiment, after executing method action 1250, there is an action which entails encountering a new sound scene jth+1 and executing method 1200 for jth=jth+1. This can be repeated for a number of new sound scenes in at least some exemplary embodiments.

Briefly, it is noted that in an exemplary embodiment, there is an exemplary method that includes executing method 800, and then subsequent to the actions of classifying the first sound scene according to the first feature subset and classifying the first sound scene according to the second feature subset of method 800, classifying an ith sound scene according to the second feature subset, wherein the ith sound scene is different than the first and second sound scenes. This method further includes executing an "i"th action, the ith action including (a) classifying the ith sound scene according to a jth feature subset different from the first feature subset and the second feature subset and (b) classifying an ith+1 sound scene according to the jth feature subset, wherein the ith+1 sound scene is different than the ith sound scene. This method further includes the action of re-executing the ith action where ith=the ith+1 (the ith+1 of (b)) and jth=jth+1 an integer number X times. In an exemplary embodiment, X=1, 2, 3, 4, 5, 6, 7, 8, 9, 10, 11, 12, 13, 14, 15, 16, 17, 18, 19, or 20, or more. The integer X can be any value between 1 and 1,000 and any range therein in 1 integer increments. Indeed, X can be any of the Xs detailed herein, whether that be a hard value or a counter. Also, X can be divided between different machines/prostheses, as detailed above and as will be described in greater detail below.

Further, it is noted that in an exemplary embodiment, there is an exemplary method that includes executing method 800, and then subsequent to the actions of classifying the first sound scene according to the first feature subset and classifying the first sound scene according to the second feature subset of method 800, classifying an ith sound scene according to the second feature subset, wherein the ith sound scene is different than the first and second sound scenes. This method further includes executing an "i"th action, the ith action including (a) developing a jth feature subset based on an evaluation of the effectiveness of the classification of the ith sound scene according to a current feature subset, (b) classifying the ith sound scene according to a jth feature subset different from the first feature subset and the current feature subset, and (c) classifying and ith+1 sound scene according to the jth feature subset, wherein the ith+1 sound scene is different than the ith sound scene. This method further includes the action of developing a jth+1 feature subset based on an evaluation of the effectiveness of the classification of the ith+1 sound scene according to the jth feature subset and re-executing the ith action where ith=the ith+1 (the ith+1 of (b)) and jth=jth+1 an integer number X times. In an exemplary embodiment, X=1, 2, 3, 4, 5, 6, 7, 8, 9, 10, 11, 12, 13, 14, 15, 16, 17, 18, 19 or 20 or more. The integer X can be any value between 1 and 1,000 and any range therein in 1 integer increments. Indeed, X can be any of the Xs detailed herein, whether that be a hard value or a counter. Also, X can be divided between different machines/prostheses, as detailed above and as will be described in greater detail below.

In view of the above, it can be seen that in exemplary embodiments, an iterative system can be utilized to classify various sound scenes. It is noted that the action of encountering sound scenes that are found to be classified in an ineffective manner using a given/current feature subset are, in some embodiments, a relatively rare situation relative to that which is the case where sound scenes are encountered that are found to be classified in an effective manner. That is, for the most part, at least in some embodiments, a given initial feature subset that is initially utilized (e.g., the initial sound classifier algorithm/the algorithm that would exist without the adaptation/learning/dynamic features associated with the teachings detailed herein) is one that is found to be useful for a statistically significant population. Accordingly, encountering a new sound scene where the current feature subset is not effective may not occur until after a number of other new sound scenes are encountered where the feature subset has adequate efficacy for those other new sound scenes. By way of example only, 1, 2, 3, 4, 5, 6, 7, 8, 9, 10, 11, 12, 13, 14, 15, or more new sound scenes might be encountered until a new sound scene is inadequately classified utilizing the current feature subset. Of course, in at least some embodiments, when such a new sound scene is inadequately classified, method 900 or any of the other methods detailed herein can be executed, and a new feature subset is developed for that new sound, and the hearing prosthesis utilizes the new feature subset during classifications of subsequent sounds. The above said, in at least some exemplary scenarios, the use of the new feature subsets will extend for a longer period of time than the use of the earlier feature subsets. In this regard, in an exemplary embodiment, because in the initial period of use, the hearing prosthesis can be exposed to new sound scenes at a higher frequency than during periods of later use (something is "new" only once). Accordingly, in an exemplary embodiment, there is an exemplary method that entails classifying a plurality of sound scenes according to the first feature subset (of, for example, method 800) for a first period of use of the hearing prosthesis, and classifying a plurality of sound scenes according to the second feature subset (of method 900) for a second period of use of the hearing prosthesis, wherein the second period of use extends temporally at least 2 times, 3, 4, 5, 6, 7, 8, 9, 10, 11, 12, 13, 14, 15 times, or more times longer than the first period of use. In an exemplary embodiment, the action of classifying a plurality of sound scenes according to the first feature subset could entail classifying a number of new scenes utilizing that first subset in a scenario where the first subset is deemed to have adequate efficacy with respect to classifying those sound scenes. It is noted that the action of classifying the plurality of sound scenes according to the first feature subset could occur where the first feature subset has been developed by repeatedly executing the various methods detailed above. In this regard, the first feature subset is presented in terms of nomenclature. The first feature subset could be the second developed feature subset of the sound classifier system, the third developed feature subset of the sound classifier system, the fourth, the fifth, etc.

Note that in at least some exemplary embodiments, the goal of adjusting or otherwise developing new feature subsets that are utilized to replace prior feature subsets is to develop an optimized feature subset for the particular recipient. In at least some exemplary embodiments, the goal is to develop a feature subset that can provide adequate efficacy with respect to classifying as many sound scenes as possible utilizing that particular subset. In this regard, an exemplary method includes executing method 800 or 900, and further classifying the first sound scene according to a third feature subset different from the second feature subset during a third temporal period of exposure of the hearing prosthesis to the first sound scene. This third temporal period of exposure of the hearing prosthesis to the first sound scene is different than the first temporal period of method 800 and method 900. This method further includes the action of developing this third feature subset based on an evaluation of the effectiveness of the classification of a second sound scene different from the first sound scene, wherein the second sound scene is first encountered subsequent to the development of the second feature subset. That is, in this method, the third feature subset is developed to accommodate the second sound scene. This third feature subset set is also developed to accommodate the first sound scene. That is, the purpose of developing the third feature set is to develop a feature subset that efficaciously classifies the second sound scene and the first sound scene. Corollary to this is that in an exemplary embodiment, there is a method that entails classifying the first sound scene according to a fourth feature subset different from the first and second feature subsets and different than the third feature subset during a fourth temporal period of exposure of the hearing prosthesis to the first sound scene. This method further includes the action of developing the fourth feature subset based on an evaluation of the effectiveness of the classification of a fifth and/or a sixth and/or a seventh and/or an eighth and/or a ninth and/or a tenth sound scene different from the first and/or second and/or third and/or fourth and/or fifth and/or sixth and/or seventh and/or eighth and/or ninth sound scene wherein the latter sound scenes are first encountered subsequent to the development of the third feature subset.

While the above exemplary embodiments of the feature sets utilized by the scene classifier for the hearing prostheses have focused on the utilization of audio data as the components thereof (e.g., spectral sharpness, zero-crossing rate, etc.), in an alternative embodiment, the feature sets can include or otherwise utilize extra audio/extra sound data (sometimes referred to herein as nonaudio data/non sound data). By way of example only and not by way of limitation, in an exemplary embodiment, the scene classifier can utilize a feature of geographic location as part of the feature set. For example, in an exemplary embodiment, the scene classifier can be configured to utilize one or more of the above-noted aforementioned audio features (e.g., the mel-frequency cepstral coefficients), and could also utilize a geographic feature. For example, in a scenario where one of the features is a geographic location of the recipient, and in an exemplary scenario, the recipient is located in a city at ground level, this could be taken into account and otherwise utilized as part of the feature set by the scene classifier system of the prosthesis. In an exemplary scenario, this could result in the algorithm of the scene classifier more likely determining that non-voice and non-music sound constitutes noise than that which would be the case if the geographic location of the recipient is on the top of a mountain, for example, or if the geographic location was not utilized as a feature, and the other audio features were so utilized (the other audio features utilized in this exemplary scenario). Note that embodiments that utilize extra-audio features do not necessarily imply utilizing fewer or less of the audio features. That is, the utilization of extra audio features could be in addition to the number of audio features utilized in a given feature set. That said, in alternative embodiments, the extra audio features could displace one or more of the audio features utilized in the establishment of a feature set/feature subset). Corollary to this is that in an exemplary embodiment where, for example the geographic location of the recipient is at the top of a mountain or the like, this can be taken into account or otherwise utilized as part of the feature set by the scene classifier system of the prosthesis. This could result in the algorithm of the scene classifier more likely determining that a non-voice and non-music sound constitutes a wind environment than that which would be the case of the geographic location of the recipient was inside a building (which could be extrapolated from the geographic location). In this regard, it is noted that in an exemplary embodiment, the hearing prosthesis includes a global positioning system receiver or the like, or is configured to utilize cellular phone technology so as to determine a location of the prostheses. Any device, system, and/or method that will enable the prosthesis to determine a location of the recipient can be utilized in at least some exemplary embodiments.

Accordingly, in an exemplary embodiment, there is a method that comprises adapting a scene classifier system of a prosthesis configured to sense a range of data (e.g., sound data) based on input based on data external (e.g., nonsound data) to the range of data. In an exemplary embodiment, the prosthesis is configured to evoke a sensory percept based on that sensed range of data, or otherwise evoke a sensory percept corresponding to that which would result if the sensed data within the range were sensed via a normal human being with a fully functioning sensory system. By way of example only and not by way of limitation, in an exemplary embodiment where the aforementioned prosthesis is a hearing prosthesis, the range of data sensed by the prosthesis will correspond to sound. Thus, the scene classifier of the prosthesis would utilize input based on non-audio data/non-sound data, such as by way of example, the aforementioned geographic location. Still further by way of example only and not by way of limitation, in an exemplary embodiment where the aforementioned prosthesis is a retinal implant, the range of data sensed by the prosthesis will correspond to light. Thus, the scene classifier system of the prosthesis will utilize input based on non-light data, such as by way of example, sound, or the aforementioned location data.

In an exemplary embodiment, the action of adapting the scene classifier system of the prosthesis configured to sense a range of data based on input based on data external to the range of data entails utilizing a different feature set to classify future scenes than that which was the case prior to the adaptation. For example, in the aforementioned scenario, a feature set that was utilized prior to the adaptation can entail a feature set that utilizes only audio data/sound data. Conversely, by way of example, based on various learning processes in accordance with the teachings detailed herein, the prosthesis could recognize that the use of the input based on data external to the range of data of the hearing prosthesis can have utilitarian value, and thus a feature set can be developed utilizing such a feature (e.g., locational data). In an alternate embodiment, again by way of example, based on various learning processes in accordance with the teachings detailed herein, the prosthesis could recognize that while the use of input based on data external to the range of data the hearing prosthesis can have utilitarian value, adapting the scene classifier system based on at least some data internal to the range of data is not as utilitarian, and thus eliminates the use of that data. For example, in a scenario where a current feature set utilized to classify scenes utilizes spectral sharpness, zero-crossing rate, spectral roll-off frequency, and locational data, the adaptation can result in the utilization of a feature set that utilizes zero-crossing rate, spectral roll-off frequency and locational data, but not spectral sharpness. That said, in an alternative embodiment, the primacy of the various components of the feature set (e.g., weighting of the components) can be reordered by way of the adaptation, thereby resulting in a different feature set that classifies future scenes than that which was the case prior to the adaptation. For example, in a scenario where the primacy of the components of a feature set are, from highest to lowest, spectral sharpness, zero-crossing rate, spectral roll-off frequency, and locational data, the different feature set that is utilized to classify future scenes could be such that the primacy of the components are, from highest to lowest, spectral sharpness, locational data, spectral roll-off frequency, and zero-crossing rate. Note also that consistent with the teachings detailed above, in some embodiments, additional components can be added to a given feature set while in other embodiments, components can be removed from a given feature set. Exemplary embodiments include adding and/or subtracting and/or weighting and/or reordering the primacy of any number of given features to establish a feature set that has utilitarian value.

It is noted that while the above embodiments have been described in terms of locational/geographic based data as the input based on data external to the range of data sensed by the prosthesis, in some alternate embodiments, the input based on data external to the range of data can be temporal based data. By way of example only and not by way of limitation, the input can correspond to a length of time subsequent to the first use of the prosthesis and/or the length of time subsequent to the period of time after the implantation of an implantable prosthesis (e.g., a retinal implant, a cochlear implant, a middle ear implant, etc.). In this regard, a more aggressive regime of adaptation of the scene classifier system may be utilized as the cognitive performance of the recipient increases with familiarity of the prosthesis. By way of example, a recipient who has been implanted with a cochlear implant for five years will, statistically speaking, have a relative level of cognitive performance that is higher than that which would otherwise be the case for that recipient after the cochlear implant has been implanted for only one year. Accordingly, the feature sets utilized by the scene classifier system could be those that are more conservative in the early years, and then become more aggressive as time progresses. Still further by way of example and not by way of limitation, the input can correspond to an age of the recipient. For example, statistically speaking, a child (e.g., a four, five, or six-year-old) would experience particular audio environments more often than that which would be the case with respect to a 20-year-old, all things being equal. Corollary to this is that for example, a person who is 85 or 90 years old, statistically speaking, would also experience particular audio environments more often than that which would be the case with respect to a 30-year-old, all things being equal. In this regard, with respect to the former category, it would be relatively likely that the recipient would be exposed to speech having a higher pitch of speech than that which would otherwise be the case (because he or she is interacting with and is around other children). Accordingly, the scene classifier system would be adapted based on the age of the recipient to accommodate this fact. Thus, as the recipient grows older, the prosthesis or other system adapts the scene classifier system to identify low pitched sounds as speech, this based on the age of the recipient. In an exemplary embodiment, the prosthesis can be configured to automatically do this based on an initial input as to the age of the recipient (e.g., at implantation or at fitting, the prosthesis could be provided with input corresponding to the age of the recipient, and an onboard clock could thus calculate the current age of the recipient utilizing standard algorithms (e.g., utilizing addition to add the time elapsed from fitting to the inputted date)). In an exemplary embodiment, via an elapsed time indicating that the child is about 13 years of age or so, (an age proximate puberty), the hearing prosthesis adapts itself to utilize lower frequencies as an indication of speech. Still further by way of example only and not by way of limitation, the input could be sociological input. For example, the input could be that an adolescent human is attending an all-girls high school, and thus the adaptation of the scene classifier system utilizing the pitch of speech to identify a speech scene might reduce the floor to the frequencies used to identify speech to a level not as low as that which might be the case if the adolescent human was attending a coed school or an all-boys school.

Note further that in at least some exemplary embodiments of these adaptations, the feature sets utilized for the scene classifications remain unchanged. That is, the utilization of the use extra audio features to adapt the scene classifier system can be executed without changing the underlying feature sets utilized by the scene classifier of the scene classifier system.

Figure 12C:
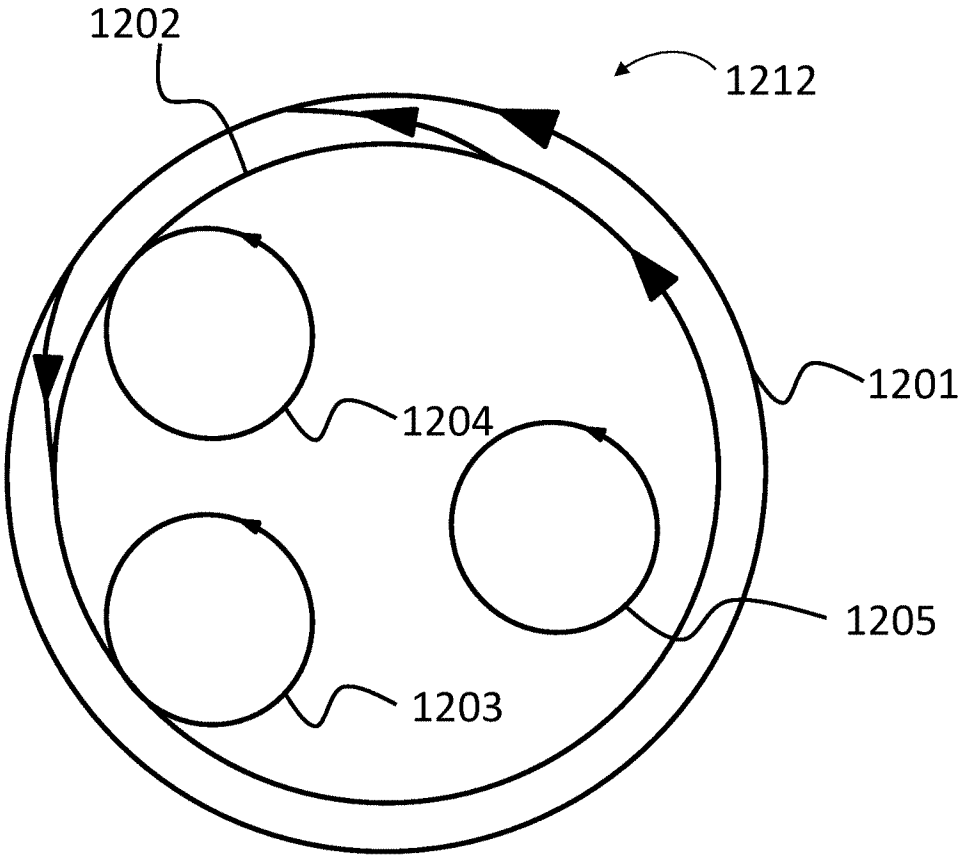
FIG. 12C presents another conceptual schematic according to an exemplary embodiment.

Note also that this concept can be applied, by way of example only and not by way of limitation, at the inception of a recipient's hearing journey to adapt a scene classifier system prior to any scenes ever being classified. In this regard, FIG. 12C represents an exemplary flowchart for an exemplary method, method 1299, that includes a method action 1260, which entails obtaining a prosthesis. Method action 1270 entails evaluating the non-audio/extra audio data. Method action 1280 entails adapting the scene classifier system of the prostheses based on the evaluation. More specifically, method action 1270 can entail evaluating non-audio/extra audio data automatically. By way of example only and not by way of limitation, the prosthesis could request input indicative of one or more non-audio features. For example, in the case of a hearing prosthesis, data indicative of the recipient's age, the recipient's gender, the recipient's post-lingual deafness period, the recipient's preference in music if any, the recipient's occupation, the location of the recipient's home, etc., could be queried by the prosthesis, and such can be inputted into the prosthesis. The prosthesis can evaluate this data, and based on this evaluation, adapt the scene classifier system accordingly. By way of example, if the age of the recipient is that of a young child, the "child scene classifier regime" will be selected and used for the prosthesis. Conversely, if the age of the recipient is that of an elderly person, the "elderly scene classifier regime" would be utilized. Still further, in an exemplary embodiment, if the occupation of the recipient is that of a construction worker, the "construction worker scene classifier regime" would be utilized, and if the recipient is an office worker, the "office worker classifier regime" would be utilized. These scene classifier regimes will be different from one another, and would utilize, in at least some exemplary embodiments, common auditory scene analysis algorithms for the respective statistically significant groups of recipients (young child, elderly, construction worker, office worker, respectively).

These varying classifier regimes can be pre-developed, and pre-programmed into the hearing prosthesis. Upon inputting the non-audio data into the prosthesis, the prosthesis can be configured to automatically select one of these scene classifier regimes, and thus adapt the scene classifier system accordingly. That said, in an alternate embodiment, the action of evaluating the non-audio data of action 1270 can entail utilizing a lookup table or the like, or user's manual for the hearing prosthesis. In this regard, the recipient could be instructed to utilize a lookup table presented in a user's manual, and input a given code or otherwise set the prosthesis according to entries of the user's manual for given non-audio data. That said, in an alternate embodiment, an audiologist or the like can set the prosthesis to utilize a given scene classifier regime based on the non-audio data.

Thus, in view of the above it can be understood that in an exemplary embodiment, different groups of hearing prosthesis recipients will encounter common audio environments, and thus non-audio features can be related to audio features. Thus, these non-audio features can be utilized to draw conclusions about which classifier regime implementation has more utilitarian value for a given recipient based upon which common group to which the recipient belongs.

Accordingly, not only can some embodiments of the teachings detailed herein utilize extra audio and/or non-audio data so as to adapt a scene classifier of a hearing prosthesis in the period after a recipient commences use thereof, but also embodiments can be utilized to adapt a scene classifier at the inception of use or in close proximity thereto. Note that while the above embodiment has been described in terms of a hearing prosthesis, other embodiments are applicable to other types of prostheses, such as by way of example only and not by way of limitation, a retinal implant. In this regard, any disclosure herein with respect to non-audio data corresponds to a disclosure of non-X data, where X corresponds to the range of data that a given prosthesis is configured to sense (light in the case of the retinal implant, etc.).

It is briefly noted that in an exemplary embodiment, the aforementioned input based on data external to the range of data constitutes user input indicative of a satisfaction with an adaptation of the scene classifier system. With reference to the above-noted scenarios where the hearing prosthesis is exposed to, for example, bossa nova music, if the prosthesis or other system, such as a remote system, has previously adapted the scene classifier system, and the scene classifier of the system subsequently classifies the scene with the bossa nova music based on the adaptation, and adjusts the operation of the hearing prosthesis according to this classification, and the recipient does not like the change, the recipient can override or otherwise provide input to the prosthesis or another device (e.g., a smart phone) indicating such. The prosthesis or other system such as a remote system can receive this input, either in real-time or subsequently, and determine that the classification was not as utilitarian as that which might have otherwise been the case. The prosthesis or other system can thus develop a new feature set different from that which was utilized to classify the scene, and thus adapt the scene classifier system accordingly. In an exemplary embodiment, the input indicative of a satisfaction with an adaptation of the classifier corresponds to input directly to the hearing prosthesis. In an exemplary embodiment, the hearing prosthesis has an override button (specifically dedicated to such, or a shared functionality button where the functionality of override is moved to the forefront of functionalities upon a scene classification and adjustment to the prosthesis according to the scene classification), and thus the action of depressing or otherwise operating that button provides input indicative of the satisfaction with the adaptation of the classifier. In an exemplary embodiment, the hearing prosthesis can be configured to receive a verbal input by the recipient indicating the satisfaction or satisfaction with the adjustments resulting from the scene classification. Indeed, it is noted that the aforementioned override button can instead be an input button indicating that the recipient likes the changes to sound processing as a result of the classification of the sound, where depressing the button or otherwise operating the button corresponds to input indicative of a satisfaction with an adaptation of the classifier. In some alternative embodiments, the recipient can simply mentally note an approximate time where change was made that he or she did or did not like, and provide input in a manner akin to that which would result from an analogous "test drive" of a vehicle, where the input is in more general terms (e.g., "the hearing prosthesis automatically made a few changes that I could notice and I would have rather it not made those changes," "I thought that the hearing prosthesis was operating better during the second part of the day than it was during the first part of the day," etc.).

It is further noted that input can be indirect/based on latent variables, concomitant with the examples of recipient feedback detailed above. By way of example only and not by way of limitation, the input can correspond to data relating to the temporal proximity to the first volume adjustment by the recipient of the hearing prosthesis after the change to the operation of the hearing prosthesis based on the classification of the scene. Corollary to this is that the input can be event non-occurrence based data (e.g., where the recipient does not override the change made to the sound processing that is made based on the sound classification). Granted, while the current method is directed towards adapting a scene classifier system of a prosthesis based on input, as will be described in greater detail below, by way of example only and not by way of limitation, the input can be utilized in a machine learning algorithm or the like, where the machine learning algorithm is utilized to adapt the scene classifier system. The absence of an occurrence of an event can be utilized by the machine learning algorithm as an indication that the machine learning algorithm is on a trajectory that has utilitarian value, and thus can, in some embodiments, further adapt the scene classifier system based on this trajectory. In another exemplary embodiment of event non-occurrence based data, and adaptation can be made "permanent" based on the lack of a feedback from the recipient indicating that the adjustments to the hearing prosthesis based on a "temporary" adaptation or otherwise a "temporary" feature set are unacceptable. That said, in a scenario where the prosthesis actively looks for affirmative acceptance from the recipient subsequent a change in the sound processing by the prosthesis (e.g., depressing a button indicating that a change in the processing should be maintained), the event nonoccurrence based data can correspond to the absence of the recipient depressing or otherwise providing input indicative of acceptance of the change.

In an exemplary embodiment, the input can correspond to the input indicative of the capabilities of the recipient to perceive certain sounds. By way of example only and not by way of limitation, a recipient might "learn" to perceive certain sounds that he or she otherwise previously could not perceive during the course of the recipient's hearing journey. Accordingly, prior to such, there would be no point in identifying and classifying such sound environments. However, subsequent such, there can be utilitarian value at least in some exemplary embodiments of identifying and classifying such sound environments. Thus, an exemplary embodiment entails an embodiment where the input corresponds to input based on hearing test performance of a recipient of the hearing prosthesis.

By "based on the hearing test performance," it is meant both input directly corresponding to the results of a hearing test (e.g., yes/no results for given frequencies at given volumes) and input that is extrapolated from the hearing test performance/that corresponds to the functional utilitarian value of the results of the hearing test (e.g., certain frequencies should be given more weight than others, certain frequencies should be disregarded with respect to classifying a scene, etc.).

In an exemplary embodiment, the method detailed above that includes the action of adapting the scene classifier system of the prosthesis based on input based on the data external to the range of data sensed by the hearing prosthesis further includes the actions of adjusting a signal processing regime based on the adapted scene classifier system, and evoking a sensory percept based on the adjusted signal processing. This is to be understood from the above. Note further that in an exemplary embodiment, the aforementioned method and variations thereof further includes the actions of adapting the scene classifier system, adjusting the signal processing regime and evoking the sensory percept as just detailed without adjusting a feature regime of the scene classifier of the prostheses. By without adjusting a feature regime of the scene classifier of the prosthesis, this means that neither the components that make up the regime nor the primacy/weighting of those components are changed. That said, in an alternate embodiment, the aforementioned method and variations thereof further include the actions of adapting the scene classifier system, adjusting the signal processing regime and evoking the sensory percept as just detailed without adjusting the components of the feature regime.

It is noted that the phrase scene classifier system includes both the scene classifier feature and the components that are utilized by the prosthesis to implement actions that enable the utilitarian value of the scene classifier in the first instance. In this regard, an exemplary utilitarian value of the scene classifier is that the classification of the scene can be utilized as a basis for the processing of the signals in a different manner for different scenes, or at least certain scenes. Thus, with respect to an exemplary embodiment where the aforementioned method actions associated with adapting the scene classification system are executed without adjusting the feature regime, the adaption corresponds to adapting the way that the prosthesis processes the sensed data corresponding to a given scene. For example, in an exemplary scenario where the input based on data external to the range of data of the hearing prosthesis corresponds to the age of the recipient, the scene classification system adapts the way that the sensed data corresponding to a given scene is processed to accommodate for the fact that the recipient has different needs at different ages, or has different limitations at different ages. Thus, the feature sets may be the exact same as that which existed prior to the adaptation, weighted the exact same way, but the way that the scene classifier system instructs the processor to process the sensed data underlying the classified scene is different. Continuing with the age example, in an exemplary embodiment, a given scene corresponding to music may be processed in a first manner in a pediatric scenario, and in a second manner different than the first manner in a teenage scenario, and/or in a third manner in a mid-fifties scenario, and/or in a fourth manner in an elderly scenario. In this regard, certain scenes can be more important at certain ages relative to the importance of those scenes at other ages. For example, in the pediatric scenario, the frequencies of the voice of the mother and father of the child might be considered paramount to all other scenes. As the child gets older, a scene corresponding to the voice of the mother and a scene corresponding to the father might be processed differently (e.g., permitting a higher level of background noise than that which would be the case in the prenatal example, permitting a greater range of stimulation channels in a cochlear implant, giving primacy to the frequencies of the mother's voice as opposed to the father's voice during a period where the mother is nursing, etc.).

Also, in another exemplary scenario with respect to someone nearing the later stages of life, someone in their 50s or 60s may be inclined to prefer classical music and/or jazz music, and consider rock music as noise instead of music, even though such would be considered music by others. In an exemplary embodiment, this can be age-based where the algorithms utilized to classify scene or more likely to classify rock music as noise as the recipient gets older. Alternatively and/or in addition to this, this can be a scenario that results from input or feedback from the recipient.

Still further, considering the scenario of someone in their 60s, such a person may be a retired person, where the person spends a considerable amount of time at their home. Their typical auditory exposure could be to the television, some bingo, and a limited set of relatives that are visiting. Thus, an exemplary scenario can be such where the input based on data external to the range of data of the hearing prosthesis corresponds to the date (because the recipient is somewhat immobile, save for the bingo excursions) and the scene classification system adapts itself to accommodate the given scenes (e.g., based on date, the scene classification system could factor in the likelihood that the given sound is that of bingo if such is the recipients bingo day or the given sound is that of the relatives as it is near a given holiday or the like).

The above has generally focused on methods of implementing at least some exemplary embodiments. Some exemplary systems and apparatuses will now be described. Before proceeding, it is briefly noted that the disclosure of any method action detailed herein corresponds to a device and/or a system that is configured to implement or otherwise execute that method action, including such systems and/or devices that can execute such method action in an automatic manner.

Figure 13:
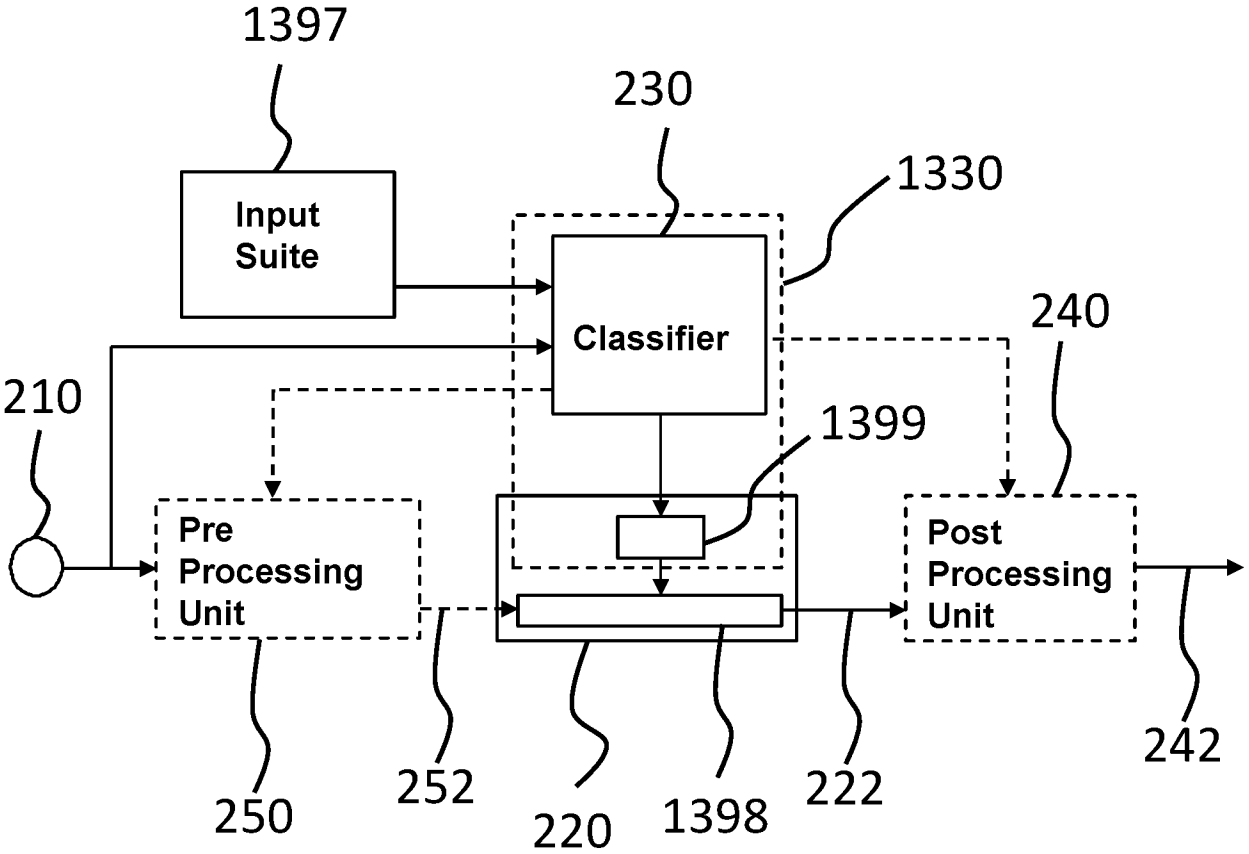
FIG. 13 presents another exemplary functional schematic according to an exemplary embodiment.

Briefly, as noted above, an exemplary embodiment includes a scene classifier system that includes a classifier and the componentry that is utilized to adjust the processing of the captured/sensed data (e.g., sound) based on the scene classification. In this regard, FIG. 13 depicts an exemplary prosthesis corresponding to that of FIG. 2 detailed above, where additional details are provided in FIG. 13. Specifically, a scene classifier system is functionally represented by block 1330, which includes the classifier 230 as detailed above, and signal processing adjustment block 1399, which is in signal communication with the classifier 230. In an exemplary embodiment, a signal processing adjustment block receives input from the classifier 230 indicative of the scene classification, and adjusts the signal processor(s) 1398 accordingly. In an exemplary embodiment, the adjustment of the signal processor(s) 1398 achieves the above noted method action of processing the sensed data in a different manner relative to that which was the case prior to the adaptation of the scene classification system 1330. In an exemplary embodiment, signal processing adjustment block 1399 includes circuitry or hardware and/or firmware that enables the input from the classifier 230 to be evaluated and to control the signal processor(s) 1398 based on the given scene classification.

FIG. 13 depicts input suite 1397. In an exemplary embodiment, input suite 1397 can correspond to the button detailed above that enables the recipient to provide feedback to the prosthesis indicative of satisfaction with respect to a change in the signal processing resulting from a scene classification. Accordingly, as can be seen, input suite 1397 is in signal communication with the classifier 230 of the scene classifier system 1330. That said, in an alternate embodiment, input suite 1397 can be in signal communication with another component that is in turn in communication with a component that is in signal communication with the classifier 230. This other component can also be part of the scene classifier system, or can be a component that is separate from the scene classifier system. In an exemplary embodiment, the component can be a logic circuit or can be software and/or firmware that is configured to adapt the classifier, while in alternate embodiments, the classifier itself includes the logic and/or software and/or firmware that adapts the classifier. Still further, in an alternate embodiment, the input from input suite 1397 simply reconfigures the classifier so as to be adapted. That is, the classifier itself does not adapt itself, but an outside source adapts the classifier/classifier system. Corollary to this is that input suite 1397 can alternatively and/or in addition to this be in direct signal communication with the signal processing adjustment block 1399. Any device, system, and/or method that will enable the teachings detailed herein to be implemented can utilize in at least some exemplary embodiments.

It is noted that alternatively and/or in addition to this, the input suite 1397 can correspond to a receiver of a global positioning system or can correspond to a locating device, such as those utilized in a cellular phone. Accordingly, input suite 1397 corresponds to a device that receives the input based on data external to the range of data that is sensed by the prosthesis. In an alternate embodiment, the input suite could be a quartz based clock or a clock based on a ring oscillator. In an alternative embodiment, the input suite can correspond to a microphone configured to receive a recipient's voice indicative of feedback. The input suite could be a touchscreen display. It is to be understood that input suite 1397 can have other functionalities as detailed herein, consistent with a device that can enable the input based on data external to the range of data that is sensed by the prosthesis to be inputted into the prosthesis.

Figure 14:
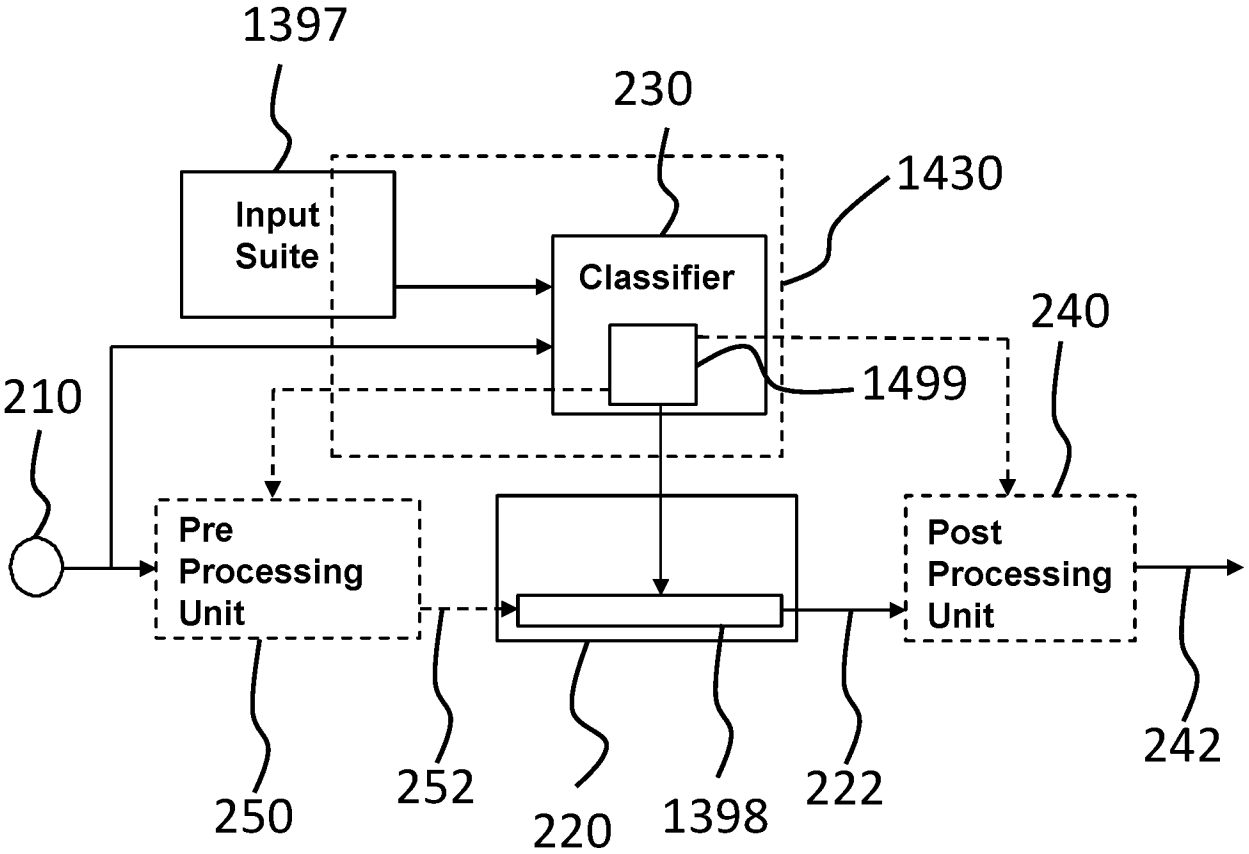
FIG. 14 presents another exemplary functional schematic according to an exemplary embodiment.

FIG. 14 depicts an alternate exemplary functional diagram that is a modification to that of FIG. 13. Here, the signal processing adjustment block is part of a larger adjustment block 1499 which is depicted as being located within the scene classifier 230, but could be located elsewhere, and the scene classifier system 1430 has been expanded to illustrate that a portion of the input suite 1397 is part of that system 1430. Note that the signal processing adjustment block 1399 is no longer in the processor 220. This embodiment represents an embodiment where the adjustment block 1499 adjusts not only the signal processor 1398, but also the preprocessing unit 250 and the post processing unit 240. By way of example, with respect to the exemplary scenarios regarding changing the processing strategy with respect to scenarios of life, not only does the scene classification system 1430 adjust the signal processor 1398 as the recipient grows older so as to process the received signal 252 differently, the scene classification system also adjusts the preprocessing unit 250 and/or the post processing unit 240 so as to process the signal from transducer 210 and/or signal 222 differently as the recipient grows older.

In an exemplary embodiment, there is a prosthesis, such as by way of example and not by way of limitation, a sense prosthesis (e.g., a retinal implant, a cochlear implant), comprising a scene classifier system, and an output unit configured to evoke a sensory percept of a recipient. In an exemplary embodiment, the scene classifier system can correspond to scene classifier system 1330 of FIG. 13. The scene classifier system can include a classifier corresponding to any classifier known in the art that can have utilitarian value and otherwise enable at least some of the teachings detailed herein and/or variations thereof. In an exemplary embodiment, the output unit can correspond to an electrode array or the like for a retinal prosthesis and/or an electrode array for a cochlear implant. In an exemplary embodiment, the output unit can correspond to an actuator of a middle ear implant and/or a bone conduction device and/or a speaker (receiver) of a conventional hearing aid. In an exemplary embodiment, the aforementioned scene classifier system can include an adaption sub-system that enables adaptation of an operation of the scene classifier system, and the prosthesis is configured to receive input indicative of an evaluation of an adaption of the scene classifier, and enable adjustment of the adaptation sub-system. In an exemplary embodiment, the adaptation subsystem can be part of the classifier 230 of the scene classifier system 1330. In an exemplary embodiment, the adaptation subsystem can be a separate component therefrom. In an exemplary embodiment, the adaptation subsystem can be part of the input suite 1397, thus extending the scope of the scene classifier system 1330 to include that portion of the prosthesis of FIG. 13.

With respect to the feature that the scene classifier system includes an adaptation subsystem that enables adaptation of an operation of the scene classifier system, this can correspond to any circuit arrangement (including microprocessor arrangement, chips, etc.) and/or firmware arrangement and/or software arrangement that can enable the adaptation. In an exemplary embodiment, the subsystem is configured so as to enable the prosthesis to adapt by itself/enable the prosthesis to have a self-adapting scene classifier system. In an exemplary embodiment, such can utilize the aforementioned user feedback methods/can enable the above-noted scenarios of adjusting or otherwise modifying or otherwise creating new feature sets. Accordingly, in an exemplary embodiment, the subsystem can correspond to the input suite 1397, which can receive input indicative of a recipient's satisfaction/dissatisfaction with an implemented adaptation of the scene classifier system. In an alternate embodiment, as will be described in greater detail below, the subsystem can correspond to a device that is configured to receive input from a remote reference classifier as will be described in greater detail below, and based on that input, enable the adaptation of an operation of the scene classifier system.

It is noted that in this exemplary embodiment, the aforementioned prosthesis does not require the prosthesis per se to perform the adjustment of the adaptation of the scene classifier system. In an exemplary embodiment, the adaptation subsystem can be an input suite that is configured to receive data generated remotely from the prosthesis (such as a remote facility) and adapt the scene classifier system remotely. Additional details of such an exemplary scenario are described in greater detail below.

With respect to the feature of the prosthesis regarding receiving input indicative of an evaluation of an adaptation of the scene classifier, this can correspond to the aforementioned feedback from the recipient, and thus can be implemented via the input suite 1397. In an alternative embodiment, this feature can correspond to a scenario where a remote device that evaluates the adaptation and provides data indicative of that evaluation to the prosthesis. Again, as will be described in greater detail below, some embodiments utilize a reference classifier that is located remotely. In an exemplary embodiment, this reference classifier is utilized to evaluate the adaptation based on its "superior knowledge" of the universe of possible scenes relative to that which is the case of the prosthesis (to the extent that the prosthesis has any knowledge at all of even a subset of the universe of possible scenes—instead, the prosthesis can simply identify the occurrence of a new scene and adapt accordingly—more details on this feature to be provided below). Note further, that in an exemplary embodiment, the feature regarding receiving input indicative of an evaluation of an adaptation of the scene classifier can also correspond to that which results from a device corresponding to an "override" switch or an override button or an override input unit, etc. In an exemplary embodiment, where the prosthesis changes or otherwise adjusts the signal processor 1398 utilizing the signal processing adjustment block 1399 as a result of a scene classification by the classifier 230, and the recipient does not like the resulting adjustment, the recipient can use the input suite 1397 as an override to change the signal processing back to which was the case prior to the adjustments of the signal processor 1398 by the signal processing adjustment block 1399. This can correspond to receiving input indicative of an evaluation of adaptation of the scene classifier.

Still, in an exemplary embodiment, the feature of the capability of receiving input indicative of an evaluation of an adaptation of the scene classifier can correspond to input indicative of a rigorous evaluation of an adaptation of the scene classifier. By "rigorous," it is meant evaluation beyond the subjective evaluation of the results of the change in the signal processing resulting from the scene classification by the recipient.

With respect to the feature of the enablement of adjustment of the adaptation subsystem, in this regard, the prosthesis can change how the adaptation subsystem adapts. That is, not only does the adaptation subsystem adapt the operation of the scene classifier system, but how that adaptation subsystem adapts can be adjusted as well. In an exemplary embodiment, this can have utilitarian value with respect to improving the performance of the adaptation subsystem.

In at least some exemplary embodiments, the prostheses detailed herein and/or variations thereof are configured to automatically adjust the adaptation subsystem based on the received input indicative of an evaluation of the adaptation of the scene classifier. Again, in one of the more straightforward examples, recipient input indicative of a satisfaction and/or a dissatisfaction with the change in the signal processing resulting from a classification of a given scene can be utilized as input indicative of an evaluation of the adaptation of the scene classifier, and thus the adaptation subsystem can be automatically adjusted.

With reference to the feature of adjusting the adaptation subsystem, in an exemplary embodiment, the performance of the adaptation subsystem is changed so that the adaptation of the scene classifier resulting from a given set of circumstances is different than that which would be the case for those same circumstances. Note that this is different than having the scene classifier classify a given scene differently utilizing different features. Here, how the scene classifier system develops a given feature set to adapt to a new scene is different from how the scene classifier system would have developed the given feature set to adapt to the new scene prior to an adjustment of the adaptation subsystem. By very loose analogy, the adaptation of the operation of the scene classifier system could correspond to velocity, whereas the adjustment of the adaptation subsystem would correspond to the derivative of the velocity (e.g., acceleration).

By way of exemplary scenario, for the following scene occurrences 1-10 encountered by the prosthesis in a temporally progressing manner (e.g., scene occurrence 1 occurs before scene occurrence 2, scene occurrence 2 occurs before scene 3, etc.) the following feature sets are used to classify those scenes:

| 1 | 2 | 3 | 4 | 5 | 6 | 7 | 8 | 9 | 10 |
|---|---|---|---|---|---|---|---|---|---|
| A | B | C | B | D | D | D | E | F | F |

Here, the scene classifier system is operated in an adaptive manner (in an exemplary embodiment, controlled by the adaptation sub-system) such that the feature sets utilized by the scene classifier system are different in some instances with respect to an immediately prior scene occurrence, and in some instances, the feature sets utilized by the scene classifier are different than any previously utilized feature set. In some instances, the feature sets that are utilized are the same as those utilized in prior scene occurrences. In any event, the algorithm utilized to adapt the scene classifier system is constant during scene occurrences 1 to 10. Conversely, in an exemplary embodiment utilizing an adjustable adaptation subsystem, an exemplary scenario can occur where the prosthesis and/or a remote system identifies that the adaptation that led to the development of feature set C was not as utilitarian as otherwise might be the case, based on the fact that at scene occurrence 4, the scene classification system had reverted back to the previous feature set B. In this regard, in an exemplary embodiment, recognizing that the algorithm produced a less than utilitarian occurrence, the hearing prosthesis or the remote system or the recipient or a third party makes an adjustment to the adaptation subsystem. In an exemplary embodiment, the adjustment is directed to an algorithm that is utilized by the subsystem to adapt the scene classifier system. By way of example only and not by way of limitation, in a scenario where the adjustment is made between scenes occurrences 3 and 4, for the above scene occurrences 1-10 encountered by the prosthesis in a temporally progressing manner, where the scenes of the scenes of the scene occurrences are identical, the feature sets on the bottom row are used to classify those scenes (where the middle row corresponds to that above, and is presented for comparison purposes):

| 1 | 2 | 3 | 4 | 5 | 6 | 7 | 8 | 9 | 10 |
|---|---|---|---|---|---|---|---|---|---|
| A | B | C | B | D | D | D | E | F | F |
| A | B | C | G | H | I | J | J | K | L |

As can be seen, the adjusted adaptation subsystem results in a feature set G for scene occurrence 4, whereas the non-adjusted adaptation subsystem resulted in the utilization of feature set B for scene occurrence 4. This is because the adjusted adaptation subsystem utilized an algorithm that was adjusted prior to scene occurrence relative to that which was utilized in the above control scenario. Note further that in some instances, because of the adjustments to the adaptation subsystem, the feature sets were changed from a previous feature set, whereas in the scenario where the adaptation subsystem was not adjusted, the feature sets were the same relative to a previous feature set used for a prior scene occurrence. For example, it can be seen that the feature set for the scene occurrence 6 is the same as that utilized for scene occurrence 5 with respect to the non-adjusted adaptation subsystem. Conversely, it can be seen that the feature set for the scene occurrence 6 is different than that which was utilized for the scene occurrence 5 with respect to the adjusted adaptation subsystem. That is, whereas the non-adjusted subsystem would not have made a change between scene occurrence 5 and scene occurrence 6, the adjusted adaptation subsystem does make a change between those scene occurrences. Also, it can be seen that in some instances, whereas the non-adjusted adaptation subsystem makes a change between two scene occurrences (e.g., scene occurrence 7 and scene occurrence 8), the adjusted adaptation subsystem does not make a change between the two scene occurrences. In an exemplary embodiment, this can be because the adjustments to the adaptation subsystem has made the adaptation of the operation of the scene classifier less sensitive to a phenomenon associated in scene occurrence 8 than that which was the case with respect to the non-adjusted adaptation subsystem. Note that in this exemplary scenario, this could have been a result of the adjustment to the adaptation subsystem that occurred after scene occurrence 3. That said, in an alternate exemplary scenario, this could have been a result of a further adjustment that resulted after the first adjustment. For example, when the algorithm of the adjusted adaptation subsystem changed the feature set after scene occurrence 5 to feature set I, the recipient could have provided feedback indicating that the adjusted signal processing regime that evoked a sensory percept for the scene of scene occurrence 6 was not acceptable. Thus, not only did the adaptation subsystem adapt the operation of the scene classifier, a machine learning algorithm of the prosthesis recognized the input from the recipient and adjusted the algorithm of the adaptation subsystem.

Thus, under an exemplary embodiment where the bottom row of the chart above presents the scenario corresponding to the adjustment of the adaptation subsystem after the first adjustment, an exemplary scenario where there was no adjustment of the adaptation subsystem after the first adjustment could be as follows:

| 1 | 2 | 3 | 4 | 5 | 6 | 7 | 8 | 9 | 10 |
|---|---|---|---|---|---|---|---|---|---|
| A | B | C | G | H | I | I | I | M | N |

To be clear, note that the above exemplary scenarios are for illustrative purposes only. The above exemplary scenarios have been presented in terms of a serial fashion where the adjustments to the adaptation subsystem occur after a given scene occurrence. Note however that the adaptations can occur during a given scene occurrence. The chart below presents an exemplary scenario of such:

| 1 | 2 | 3 | 4 | 5 | 6 | 7 | 8 | 9 | 10 |
|---|---|---|---|---|---|---|---|---|---|
| A | B | C/M | M | N | N/O/P | P | P | P | F |

As can be seen from the above chart, during scene occurrence 3, the scene classifier starts off utilizing a feature set C. During the occurrence of that scene occurrence (scene occurrence 3), the prosthesis or a remote system receives input indicating that that feature set C that was developed in the adaptive manner (resulting in a change of the feature set utilized by the scene classifier system from B to C) is not as utilitarian as that which may be the case. In an exemplary embodiment, the adaptive scene classifier system then develops a feature set M. This can be done in an exemplary scenario utilizing the non-adjusted adaptation subsystem just as was the case for the development of feature set C. That said, in an alternative embodiment, the input indicating that feature set C is not as utilitarian as that which may be the case is utilized to adjust the algorithm utilized by the adaptation subsystem, such that when the scene classifier system develops the replacement feature set for feature set C, the scene classifier system develops that feature set in a manner different than it would have developed had not the adaptation subsystem been adjusted. Corollary to this is that at scene occurrence 6, it can be seen that three different feature sets are utilized by the scene classifier system during that occurrence. In an exemplary embodiment, a determination is made that feature set N is not as utilitarian as that which might be the case, and the scene classifier system develops a new feature set O utilizing the adaptation subsystem in a state that corresponded to that which resulted in the development of feature set N. That is, there was no adjustment to the adaptation subsystem between the development of feature set N and feature set O. Conversely, upon receiving input indicative of a determination that feature set O is not as utilitarian for the scene of scene occurrence 6, the adaptation subsystem can be adjusted and feature set P is developed utilizing that adjusted adaptation subsystem.

Note also that an adjustment to the adaptation subsystem need not necessarily result in the development of a different feature set for a given scene relative to that which might have otherwise been the case in the absence of the adjustment. For example, an adjustment could have occurred after scene occurrence 7, but the feature set developed by a scene classifier system utilizing the adjusted adaptation subsystem could still result in the same feature set (e.g., P), as can be seen by the above chart. Note further that the above chart indicates that the feature set developed by the scene classifier system and utilized to classify the scene in scene occurrence 10 in the scenario where the adaptation subsystem is adjusted is the same as that which results from the scene classifier system utilizing the unadjusted adaptation subsystem (feature set F). This can be a result of a variety of reasons. That is, by way of example, an adjustment to the adaptation subsystem could have occurred prior to scene occurrence 10 that would have returned the scene classifier system to a state corresponding to that which was the case prior to one or more of the adjustments to the adaptation subsystem (more on this below).

It is noted that in an exemplary embodiment, the prosthesis is configured to automatically adjust the adaptation sub-system based on the input received by the prosthesis indicative of the evaluation of the adaptation of the scene classifier. It is further noted that in an exemplary embodiment, the prosthesis is configured to automatically adjust the adaptation subsystem based on received input based on non-audio phenomena. In this regard, in an exemplary embodiment, the hearing prosthesis is configured such that the adaptation subsystem is adjusted based on a geographic location of the recipient. By way of example only and not by way of limitation, a scenario can exist where a recipient spends an extended period of time within an urban environment. The adaptation subsystem will adapt the operation of the scene classifier system according to a given algorithm, one that might be specialized or otherwise specifically targeted to the urban environment, irrespective of whether such an algorithm is specialized or otherwise specifically developed for that recipient (e.g., one that is developed using machine learning and/or a genetic algorithm—more on this below). Continuing with a scenario, say, for example, after spending six months in an urban environment, such as New York City, U.S.A., the recipient travels to Tahiti, or takes a week long hike along the Appalachian trail, or travels to Brazil. The sound scenes that the recipient will encounter will be different in these locales than that which was the case during the recipient's six month stay in the aforementioned urban environment. In an exemplary embodiment, the input received by the prosthesis can correspond to input of a global positioning system that the prosthesis can utilize to determine the recipient's geographic location. Based on this geographic location, the prosthesis can automatically adjust the adaptation subsystem so that the adaptation of the operation of the scene classifier system while the recipient is in these various locations will be executed according to, for example, a different algorithm. In an exemplary embodiment, such as where a machine learning algorithm is utilized to adjust the adaptation subsystem, a scenario can exist where the machine learning function is shut down during the period of time that the recipient is in the aforementioned locations remote from the urban environment. Such can have utilitarian value with respect to avoiding "infecting" the algorithm with input associated with occurrences that will likely not reoccur after the recipient's stay in the aforementioned remote localities. That said, in an alternative embodiment, in a scenario where the recipient's stay in such localities is longer than a predetermined period of time, the adaptation subsystem can be adjusted so as to reengage the machine learning. Corollary to this is that in an exemplary embodiment, the machine learning can be ongoing, but the results of the machine learning are not implemented with respect to adjusting the signal processor of the prosthesis until a period of time has elapsed. That is, the prosthesis can be configured to develop or otherwise modify the algorithm that is utilized by the adaptation subsystem without implementing that algorithm, but instead while utilizing an old algorithm, such as that which existed prior to the recipient traveling to the remote locations, or another algorithm. This modified algorithm can be implemented after a period of time has elapsed where the "accuracy" of the modified algorithm is heightened due to the period of time that the prosthesis has been exposed to these new environments. That is, more data points/inputs are provided during this period of non-use so that when the algorithm is implemented, its accuracy is such that the recipient will find this of utilitarian value relative to that which might have been the case if the algorithm was continuously adjusted and implemented without interruption.

Still further, in an exemplary embodiment, the prosthesis can be configured such that the adjustments to the algorithm made during the period of time that the recipient was at the remote locations are automatically eliminated upon the receipt of input indicative of the recipient returning to the urban location. For example, during at least some of the period of time that the recipient was located at the remote locations, the adaptation subsystem adapted the scene classifier system to the scenes afforded by the remote locations. However, the status of the adaptation subsystem/settings thereof that existed at the time that the recipient left the urban area were recorded in memory within the prosthesis/maintained for future use. Upon the return to the urban area, the prosthesis can be configured to automatically adjust the adaptation subsystem to that which was the case prior to leaving the urban area/that which corresponds to the settings within the memory of the prostheses.

Note that while at least some of these exemplary embodiments have been directed towards the scenario where the prosthesis performs the adjustments and the prosthesis receives the input, in an alternate embodiment, a remote system can be utilized to adjust the adaptation subsystem. Note further that in an exemplary embodiment, such adjustment can be performed manually, or at least the initiation of such adjustment can be performed manually. Again, considering the scenarios detailed above, the recipient can input data into the prosthesis indicating that he or she is going into an environment that will have scenes that are different from the normal environment to which the prosthesis is exposed. In an exemplary embodiment, a user's manual can be provided to the recipient explaining scenarios where scenes will differ in a statistically significant manner vis-à-vis adaptation subsystem. For example, the recipient could have been trained to provide input into the prosthesis when he or she is traveling on vacation, boarding an airplane, staying away from work for an extended period of time, staying away from home for an extended period of time, etc. Thus, the prosthesis can receive the input indicating that statistically significant different scenes will be exposed to the prosthesis in a statistically significant manner. The prosthesis can thus adjust the operation of the adaptation subsystem accordingly.

Note further that in an exemplary embodiment, the prosthesis can be configured so as to utilize different adaptation regimes. In an exemplary embodiment, the prosthesis can jump back and forth between different adaptation regimes. For example, there could be the adaptation regime of the adaptation subsystem that is developed while the recipient is located in the urban environment, and then there is the adaptation regime of the adaptation subsystem that was developed while the recipient is located at the remote environment. The prosthesis (or other system) can be configured to remember or otherwise store the various adaptation regimes of the adaptation subsystem for the particular environments. Thus, upon the return of the recipient to the urban area, the adaptation regime for that urban area is implemented. Conversely, if the recipient later travels to one of the remote locations, the adaptation regime for that remote location is implemented. While some embodiments can be configured so as to execute such automatically, such as by way of example, utilizing a global positioning system, in other embodiments the prosthesis can be configured such that the input can be initiated by the recipient (e.g., the recipient could speak the words "Nucleus; input for Nucleus; I will be in Tahiti from April 25 to May 5; end of input for Nucleus," and such would initiate the features associated with utilizing the different adaptation regimes). Any device, system, and/or method that can enable such an implementation can be utilized in at least some exemplary embodiments.

Note also that while the above embodiments have been focused on a scenario where the periods of time at the remote locations are extensive/there is a large geographic distance between the locations, in an alternate embodiment, the adaptation system can be such that, for example, one regime is utilized while the recipient is at work, and another regime is utilized while the recipient is at home, and another regime is utilized while the recipient is in the car, etc.) That is, an exemplary embodiment entails bifurcating or trifurcating, etc. the algorithms utilized to adjust the adaptation subsystem based on the macroscopic environments in which the recipient is located at a given time. In this regard, the adaptation regimes can be separate regimes where adjustments to one do not affect the other or are otherwise are not utilized in the adjustments to the other. That said, in an alternate embodiment, the prosthesis or other system can be configured such that if a recipient experiences a change with respect to one adaptation regime when exposed to one macroscopic environment (e.g., while driving in the car, the recipient listens to talk radio, and an adaptation is made), and, the recipient finds that his listening experience is not as fulfilling in another macroscopic environment (e.g., at home, watching a night program on Fox News Channel or MSNBC which is generally analogous to talk radio but with near static television images of the humans talking) subsequently experienced, the recipient could provide input into the prosthesis or other system that there was something that he or she liked about the processing in the prior macroscopic environment, and thus the prosthesis or other system could be configured to automatically update a given change/ adjustment to the adaptation subsystem so that such is utilized in the adaptation regime for that other macroscopic environment.

To be clear, while some of the above embodiments have been described in terms of suspending adjustment to an adaptation algorithm while the recipient is at the remote location, other embodiments can entail operating the adaptation algorithm without any change thereto during the period of time that the recipient is at the remote location, or operating the adaptation subsystem such that the adaptation subsystem is adjusted without regard to the fact that the recipient has left the urban area. Still further, in an exemplary embodiment, the prosthesis or other system can be configured such that the adaptation subsystem adjusts itself upon returning to the urban area, such as by deleting any changes made to the adaptation regime that occurred while the recipient was away from the urban area and/or by reverting to the status of the adaptation regime at the time that the recipient left the urban area.

Figure 12D:
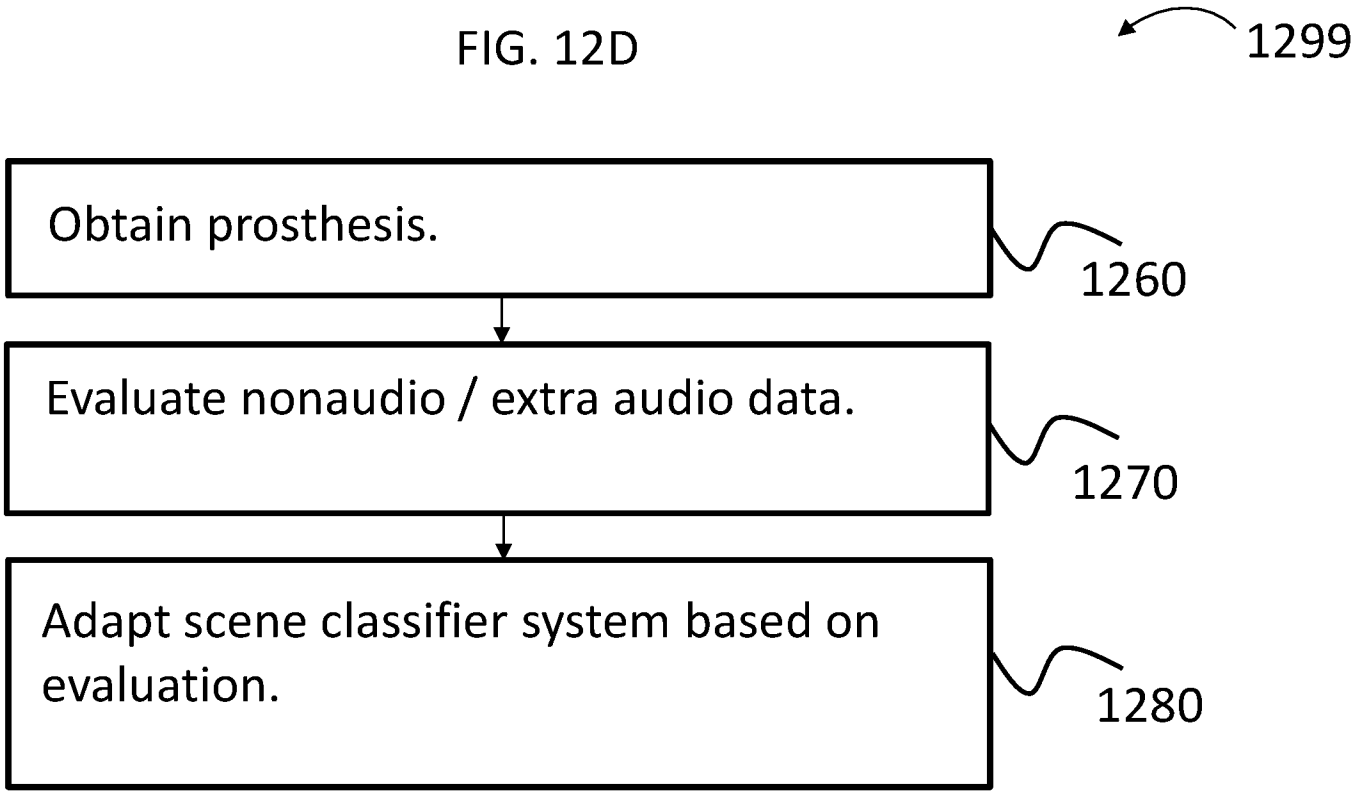
FIG. 12D presents another exemplary flowchart for an exemplary method according to an exemplary embodiment.

The way that the scene classifier adapts itself can change, both over the long term and in the short term. In this regard, FIG. 12D depicts an exemplary conceptual schematic representative of at least some of the embodiments of the adaptations of the scene classifier herein. Each loop of the group of loops 1212 represents a conceptual temporally based adaptation regime that controls the adaptation of the prosthesis. The inner loop 1201 represents the daily and/or weekly adaptation regime. The middle loop 1202 represents the monthly and/or yearly adaptation regime. The outer loop 1203 represents the multi-yearly adaptation regime. Conceptually, an exemplary hearing prosthesis or other system utilized to implement the teachings detailed herein can operate on a general basis according to an adaptation regime corresponding to loop 1202. However, in some scenarios of use, the recipient may find himself or herself in an environment that is different from that which is statistically speaking, one that dominates this middle loop 1202. For example, in the scenario where the recipient, who lives in an urban environment, travels to a remote location such as Tahiti, the scene classifier system could transition to an adaptation regime represented by the inner loop 1201 for that period of time. This adaptation regime could be much different than that to which the scene classifier system utilizes during the "normal" usage of the prosthesis/the normal sound environments in which the recipient is located. Upon the recipients return to his or her normal habitat, the prostheses will revert back to the adaptation regime represented by loop 1202. Conversely, the outer loop 1201 represents the adaptations that occur over the "lifetime" of the recipient's hearing journey, where the variations that occur over the lifetime are used to vary the adaptation of the middle loop 1202 as time progresses (e.g., over years).

It is also noted that while the above exemplary embodiments have generally focused on the adjustments to the adaptation subsystem, in an alternate embodiment, the above is applicable to the scene classifier system independent of any adaptation subsystem that might or might not be present. By way of example only and not by way of limitation, irrespective of the ability to adjust the adaptation regime of the prosthesis (e.g., the following is applicable to embodiments where the adaptation regime is static/there is no adaptation subsystem that is adjustable) the hearing prosthesis is configured such that the adaptive scene classifier temporarily classifies new scenes utilizing a newly developed feature set while the recipient is located at the remote locations, and then these newly classified scenes are deleted or otherwise removed from the scene classifier system when the recipient leaves the remote location. Again, by way of exemplary scenario, while the recipient is in Tahiti, the adaptive scene classifier system learns to identify new scenes associated with this new environment. During the period of time that the recipient is in Tahiti, the prosthesis or other system develops feature sets that are utilized by the adaptive scene classifier system. By way of example, during a two-week period in Tahiti, the adaptive scene classifier system can develop a feature set X after two days in Tahiti, and replace a current feature set Z that was developed primarily at least while the recipient was in the urban/home environment, and then develop a feature set Y for days after the developments of the feature set acts, which feature set Y supersedes feature set X, and which feature set Y is utilized for the remainder of the recipient's stay in Tahiti. Upon leaving Tahiti, the prosthesis or system adapts the scene classifier system so as to again utilize feature set Z, at least in an exemplary scenario where the recipient returns to the home location/urban area. Accordingly, in an exemplary embodiment, the prosthesis or system retains the previously identified scenes in its memory, and is configured so as to retrieve those previously identified scenes for use in the scene classifier system. Corollary to this is that in an exemplary embodiment, the prosthesis or system can be configured to delete the newly identified scenes that were developed in Tahiti, so that the scene classifier system is not infected or otherwise does not have to consider such scenes when running its algorithm after the recipient has left Tahiti, because these newly identified scenes are unlikely to be experienced again by the recipient in the near future/at least while the recipient is located at the urban area.

Such adaptation to the scene classifier system so as to default a return to the previously developed feature set and/or to delete various scenes can be executed or otherwise initiated manually and/or automatically. In an exemplary embodiment, a global positioning system can be utilized to indicate that the recipient is no longer in Tahiti, and thus the newly developed scenes can be erased from memory. Alternatively, in an alternate embodiment, a calendar system can be utilized, such that upon reaching May 5, the feature set Z is again utilized by the scene classifier system, and feature set Y is no longer used by the scene classifier system. Thus, in an exemplary embodiment, the prosthesis can be configured such that the adjustments to the scene classifier system made during the period of time that the recipient was at the remote locations are automatically eliminated upon the receipt of input indicative of the recipient returning to the urban location. Thus, in an exemplary embodiment, the prosthesis is configured such that upon return to the urban area, the prosthesis automatically adjusts the scene classifier system to the status of that which was the case prior to leaving the urban area/that which corresponds to the settings within the memory of the prostheses.

FIG. 12C is a figure conceptually representing the above scenario, where there are plurality of inner loops, representing adaptation regimes occur over a temporally shorter period of time than that of the middle loop 1202. As can be seen, loops 1204 and 1203 intersect with loop 1202. This is representative of the daily/weekly adaptations influencing the adaptation loop 1202. For example, loop 1204 can correspond to adaptation related to the recipient's workday scene environment, and loop 1203 can correspond to the adaptation related to the recipient's evening scene environment. Conversely, as can be seen, loop 1205 is offset from loop 1202. This is representative of the unique scene environments (e.g., the trip to Tahiti) that does not influence the adaptation loop 1202. Also as can be seen, there is interchange between the outer loop 1201 and the inner loop 1202. This represents the influence of the long-term adaptation on the middle loop 1202.

Still, consistent with the embodiments detailed above, feature set Y can be stored or otherwise retained in a memory, and upon the recipient returning to Tahiti or a similar environment, that feature set can be again utilized by the scene classifier system. The initiation of the use of the feature set Y can be performed automatically and/or manually. Again, with respect to the embodiment that utilizes a global positioning system, upon data from the global positioning system indicating that recipient is located in Tahiti (or an island of the Marianas, or in an exemplary scenario Polynesian Village in Disney World, Fla., USA), the feature set Y can be automatically utilized by the scene classifier system.

Again, as which is the case with respect to the embodiments directed towards the adjustments of the adaptation subsystem, in an alternate embodiment, a remote system can be utilized to adjust the scene classifier system based on this extra audio data. Note further that in an exemplary embodiment, such adjustment can be performed manually, or at least the initiation of such adjustment can be performed manually. Again, considering the scenarios detailed above, the recipient can input data into the prosthesis indicating that he or she is going into an environment that will have scenes that are different from the normal environment to which the prosthesis is exposed. The prosthesis can receive the input indicating that statistically significant different scenes will be exposed to the prosthesis in a statistically significant manner. The prosthesis can thus adjust the operation of the scene classifier system accordingly (e.g., use/delete feature sets, tag or identify new scenes as temporary scenes which will be deleted/relegated to memory at a given time/after a given occurrence, etc.).

Note also that while the above embodiments have been focused on a scenario where the periods of time at the remote locations are extensive/there is a large geographic distance between the locations; in an alternate embodiment, the adaptation system can be such that, for example, one feature set and/or one group of classified scenes is utilized while the recipient is at work, and another feature set and/or another group of classified scenes is utilized while the recipient is at home, and another feature set and/or another group of classified scenes is utilized while the recipient is in the car, etc.) That is, an exemplary embodiment entails bifurcating or trifurcating, etc. the feature sets utilized to adjust the adaptation subsystem based on the macroscopic environments in which the recipient is located at a given time. That said, in an alternate embodiment, the prosthesis or other system can be configured such that if a recipient experiences change in the processing of the prosthesis resulting from a scene classification utilizing a feature set and/or a set of scenes when exposed to one macroscopic environment (e.g., while driving in the car, the recipient listens to talk radio, and an adaptation is made), and the recipient finds that his listening experience is not as fulfilling in another macroscopic environment (e.g., at home, watching a night program on Fox News Channel or MSNBC) subsequently experienced, the recipient could provide input into the prosthesis or other system that there was something that he or she liked about the processing in the prior macroscopic environment, and thus the prosthesis or other system could be configured to automatically update the scene classifier system to utilize the feature set and/or the group of classified scenes utilized by the scene classifier system for that other macroscopic environment.

While the above exemplary scenarios are directed towards locational data as the input based on non-audio phenomenon, in an alternate embodiment, the received input is based on a temporal phenomenon, such as a period of time that has elapsed since the implantation of the prosthesis and/or the period of time that has elapsed since the first use of the prosthesis by the recipient and/or can be calendar/date specific based information. Still further, exemplary embodiments of non-audio phenomenon can correspond to age. Any of these can be utilized as a basis upon which to automatically adjust the adaptation subsystem. Other non-audio phenomenon can exist in other scenarios/embodiments.

In view of the above, in an exemplary embodiment, the prosthesis is configured to maintain a log of an operation of the adaptation sub-system, enable remote access to the log and enable remote adjustment of the adaptation sub-system of the scene classifier system based on the log.

Figure 15:
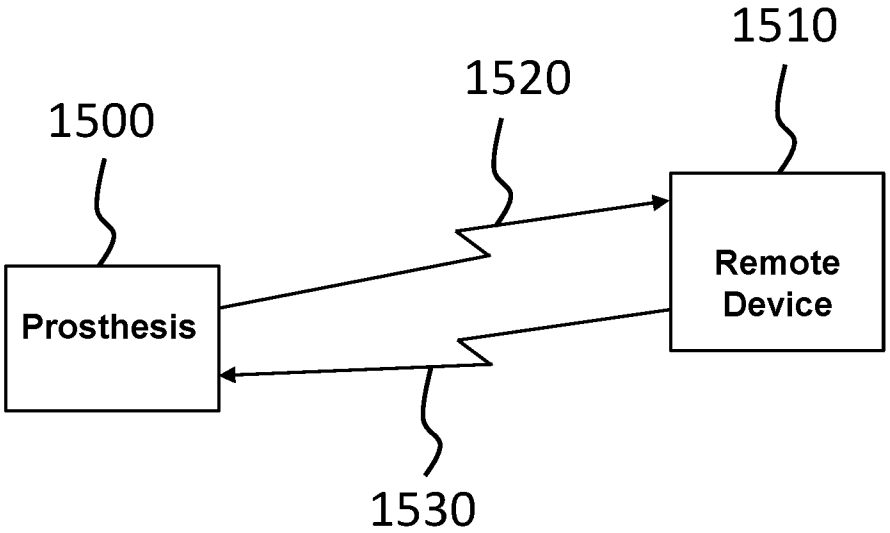
FIG. 15 presents another exemplary functional schematic according to an exemplary embodiment.

As noted above, at least some exemplary embodiments of the various prostheses can be utilized in conjunction with a remote device/remote system. In an exemplary embodiment, the processing capabilities of the prostheses are focused towards implementing the evocation of the evoked sensory percepts. In this regard, some of the automated functions with respect to the adjustment of the adaptation subsystem can be executed by a remote device. For example, at least some embodiments of the prostheses detailed herein are configured to maintain a log of an operation of the adaptation subsystem. The prosthesis is configured to enable remote access to the log (which includes the prosthesis being configured to upload the content of the log and/or the prosthesis being configured to have a remote device copy or otherwise extract the data from the log). Further, the prosthesis is configured to enable remote adjustment of the adaptation subsystem of the scene classifier system based on the log. This functionality is depicted by way of example functionally in FIG. 15, where communication 1520 between prosthesis 1500 and remote device 1510 represents the remote access to the log maintained in the prosthesis 1500, and where communication 1530 represents the remote adjustment of the adaptation subsystem of the scene classifier system of the prosthesis 1500 based on that log.

In an exemplary embodiment, the remote device can be a server of a computer network at a remote facility, such as by way of example, an audiologist's office and/or a facility of the manufacturer of the hearing prosthesis. Alternatively, in an exemplary embodiment, the remote device can be a recipient's personal computer in which is located software that enables the following teachings to be implemented. The remote device can further include software and/or firmware and/or hardware, powered by computer processors or the like, that can analyze the remotely accessed log to evaluate the performance of the adaptation subsystem. In an exemplary embodiment, the log of the operation of the adaptation subsystem can include data indicating how frequently a recipient made an adjustment to the prosthesis subsequent a scene classification by the prosthesis and the temporal proximity thereto. The remote device can include an algorithm that is based at least in part on statistical data that can make a conclusion of the satisfaction of the scene classification by the recipient based on the log of operation. For example, in an exemplary embodiment where a scene is classified that results in no change to the signal processing of the prosthesis, but the recipient in short order changes a volume of the prosthesis, it can be concluded that the satisfaction of the scene classification is not as utilitarian as it might otherwise be, at least with respect to that instance. In an exemplary embodiment, the remote device can be configured to analyze the entire log, or portions thereof. Based on this analysis, the remote device can, in an exemplary embodiment, develop or otherwise identify a utilitarian new algorithm for the adaptive subsystem, and adjust the adaptive subsystem of the hearing prosthesis by replacing the current algorithm with the new algorithm.

All of the above embodiments have focused on a log that includes recorded therein changes made to the operation of the hearing prosthesis initiated by the recipient. In an alternate embodiment, the log can include data indicative of the underlying phenomenon sense by the prostheses (and other data, as will be detailed below). By way of example, with respect to the embodiment corresponding to a hearing prosthesis, the prosthesis can record or otherwise store a given sound environment, or at least samples thereof in amounts that are statistically significant (memory storage limitations or laws barring the recording of conversations may limit the ability to record entire sound environments). Still further, in an exemplary embodiment, the prosthesis is configured to record or otherwise store proxy data indicative of the sound environment (e.g., data relating to frequency only). In an exemplary embodiment, compression techniques can be utilized. In this regard, a sound environment can be stored, or at least samples thereof, in a manner analogous to work into MP3 recordings. Any device, system, and/or method that will enable the recordation or otherwise storage of a sound environment they can have utilitarian value with respect to analyzing the performance of a scene classifier system can be utilized at least some exemplary embodiments.

Hereinafter, the data stored by the prostheses corresponding to the scene environments, either in full or via samples or via compression techniques or via proxy data—any technique—will be referred to as the stored/recorded sound environment for purposes of linguistic economy. Any such statement herein corresponds to any of the various species thereof unless otherwise specified.

In an exemplary embodiment, the prosthesis is configured to simultaneously store or otherwise record data indicative of the classification of the scenes in a manner that enables temporal correlation with the stored scene environments. Thus, in an exemplary embodiment, the prosthesis is configured to maintain a scene log. This data indicative of the classification of the scenes can correspond to just that; scene classification by name (e.g., bossa nova music, music by Prince, Donald Trump speech) and/or by nomenclature (analogous to the classification of "Typhoon Number 6" in The Hunt for Red October). In an exemplary embodiment, the prosthesis is configured to also simultaneously store or otherwise record data that is indicative of the feature sets utilized or otherwise developed by the prostheses or other system for that matter to classify the various scenes (thus, in an exemplary embodiment, the prosthesis is configured to maintain of the adaptation of the scene classifier system. Still further, the prosthesis can be configured to store or otherwise record data that is indicative of the adjustments to the prostheses by the scene classifier system based on the classified scene. Still further, consistent with the embodiment detailed above with respect to the maintenance of a log of an operation of the adaptive subsystem, in an exemplary embodiment, the prosthesis is configured to simultaneously store or otherwise record the aforementioned data in a manner that enables temporal correlation with the log of the operation of the adaptation subsystem.

An exemplary embodiment entails providing any of the aforementioned data to the remote device, automatically and/or upon manual initiation (e.g., the prosthesis can be configured to enable the remote device to access the scene log, etc.). In an exemplary embodiment, after accessing the data stored or otherwise recorded by the hearing prosthesis, the remote device and/or a remote entity (this action could be performed manually or semi-manually) can analyze the data and evaluate the efficacy of the scene classification system.

Figure 16:
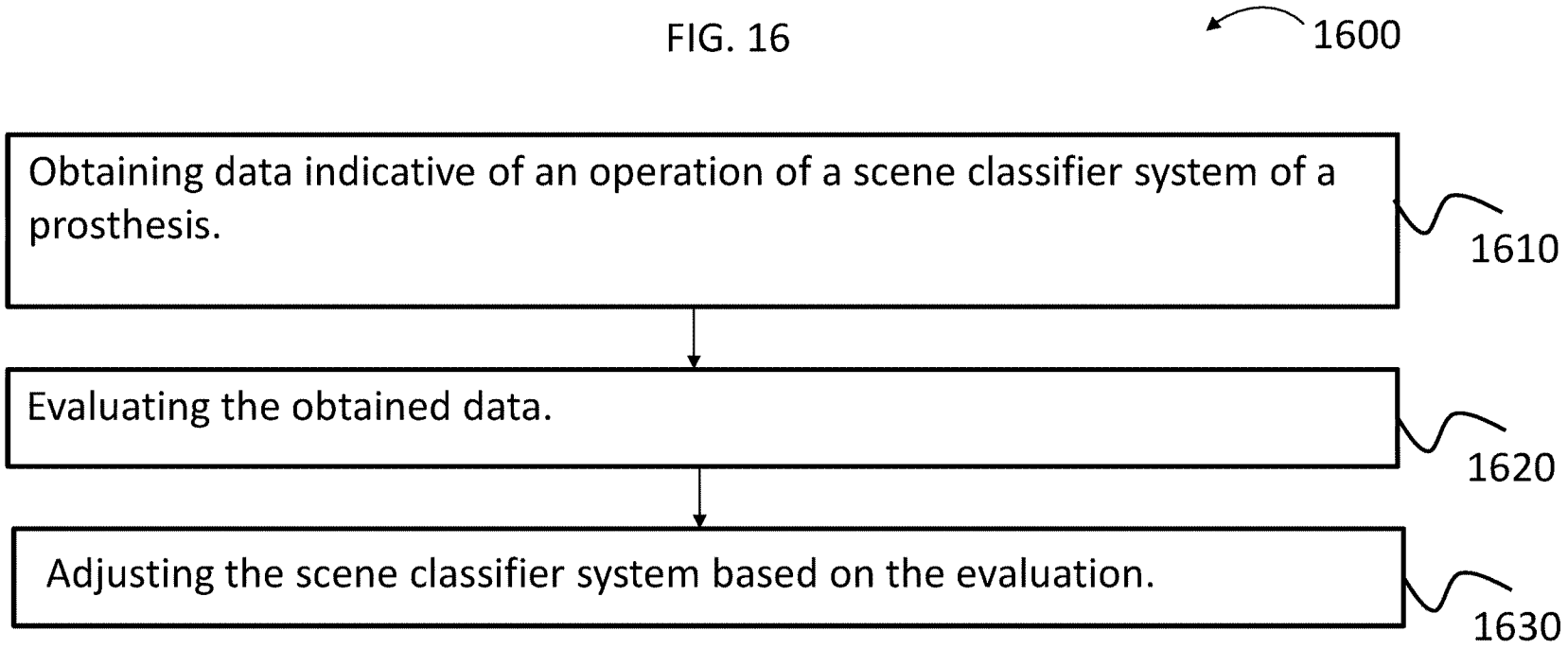
FIG. 16 presents another exemplary flowchart for an exemplary method according to an exemplary embodiment.

Briefly, FIG. 16 presents an exemplary algorithm for an exemplary method, method 1600, that corresponds to, at least in an embryonic matter, a method that can be utilized with respect to the teachings regarding the log(s) stored or otherwise maintained by the prosthesis. In this regard, with respect to method 1600, that method includes method action numeral 1610 which includes the action of obtaining data indicative of an operation of a scene classifier system of a prosthesis. In an exemplary embodiment, the data can correspond to any of the data detailed herein and/or variations thereof. In an exemplary embodiment, this can entail data that represents the historical sound environments of the prostheses and data representing the results of the scene classification system's classification of the sound environments, which can be temporally linked to the data that represents the historical sound environments. That said, in at least in some exemplary alternate embodiments, action 1610 can instead entail obtaining the data in a manner that represents the real time acquisition thereof. In this regard, in an exemplary embodiment, the prosthesis can be configured to communicate with a so-called smart phone or the like, and periodically provide the data indicative of the operation of the scene classifier system to the prosthesis (once every second, once every 10 seconds, once a minute, etc.). In an exemplary embodiment, the smart phone or the like analyzes the data itself (more on this below) or subsequently (immediately or with a temporally insignificant lag time matter) passes this data on to the remote device (e.g. utilizing cellular phone technology, etc.), where the remote device can be a remote facility of the manufacturer the hearing prosthesis etc., where the data is then analyzed.

However the data is obtained, subsequent to method action 1610, method action 1620 is executed, which entails evaluating the obtained data. In an exemplary embodiment, this can entail evaluating the data according to any of the teachings detailed herein relating to evaluating the efficacy of a given operation of a scene classification system. Any device, system, and/or method that can be utilized to evaluate the data, whatever that data is (in an exemplary embodiment, any data that can have utilitarian value with respect to implementing the teachings detailed herein can be utilized in at least some exemplary embodiments), can be utilized in at least some exemplary embodiments. In an exemplary embodiment, the action of evaluating the obtained data is executed utilizing a reference classifier at the remote device/remote location. In this exemplary embodiment, the reference classifier is a device that has a catalog of scenes stored therein or otherwise maintained thereby. In an exemplary embodiment, this can be considered a master catalog of the statistically significant scenes to which the prosthesis can be exposed. In an exemplary embodiment, this can be considered a master catalog of almost all and/or all scenes to which the prosthesis can be exposed. By way of example, this reference classifier could include hundreds or thousands or tens of thousands or even millions or more discrete scenes. In an exemplary embodiment, this reference classifier could include an individual scene for Donald Trump's voice, an individual scene for Hillary Clinton's voice, an individual scene for Barack Obama's voice, an individual scene for an Elvis impersonator's voice, etc. The reference classifier could include respective individual scenes for every type of music known to humanity (e.g., bossa nova music, indigenous Jamaican reggae music, non-indigenous Jamaican reggae music, clips and music, music by Bach, music by Wagner, etc.). In an exemplary embodiment, this reference classifier can include respective individual scenes at a level of magnitude that would surpass any of the pertinent memory capabilities of the prosthesis, at least at the current time (but note that in an exemplary embodiment, such a reference classifier can be incorporated into the prosthesis with regard to a limited subset of statistically significant scenes).

In this regard, in an exemplary embodiment, the action of evaluating the obtained data obtained in method action 1610 entails analyzing the data indicating the scene to which the prosthesis was exposed and comparing that data to the data in the reference classifier. The action of evaluating the obtained data further entails comparing the results of the scene classifier system of the prosthesis to the results that would occur had the prosthesis had the access to the reference classifier of the remote device. That is, the paradigm here is that the reference classifier is an all-knowing and perfect system or at least establishes a framework upon which the results of future classification of scenes will be compared (this latter concept is roughly analogous to the establishment of a dictionary by Webster in the 1800s—prior to that, various spellings for a given word were commonly accepted—Webster standardized the spellings choosing one spelling over the other in some instances in an arbitrary manner—thus, the reference classifier can be considered in some embodiments a way to standardize the various scenes—an exemplary embodiment of evaluating the obtained data could include comparing the identified scene identified by the scene classification system for the underlying scene environment data to that of the reference classifier for that same underlying scene environment data in a manner analogous to comparing a spelling of a word to the spelling of that word in a dictionary).

With reference back to FIG. 16, method 1600 further includes method action 1630, which entails adjusting the scene classifier system based on the evaluation executed and method action numeral 1620. In an exemplary embodiment, this can entail replacing a feature set currently used by the scene classifier system of the hearing prosthesis with a different feature set. In an exemplary embodiment, this can entail replacing a scene classification library/updating a scene classification library of the prostheses containing various scenes are classified by the prosthesis with the correct classified scene for the given scene environment.

Note also that in an exemplary embodiment, method action 1630 can entail adjusting the adaptation subsystem of the scene classifier system of the hearing prosthesis. In this regard, the adjustment can correspond to any of the adjustments detailed above where the algorithm of the adaptation subsystem is adjusted so that the scene classifier system adapts in a manner that is different than that which would have otherwise been the case for a given scene. By way of example only and not by way of limitation, as will be detailed in greater detail below, in a scenario where the prosthesis utilizes a machine learning algorithm, such as a genetic algorithm, the evaluation of the obtained data in method action 1620 would be utilized as input to the genetic algorithm, thus adjusting the scene classifier system based on this input. Additional details of such will be described below.

Figure 17:
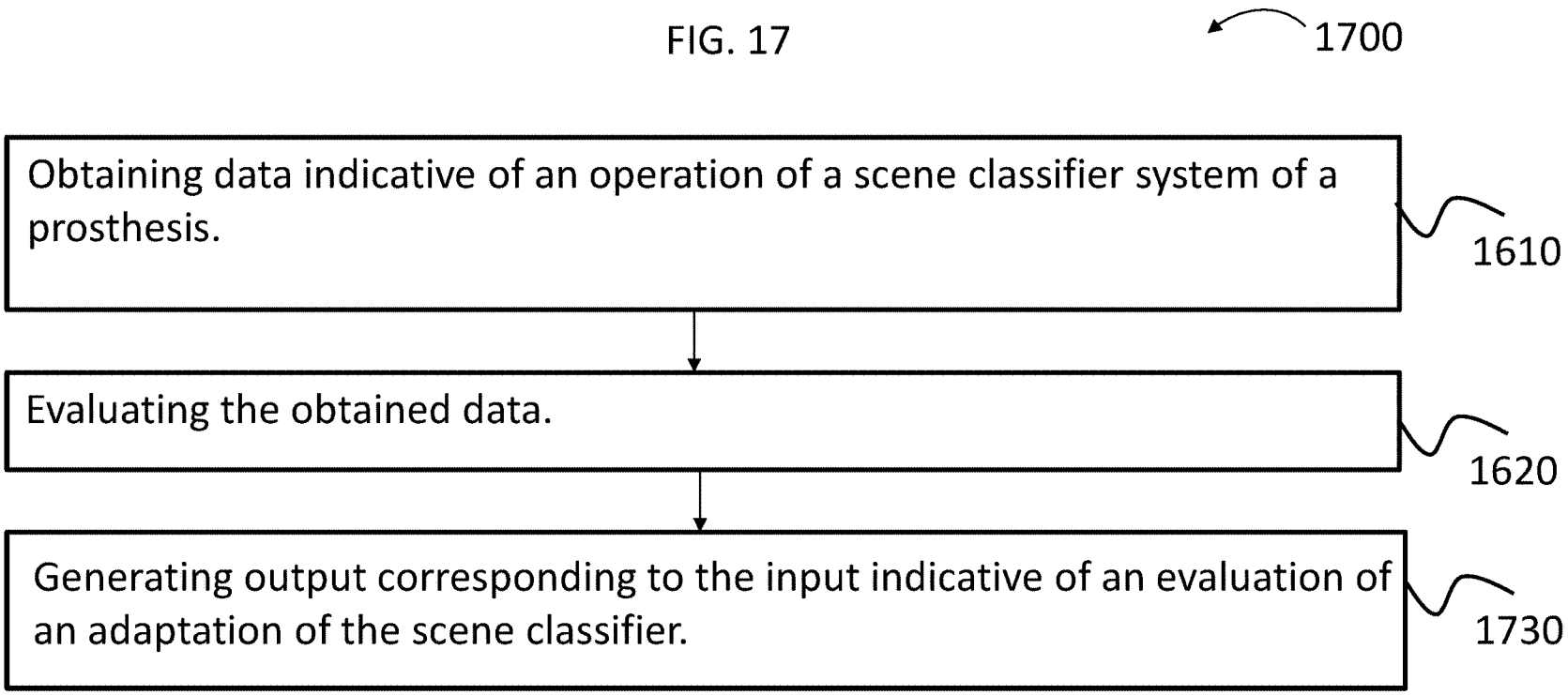
FIG. 17 presents another exemplary flowchart for an exemplary method according to an exemplary embodiment.

As noted above, some exemplary embodiments of the prostheses detailed herein are configured so as to receive input indicative of an evaluation of an adaptation of the scene classifier. In this regard, FIG. 17 represents an exemplary flowchart for an exemplary method, method 1700. Here, the first two method actions are identical to those of the method 1600. However, method 1700 further includes method action 1730, which entails generating output corresponding to the input indicative of an evaluation of an adaptation of the scene classifier. For example, the remote device can be configured to output a signal or a message that will be received by the hearing prosthesis indicating whether or not the hearing prosthesis correctly classified a given sound scene (e.g., based on the analysis of method action 1620). An indication that the hearing prosthesis did not correctly identify a given sound scene can be an indication that the adaptation of the scene classifier was less than utilitarian. In this regard, the prosthesis can be configured such that upon receipt of such an indication, the prosthesis adjusts the adaptive subsystem so that the adaptive subsystem would adapt the scene classifier system in a different manner than that which was the case upon experiencing one or more of the same scenes, all other things being equal. Again, with respect to the embodiment that utilizes the genetic algorithm, this output would be utilized to adjust the genetic algorithm again, details of which will be provided in greater detail below. Conversely, if the results of action 1730 were to generate output indicating that the evaluation of the adaptation of the scene classifier was a utilitarian adaptation, no adjustment would be made to the adaptive subsystem of the prosthesis.

In view of the above, it can be seen that in an exemplary embodiment, there is a method of re-training an adaptive scene classifier system of a hearing prosthesis so as to increase the accuracy of that scene classifier system. This method of re-training the adaptive scene classifier system includes providing input relating to the accuracy of previous actions executed by the adaptive scene classifier system. Some input is based on the reference classifier as detailed herein. Further, as noted above, some input is based on the evaluation of the results of the previous actions by the recipient of the prosthesis. Note that the two are not mutually exclusive.

Note further that in many respects, the method actions detailed herein can be considered to provide a personalized scene classifier system. This is the case not only with respect to the methods associated with or otherwise relying upon recipient/user feedback, but also with respect to the methods detailed herein that utilize the reference classifier. In this regard, even though the reference classifier is a system that is, at least in some embodiments, configured with data regarding almost every conceivable scene that could exist, because of the self-segregating actions of limiting exposure to only certain types of scenes by the recipient, the adaptive algorithm that is adjusted so as to have an algorithm that is optimized or otherwise specialized in identifying the given scenes more commonly exposed to a given recipient and that which could be the case for other recipients, the particular resulting algorithm is thus personalized. Indeed, this raises an issue associated with the teachings detailed herein. The adjustments to the scene classifier systems in general, and the adaptation subsystem in particular, can, in at least some embodiments, result in a scene classifier system that is in the aggregate not as accurate with respect to properly classifying a broad range of scenes (e.g. such as all of those or a large percentage of those in the reference classifier) as that which would otherwise be the case in the absence of the teachings detailed herein. In this regard, feature sets are developed that target the relatively limited number of scenes that a given recipient experiences, and these feature sets do not necessarily provide accuracy across the board. That said, in alternate embodiments, the adjustments to the scene classifier systems in general, and the adaptation subsystem in particular, can result in a scene classifier system that is more accurate across the board relative to that which is the case in the absence of the teachings detailed herein In view of the above, by utilizing a remote device, whether that remote device be a personal computer, a smart phone, or a mainframe computer located at a manufacturer's facility of the prosthesis, the superior computing power of such a remote device can be utilized to allow for highly accurate analysis of a given scene relative to that which would be the case with respect to that which can be obtained utilizing the prosthesis by itself.

In an exemplary embodiment, as briefly noted above, some exemplary embodiments include a prosthesis that is configured or otherwise provided with a machine learning algorithm. In an exemplary embodiment, the results of the machine learning algorithm are utilized to adjust the adaptation subsystem. In an exemplary embodiment, a so-called genetic algorithm is utilized by the prosthesis, wherein the progression of the genetic algorithm corresponds to the adjustment of the adaptation subsystem. In an exemplary embodiment, recipient feedback is utilized as input into the genetic algorithm, thereby guiding the progression of the genetic algorithm. That said, in an alternate embodiment, reference classifier input is utilized as input into the genetic algorithm, thereby guiding the progression of the genetic algorithm. Still further, in an exemplary embodiment, both recipient feedback and reference classifier input is utilized as input into the genetic algorithm, thereby guiding the progression of the genetic algorithm.

In some exemplary embodiments, there is a prosthesis, such as by way of example, a cochlear implant and/or a retinal implant that comprises a signal processor, such as signal processor 220, configured to process signals emanating from respective scenes to which the prosthesis is exposed. The prosthesis further includes a stimulator component configured to evoke a sensory percept in a recipient based on operation of the signal processor. By way of example, the signal processor can be a sound processor of a hearing prosthesis or a light processor of a retinal prosthesis. In this exemplary embodiment, the prosthesis is configured to adapt the prosthesis to newly encountered scenes to which the prosthesis is exposed by assigning for use by the signal processor respective signal processing regimes via the use of a machine learning algorithm supplemented by extra-prosthesis data.

In an exemplary embodiment, the machine learning algorithm is utilized to identify the newly encountered scenes. That said, in an alternate embodiment, the machine learning algorithm is utilized to develop or otherwise identify signal processing regimes that can have utilitarian value with respect to processing the input resulting from a given scene. That is, in an exemplary embodiment, it is not that the scene classifier is adapted, but it is that the component of the scene classifier system that applies a given processing regime to the signal processor (e.g., block 1399 of FIG. 13) is adapted. Additional details of this will be described below.

With respect to adapting the prosthesis to newly encountered scenes to which the prosthesis is exposed, this entails the results of the adjustments to the signal processor resulting from scene classification. That is, for respective scene classifications, there exist corresponding signal processing regimes, but it is noted that in some embodiments, a plurality of scene classifications can share the same signal processing regime (e.g., scene classification corresponding to rap music and scene classification corresponding to heavy metal music may utilize the same sound processing regime). By way of example only and not by way of limitation, below is an exemplary chart presenting sound processing regimes for various scene classifications:

| 1 | 2 | 3 | 4 | 5 | 6 | 7 | 8 | 9 | 10 |
|---|---|---|---|---|---|---|---|---|---|
| A | B | A | A | C | D | E | B | F | G |

As can be seen, scenes 1, 3, and 4 utilize the same processing regime (processing regime A), and scenes 2 and 8 utilize the same processing regime (processing regime B). In any event, according to at least some exemplary embodiments, if scenes 6, 7, 8, 9 and 10 correspond to newly encountered scenes to which the scene processor is exposed, the assigned signal processor regimes respectively correspond to signal processing regimes D, E, B, F and G. In an exemplary embodiment, the prosthesis can be configured to utilize a signal processing regime corresponding to that for a scene previously recognized by the prosthesis that has statistically similar characteristics to that of the newly encountered scene. That said, in an alternate exemplary embodiment, the prosthesis can be configured to develop a new signal processing regime based on the features associated with the newly encountered scene (e.g. the mel-frequency cepstral coefficients, spectral sharpness, zero-crossing rate, spectral roll-off frequency, etc.) according to an algorithm that adjusts the signal processing based on such features. This developed signal processing regime is then saved or otherwise stored by the prosthesis and utilized when that scene is next encountered. Alternatively, and/or in addition to this, the newly encountered scene can be classified by the scene classification system, and stored in a memory of the prosthesis for subsequent communication to a remote device, or can be immediately communicated to a remote device, which remote device can in turn provide the prosthesis with a signal processing regime deemed viable or otherwise utilitarian for that specific scene. By way of example only and not by way of limitation, with respect to the exemplary embodiment where the remote reference classifier is utilized, the remote reference classifier can have correlated signal processing regimes for the given scenes thereof. Thus, upon identification of a new scene, the remote device can provide the corresponding signal processing regime to the prosthesis, which in turn saves that signal processing regime in the prosthesis in a manner that enables the prosthesis to access that signal processing regime upon the classification of a respective scene. Note further that in the aforementioned scenario where a signal processing regime is obtained from a remote location, in an exemplary embodiment, the signal processing regimes obtained from the remote location can be embryonic signal processing regimes. In this regard, upon the prosthesis obtaining the embryonic signal processing regimes, the prosthesis can modify those embryonic signal processing regimes according to the specific features of the signal processing of the prosthesis for that recipient. For example, in an embodiment where the prosthesis has been fitted to the recipient, the embryonic signal processing regimes will be modified to be consistent with the features of the prosthesis that was "fitted" to the recipient.

Consistent with the teachings detailed above, the extra prosthesis data is respective recipient feedback based on the implementation of the respective assigned respective signal processing regimes. In this regard, with respect to user feedback, in at least some exemplary embodiments, it is the changes in the signal processing resulting from scene classification upon which the recipient forms his or her decision as to the efficacy of a given scene classification. Thus, in the embodiments that utilize the machine learning algorithm that adjusts the algorithm-based at least in part on input from the recipient, that input is informed by the processing regime adopted for that classified scene.

Still further, consistent with the teachings detailed above, the extra prosthesis data is respective third-party feedback based on the respective third party feedback based on results of scene classification by the prosthesis of the newly encountered scenes. In an exemplary embodiment, the third party feedback can be the feedback from the reference classifier noted above.

It is to be noted that in an exemplary embodiment, the methods detailed herein are directed to identifying a new scene that the user is spending a lot of time in relative to that which is the case for other scenes. That is, the mere fact that the prosthesis encounters a new scene does not necessarily trigger the adaptations and/or adjustments detailed herein. For example, in an exemplary embodiment where a new scene is encountered, and the prosthesis cannot classify that new scene utilizing the current scene classification system settings/the current feature set of the scene classification system, the prosthesis will not attempt to adjust the operation of the scene classifier system and/or adjust the adaptations subsystem. Corollary to this is that in a scenario where the prosthesis incorrectly classifies a given new scene, the fact that the new scene has been incorrectly classified will not in and of itself trigger an adjustment or otherwise an adaptation to the scene classification system.

In an exemplary embodiment, the prosthesis and/or the remote systems that are utilized with the prosthesis to adapt or otherwise adjust the scene classifier system are configured to only make the adjustments in the adaptations detailed herein upon the occurrence of that new scene a predetermined number of times (e.g., within a predetermined temporal period) and/or exposure by the prosthesis to that new scene for a predetermined amount of time (singularly or collectively). Thus, this can have utilitarian value with respect to avoiding or otherwise minimizing scenarios where the scene classifier system is adjusted or otherwise adapted to better classify a new scene that may not be seen within a temporally significant period (if ever). In some respects, this is analogous to the aforementioned features detailed above with respect to the recipient traveling to Tahiti or the like. However, this is also applicable to a scenario where the recipient is not necessarily making any noticeable or major change to his or her lifestyle that is planned or otherwise represents a clear change at the time. In an exemplary scenario, a recipient may be an avid listener of rap music. The listener may be exposed to a sound scene corresponding to Barry Manilow music only a few times in his or her life. With respect to embodiments where the scene classifier system is optimized according to the teachings detailed herein, adapting the scene classifier system to classify Barry Manilow music could, in some embodiments, detract from the scene classifier's ability to identify rap music. Thus, in an exemplary embodiment, the scene classifier system would not be adapted to classify such a new scene upon only a single occurrence thereof. However, in an exemplary scenario, the recipient falls in love with someone that frequents 70's retro dance clubs, after a lifetime of listening to no other music than rap, and thus becomes exposed to sound scenes corresponding to Barry Manilow music on a regular basis. Thus, it becomes worthwhile or otherwise utilitarian to adapt the scene classifier system to classify such scenes. By way of example only and not by way of limitation, the prosthesis or other systems detailed herein can be configured such that upon the exposure of the prosthesis to Barry Manilow music on two separate occurrences separated by a 24 hour period, where prior to that such occurrence had never occurred before, the prosthesis could commence the adaptation of the sound classification system accordingly.

Conversely, in an exemplary embodiment, there exists a scenario where the recipient is no longer exposed to scenes to which he or she was relatively frequently exposed. In an exemplary embodiment, the aforementioned rap enthusiast breaks up with the person that frequents the 70's retro dance clubs. After a period of time where there has been no exposure to discover the like, the scene classifier system is adapted so that the disco scenes currently mapped by the scene classifier system, which are no longer used, are removed from the system, or at least relegated to a lower status.

Accordingly, in an exemplary embodiment, it is to be understood that the machine learning algorithm takes into account temporal and/or repetitive aspects of the newly encountered scenes.

As noted above, while some embodiments of the teachings detailed herein utilize the machine learning algorithm to adapt the scene classifier, other embodiments are directed towards developing signal processing regimes utilizing machine learning algorithms for various classified scenes including newly classified scenes. As noted above, in an exemplary embodiment, upon encountering a new scene, the prosthesis can assign a processing regime for that new scene that corresponds to a previously encountered scene that is similar in a statistically significant manner (e.g., three of five features are similar or the same, etc.) to this new scene. In an embodiment where the extra prosthesis data corresponds to user feedback, with respect to the utilization of the processing regime for the similar previously encountered scene, if the user feedback indicates satisfaction with the processing regime, the prosthesis is configured to persist with this mapping of the signal processing regime to this new scene. Still with reference to the embodiment where the extra prosthesis data corresponds to user feedback, if the user feedback indicates dissatisfaction with the processing regime, the prosthesis is configured to modify the processing regime and/or apply a processing regime for another previously classified scene (e.g., the next "closest" scene, etc.). This can go on until the recipient expresses satisfaction with a given processing regime for this newly encountered scene. In an exemplary embodiment, the feedback can be binary good/bad input, or can be input indicating that a given processing regime is better or worse than a previously utilized processing regime. By way of example, if a parameter of a previously utilized signal processing regime is adjusted, and the recipient provides feedback indicating that the adjusted signal processing regime is worse than that which was the case without the adjustments, the prosthesis is configured to adjusting other parameter and/or adjust that same parameter in the opposite direction. Conversely, if the adjustment of the parameter results in feedback indicating that the adjusted signal processing regime is better than that which was the case without the adjustments, the prosthesis is configured to make another adjustment in the "same direction" of that parameter. This can continue until the recipient indicates that further adjustment makes no noticeable difference and/or that further adjustment results in a deleterious effect on the perception of the efficacy of the signal processing, etc.

Thus, it can be seen that at least some exemplary embodiments include assigning, in a semi-random fashion, new signal processing regimes to the newly identified scene. Where the assignments of the new scene are at least partially based on previously encountered scenes with similar features as that of the new scene, or at least based on previously encountered scenes with features that are closer to those of the new scene relative to other previously encountered scenes.

Figure 18:
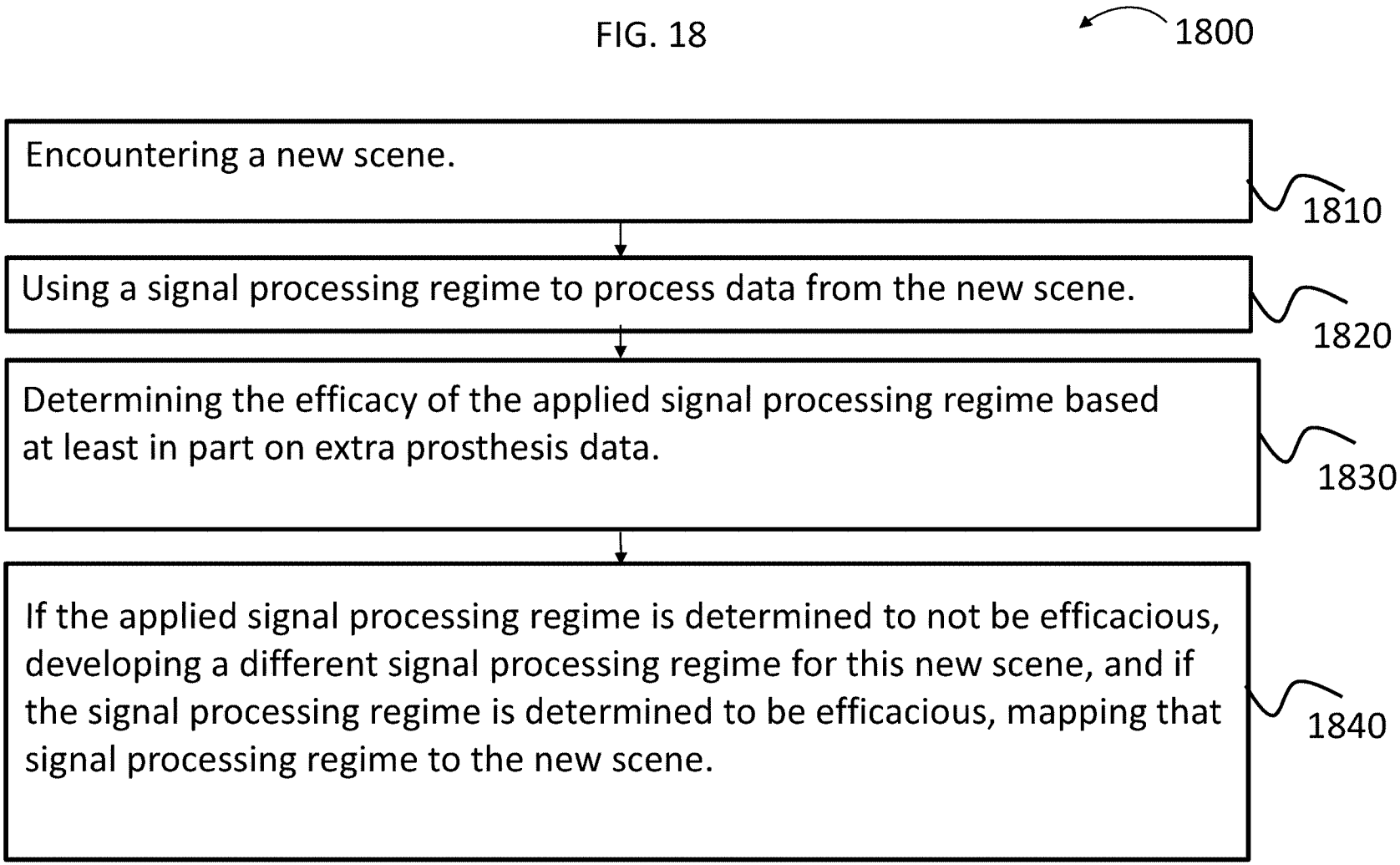
FIG. 18 presents another exemplary flowchart for an exemplary method according to an exemplary embodiment.

To these ends, FIG. 18 presents an exemplary flowchart for an exemplary method, method 1800. Method 1800 includes method action 1810, which entails encountering a new scene. Method 1800 further includes method action 1820 which entails utilizing a signal processing regime to process data from the new scene. In an exemplary embodiment, this signal processing regime is a previously utilized signal processing regime selected on the basis of the new scene being similar/more similar to a previously encountered scene to which this signal processing regime was found to be efficacious. That said, in an alternate embodiment, the prosthesis or other remote system can be configured so as to develop a new signal processing regime for this new scene. In an exemplary embodiment, this can entail "starting with" the aforementioned signal processing regime utilized for the scene that was similar to this new scene, and making adjustments thereto, or in other embodiments, developing a completely new regime. With respect to the former, in an exemplary embodiment, in a scenario where the new scene was evaluated using features A, B, C, D and E of a feature set of the scene classifier, and all features except feature D correspond to a scene identification corresponding to previously identified scene number 8, the prosthesis or other system could take the signal processing regime for scene number 8, and modify that regime in the manner the same as or in a similar way or in a different way, but limited to those components of signal processing that were modified when previously developing a new processing regime for a new scene where the only difference between that new scene and a previously identified scene was a feature D. Alternatively, the prosthesis or other system could take the signal processing regime for scene number 8, and modify that regime in the manner the same as or in a similar way or in a different way, but limited to those components of signal processing that were modified when the signal processing regime for scene number 8 was developed when that scene (scene 8) was first encountered (when that was a new scene).

With respect to the latter (developing a completely new signal processing regime), an algorithm can be utilized to analyze the differences in the features of the new scene a based on those differences, can develop a feature regime utilizing an algorithm that was successfully used to develop a new signal processing regime for a new scene in the past.

With respect to both of these routes to developing a new signal processing regime, machine learning can be utilized to adjust the algorithms for developing the new regime. For example, with respect to the latter scenario, where an algorithm is utilized that was successfully used to develop the new signal processing regime for the new scene in the past, that algorithm could have been adjusted relative to a previous algorithm that was utilized based one input or feedback (e.g., from the recipient or from the remote classifier, etc.) as to the efficacy of the resulting signal processing regime(s) (plural in scenarios where the first signal processing regime that was developed utilizing that prior algorithm was deemed insufficiently efficacious, and subsequent regime(s) were developed).

However the signal processing regime of method action 1820 is selected or otherwise developed, method 1800 then proceeds to method action 1830, which includes the action of determining the efficacy of the applied signal processing regime applied in method action 1820. In an exemplary embodiment where the extra prosthesis data is recipient feedback, this can correspond to an implementation of the various techniques detailed above (e.g., a binary good/bad input, a singular good/bad input, where the absence of input is deemed to be input, a more sophisticated input (too loud, too high pitched, etc.)). In an exemplary embodiment where the extra prosthesis data is the input from a remote device that has evaluated the results of the actions 1810, 1820, and 1830, or at least data indicative of the results of the actions 1810, 1820, and 1830, such as by way of example only and not by way of limitation, the reference classifier detailed above, this can correspond to the remote device determining that the signal processing regime of action 1820 is not that which should have been used.

Method action 1840 entails developing a different signal processing regime for the new scene than that utilized in action numeral 1820 if the applied signal processing regime is determined to not be efficacious, and if the signal processing regime is determined to be efficacious, mapping that signal processing regime to the new scene. With regard to the latter, such will end method 1800. With regard to the former, this may or may not end method action 1800. In an example where the remote reference classifier is used, where the accuracy thereof is relatively high, the action of developing the different signal processing regime can entail utilizing the signal processing regime directed by the remote classifier. That could be the end of the method. That said, in an exemplary embodiment where the remote classifier is utilized, this can entail the remote classifier providing an embryonic signal processing regime, and the prosthesis modifying it or otherwise adjusting it to the particular settings deemed useful for that particular recipient. In such an exemplary scenario, one could in some exemplary embodiments, return back to method 1810 and utilize this new signal processing regime, at least upon the next occurrence of this "new scene."

With respect to embodiments utilizing recipient feedback, one would, in some exemplary embodiments, also return back to method 1810, and utilize a new signal processing regime for that new scene, at least the next time that that new scene is encountered. This new signal processing regime can be developed utilizing any of the teachings detailed herein.

Figure 19:
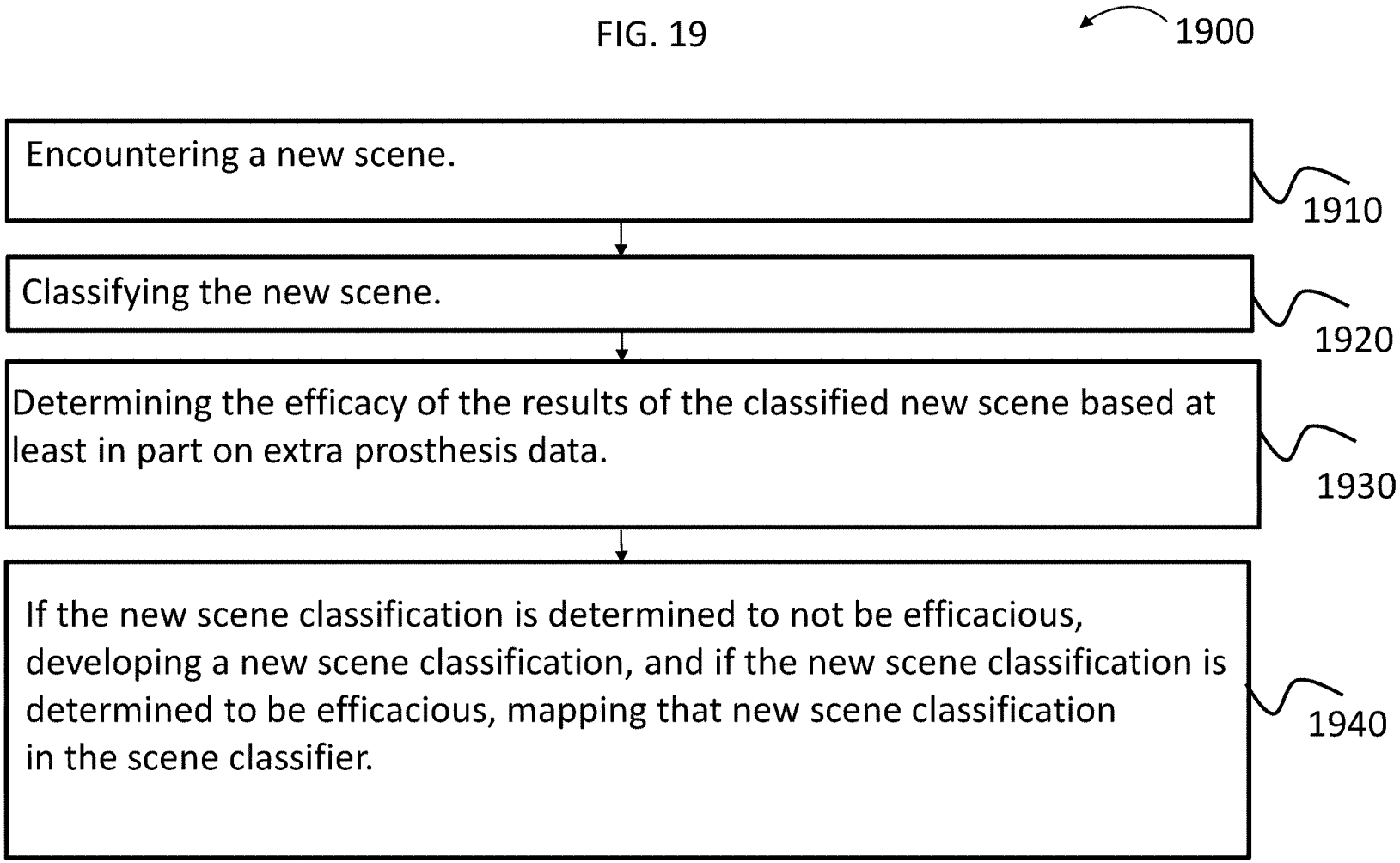
FIG. 19 presents another exemplary flowchart for an exemplary method according to an exemplary embodiment.

It is noted that while the above embodiments associated with FIG. 18 have been directed towards the development of the new signal processing regime, is to be understood that the embodiments associated with FIG. 18 can also correspond to a more purely scene classification based method. In this regard, FIG. 19 presents an exemplary flowchart for method 1900, which includes method action 1910, entailing encountering a new scene. This corresponds to method action 1810 of method 1800 detailed above. Method action 1920 entails the action of classifying the new scene. This can be done according to any of the teachings detailed herein and/or variations thereof, such as by way of example only and not by way of limitation, utilizing any form of conventional scene classifying system that can have utilitarian value. Method action 1930 entails determining the efficacy of the results of method action 1920 based at least in part on extra prosthesis data. In an exemplary embodiment where the extra prosthesis data corresponds to recipient feedback, this can be based on the user's satisfaction of the applied signal processing regime for this new scene. Alternatively, and/or in addition to this, this can correspond to indicating to the recipient the classified new scene. For example, in an exemplary embodiment, such as where the prosthesis is in signal communication with a portable handheld device, such as a smart phone, the smart phone can provide an indication of the recipient indicative of the newly classified scene. By way of example, in a scenario where the new scene is bossa nova music, the hearing prosthesis can present such on the touchscreen of the smart phone (e.g., "New Sound Scene Detected: Bossa Nova Music?"). The smart phone can provide a binary input regime to the recipient (e.g. yes/no) where the recipient can input his or her opinions. Note further that such can be utilized in conjunction with a person who does not utilize the prosthesis, where this other person can provide input either directly or indirectly indicating whether or not the scene classification is efficacious.

In an exemplary embodiment where the remote reference classifier is utilized, method action 1930 can be executed by comparing the results of method action 1920 to the scene proffered by the reference classifier, where that scene is determined or otherwise treated to be definitive.

Method action 1940 of method 1900 entails developing a new scene classification if the new scene classification is determined not to be efficacious. In an exemplary embodiment, this can entail utilizing whatever scene is proffered by the reference classifier. Alternatively, and/or in addition to this, this can entail developing a new scene classification and "testing out" this new scene classification subsequently (e.g., by returning to method action 1910).

It is noted at this time that exemplary embodiments can utilize a combination of the extra audio data. By way of example, with reference again to the person who is exposed to 70's music for the first time in his or her life, a scenario can exist where the recipient is suddenly exposed to a lot of Bee Gees music, such as in the 70's themed dance club, which music tends to have a male vocalist singing at a higher pitch relative to that which is normally the case. An exemplary scenario can exist where the prosthesis applies a signal processing regime that the recipient interprets as being incorrect or otherwise non-utilitarian, because the signal processing regime evokes a hearing percept with high pitches from male vocalists (video could be shown of the singers in the dance club, thus indicating to the recipient that the vocalists are male). The recipient could attempt to override or otherwise provide input indicating that the signal processing regime has less efficacy, with the understanding that such high pitches usually do not come from male vocalists. However, because the prosthesis also utilizes locational data, an algorithm of the scene classifier system can recognize that such a dichotomy can exist or otherwise is more likely to exist in a 70's themed club, and otherwise prompt the recipient for further information about a given scene. That is, while not overriding the recipient's overriding, the prosthesis could proffer an alternate possibility to the recipient. Indeed, in an exemplary embodiment, the prosthesis could ask the recipient to input additional data such as the name of the music/specific song to which the recipient is listening, either at that time or during a later temporal period. Thus, in an exemplary scenario, some of the extra audio data could be utilized to balance other extra audio data so as to achieve a more accurate scene classification result.

Corollary to the above is that an exemplary embodiment can entail an interactive environment subsequent to the scene classification where a "disagreement" between the recipient and the scene classification system can be evaluated. For example, an interactive system can be located on the recipient's computer. Recent scene classification events can be downloaded to the computer, and the computer can analyze data associated with the scene classification where there was disagreement. The system can attempt to evaluate a given scene classification scenario and try to verify whether or not the recipient's perception was correct. For example, in the aforementioned scenario, the computer system or other interactive system could prompt a series of questions to the recipient, one of which could be "did you find the pitch of the music to be too high?" A yes indication to that question could lead to further questions or further analysis by the system. The interactive system would endeavor to determine whether or not the recipient's perception was correct, or whether a given scene was so new to the recipient that the scene classifier was accurate and it was the recipient that made a mistake in the evaluation of the efficacy of the scene classification/the utilitarian value of the signal processing regime adopted for that scene. While the recipient may very well have ultimate control over the ultimate determination of the efficacy of the scene classification, the interactive system could guide the recipient to the "right answer." Here, in this exemplary scenario the right answer would be that yes, there are male vocalists that sing with such pitch, and thus a signal processing strategy that results in a perceived high pitch by the user is correct.

Note also that embodiments associated with obtaining recipient feedback can entail proffering a scene classification directly to the recipient, and having the recipient indicating whether or not the scene classification is correct. For example, in an exemplary embodiment, such as those that are utilized in conjunction with a portable electronics device, the device can display on the screen the results of a classification of a given scene. Still further by example, when the recipient is exposed to bossa nova music, the portable handheld electronics device can display "jazz" on the screen. The recipient can provide input indicating that that is incorrect or even can provide input by typing in bossa nova music on the touchscreen. Alternatively and/or in addition to this, the prosthesis could evoke an artificial hearing percept using the word jazz, or something more sophisticated, such as "your prosthesis identifies the current scene as jazz music." The recipient could depress a button indicating yes or no or could provide and auditory answer to the prostheses. Any arrangement of providing recipient feedback or otherwise providing input and/or presenting data for the recipient to provide recipient feedback or otherwise provide input that can enable the teachings detailed herein can be utilized at least some exemplary embodiments. Thus, in an exemplary scenario of evaluating the efficacy of a given feature subset, an exemplary scenario entails presenting the recipient with an evaluation of a given scene in terms that the recipient can understand or in terms that are otherwise meaningful to the recipient, and obtaining the recipient's feedback based on what is presented thereto.

As noted above, embodiments implementing machine learning to classify new scenes and/or otherwise develop new processing regimes for new scenes can utilize genetic algorithms or other machine learning algorithms. In an exemplary embodiment, consistent with the teachings detailed above, an element can be introduced into the algorithm which can adjust the course of the algorithm. In an exemplary embodiment, this element can be the user feedback element as noted above. In an exemplary embodiment, a random element can be introduced so as to produce a genetic mutation in the genetic algorithm. In this regard, some exemplary embodiments can be implemented utilizing the teachings of US Patent Application Publication Number 20050107845 to Gregory Wakefield, published by the United States Patent and Trademark Office on May 19, 2005, with respect to the concepts of using the random mutations disclosed therein. Positive feedback from the recipient associated with a signal processing regime predicated upon this genetic mutation and/or confirmation from the reference classifier of an accurate or otherwise utilitarian scene assessment can be considered a successful mutation, and thus this mutation can be utilized in future algorithms.

Some exemplary embodiments can entail emphasizing certain frequencies over other frequencies in a random manner. In an exemplary embodiment, when developing the sound processing strategy for a newly developed scene, frequency bands can be randomly selected for increased gain relatives relative to other frequency bands or for decreased gain relative to other frequency bands. In an exemplary embodiment, when developing the sound processing strategy, such as by way of example only with respect to a cochlear implant, certain channels can be shut down entirely for a given new scene in a random manner. Any feature of the sound processing regime that can be adjusted in a random manner so as to implement a genetic algorithm or the like can be utilized at least some exemplary embodiments providing that such has utilitarian value with respect to the random adjustment thereof.

Figure 20:
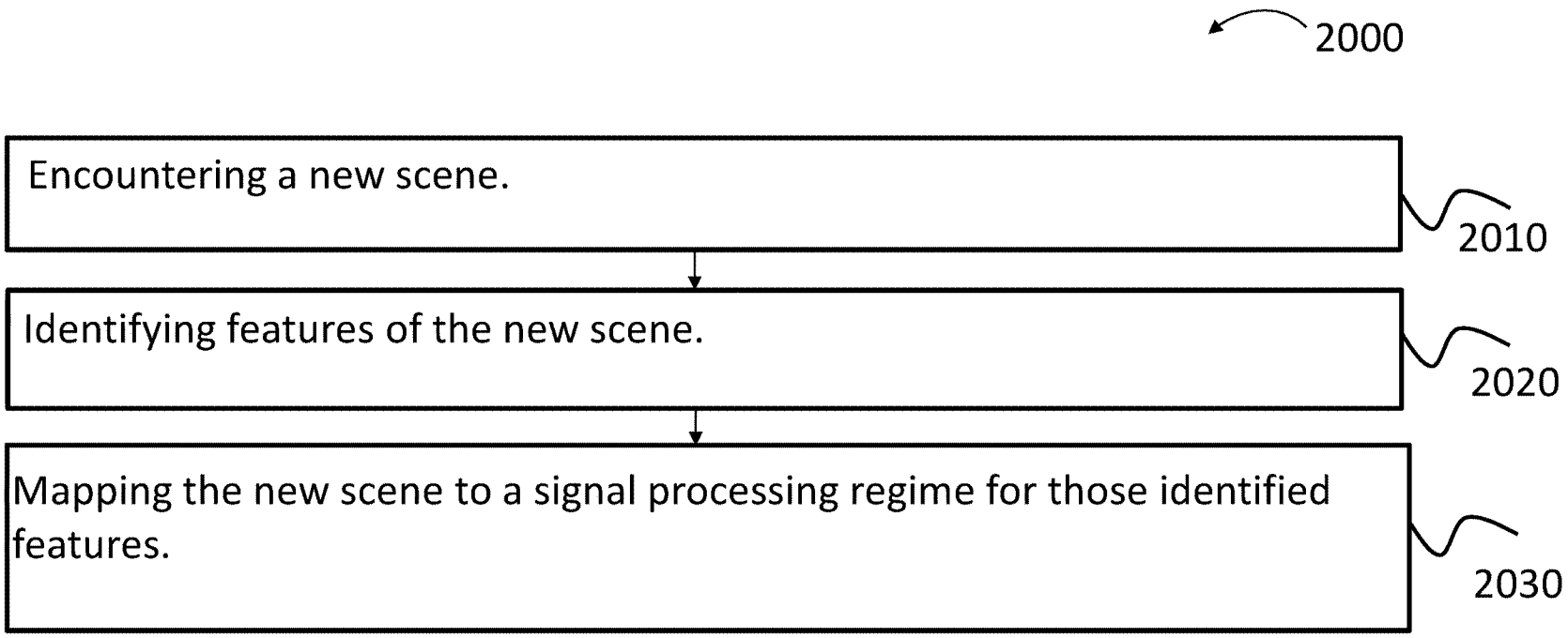
FIG. 20 presents another exemplary flowchart for an exemplary method according to an exemplary embodiment.

FIG. 20 depicts an exemplary flowchart for an exemplary method, method 2000, utilizing a genetic algorithm. At method action 2010, a new scene is encountered. By way of example only and not by way of limitation, this can be bossa nova music. In this regard, by new scene as used herein, this can be a scene that is not new to the recipient per se, but is new to the scene classifier system. By way of example only and not by way of limitation, an initial scene classifier system of a hearing prosthesis can be programmed or otherwise be provided with various predetermined scenes corresponding to scenes that are generalized (e.g., speech, music, etc.) and/or corresponding to scenes that are statistically likely to be encountered with a general or specific population (e.g., jazz, rock, elevator music, rap, pop, etc.). Thus, in such a context, the occurrence of bossa nova music is a new scene. Method action 2020 entails identifying features of the new scene. In this regard, the features of this new scene can include music and speech. Indeed, in an exemplary embodiment, this can correspond to features of music, and speech in noise. Method action 2030 entails mapping the new scene to a signal processing regime for those identified features. In an exemplary embodiment, this can entail adopting a signal processing regime for the dominant feature (e.g., which could be speech in noise). In an exemplary embodiment, this can entail adopting a signal processing regime that is a hybrid for these two features. This hybrid can be developed by the prosthesis and/or by a remote device or other system, or can be one that is preprogrammed for such an eventuality.

After method action 2030 is executed, method action 1830 of method 1800 can be executed, and then method 1800 could be followed, and/or method action 1930 of method 1900 could be executed, and then method 1900 could be followed.

Figure 21A:
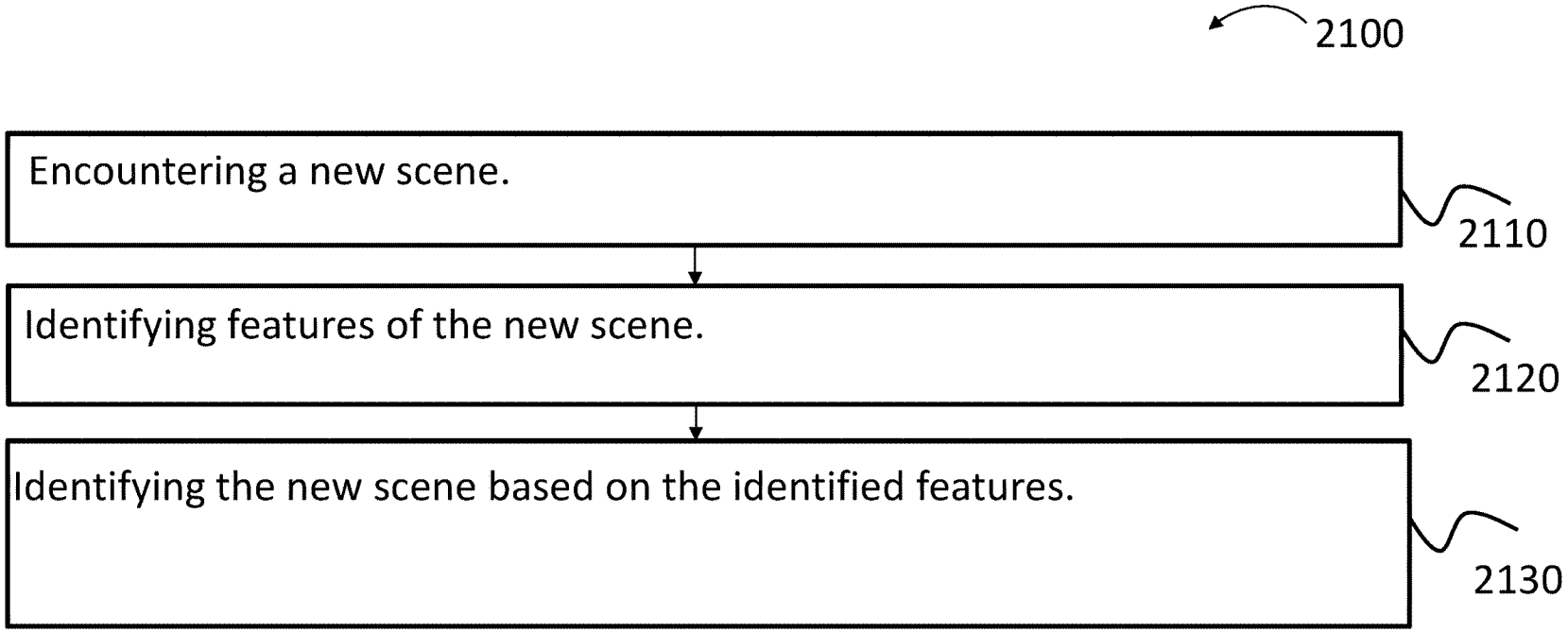
FIG. 21A presents another exemplary flowchart for an exemplary method according to an exemplary embodiment.

Corollary to this is the method 2100 represented by the flowchart of FIG. 21A. This method includes method 2110, which entails encountering a new scene. Method action 2120 entails identifying features of the new scene, and method action 2130 entails identifying the new scene based on the identified features. In an exemplary embodiment, an additional method action associated with method 2100 includes the action of applying or otherwise developing a signal processing regime for the new scene.

Consistent with the teachings detailed herein regarding the utilization of extra prosthesis input, in an exemplary embodiment, the action of identifying features of the new scene can be executed by a remote device from the prosthesis. In an exemplary embodiment, the identification of the features of the new scene can be executed by the reference classifier located at the remote facility detailed above. In an exemplary embodiment, the prosthesis could be configured to determine whether or not the prosthesis has encountered a new scene. Upon such a determination, the prosthesis can provide a signal to a smart phone or the like, or some other portable electronics device, such as a remote device that is part of the prosthesis (a device sometimes referred to as a prosthesis programmer—a device that is part of the prosthesis, and is utilized to provide greater functionality of the prosthesis (e.g., because it has a 2 by 4 inch touchscreen that is not practical to include as a direct part of the prosthesis worn by the recipient, or because it has knobs or switches in relatively large numbers and/or large sizes that enable the recipient to better manipulate input, etc.). The portable electronics device could autonomously obtain information indicative of the scene (e.g., the portable electronics device could have a microphone or the like such that the portable electronics device could obtain the data indicative of the new scene), or the portable electronics device could obtain information indicative of the scene from the signal provided by the prosthesis. In any event, the portable electronics device could have a processing power greater than that of the prosthesis/could have memory power greater than that of the prosthesis, and thus could be used to identify the features of the new scene and/or to identify the new scene. Alternatively, and/or in addition to this, the portable electronics device could have the capability of developing or otherwise identifying a signal processing regime that should be utilized for this new scene, and/or could have the capability of identifying (or at least the capability to better identify the scene) and providing such regime and/or scene identification to the prosthesis, whereby upon such providing to the prosthesis, the prosthesis could adapt itself to utilize this signal processing regime and/or scene identification information upon the occurrence of the new scene. In this regard, such can enable dynamic scene classification.

That said, in an alternate embodiment, the portable electronics device can be utilized as a conduit to the reference classifier. In an exemplary embodiment, upon the occurrence of the new scene (and it is noted that while some embodiments detailed herein are directed towards the prosthesis identifying the new scene, in an alternative embodiment, such can be executed completely autonomously by a remote device, such as a portable handheld device in the form of a smart phone or the like, or a remote device that is part of the prosthesis (again, a device sometimes referred to as a prosthesis programmer—a device that is part of the prosthesis, and is utilized to provide greater functionality of the prosthesis, but is not necessary for the day-to-day use of that prosthesis). This also the case with respect to the other embodiments detailed herein as well—any teaching detailed herein associated with scene classification that is executed by the prosthesis can be executed, in some embodiments, by a remote device, whether it is part of the prosthesis or a separate component entirely.

Still in keeping with the embodiments utilizing this remote device, in an exemplary embodiment, the utilization of a remote device can be used as a platform so as to enable the utilization of the remote reference classifier at the remote location, such as the prosthesis manufacturer's facility. In an exemplary embodiment, upon a determination that a new scene has been experienced, the prosthesis can communicate with a smart phone or the like or other portable electronics device (or the portable electronics device can determine that a new scene has been experienced autonomously) and data indicative of the new scene can be communicated to the reference classifier at the remote location by the smart phone. (Note that in some other embodiments that have a prosthesis that has the ability to communicate utilizing cellular phone technology or via other technologies, such as by way of example, Wi-Fi, the prosthesis can communicate with a remote location to access or otherwise utilize the reference classifier without utilizing the intermediate cell phone—assuming that a server at a location is utilized, such could be a non-portable electronics device.) In real-time or in semi-real time, the reference classifier can classify the new scene, and provide input to the prosthesis indicative of the new scene and/or indicative of a signal processing regime that will have utilitarian value with respect to utilization thereof with that scene. Thus, in at least some exemplary embodiments, some or all of the method actions 2100 can be executed by a component that is not part of the prosthesis and/or by a component that is an ancillary part of the prosthesis.

To be clear, while much of the teachings detailed above with respect to the remote classifier have been utilized in terms of the remote classifier providing input in a definitive matter with respect to the new scene, and the prosthesis adopting that input/using that input to map the signal processing regime to a given new scene, embodiments utilizing the remote classifier can also be used so as to adapt or otherwise adjust the adaptation subsystem of the scene classifier system of the prostheses. While the reference classifier can often act as a classifier of last resort, there is utilitarian value with respect to having the prosthesis or the components associated with the prosthesis that are carried by or otherwise used with the recipient (e.g., a smart phone that is used in combination with the prosthesis) classifying new scenes autonomously or in a semi-autonomously matter. In this regard, while the above-noted exemplary embodiment in the paragraph immediately above focused on a real-time or semi-real time classification utilizing the reference classifier, in alternative embodiments, access to the reference classifier may not occur for tens of minutes if not hours if not days subsequent to the occurrence of the new scene. Thus, even with this scene classifier, there is utilitarian value with respect to having an algorithm that more accurately classifies new scenes. Accordingly, even in embodiments where the reference classifier is used to identify the new scene, that reference classifier information is also utilized to adjust the adaptive subsystem so that the adaptive subsystem is more likely to correctly classify a new scene and/or more likely to correctly develop or otherwise apply a signal processing regime for a new scene.

Note also that with respect to the exemplary scenario of utilizing a portable electronics device, in an exemplary embodiment, the portable electronics device performs an analysis of a given scene and provides the results of its analysis to the recipient. The recipient can provide input to the portable electronics device as to whether or not the results of the analysis are correct (i.e., whether the correct scene was determined as a result of the analysis). Consistent with the teachings detailed herein, machine learning or the like can be utilized to adjust the algorithm based on this feedback. That is, any of the devices, systems, and/or methods detailed herein associated with the hearing prosthesis can be utilized in a remote device such as a smart phone and/or a pad and/or a desktop and/or a laptop computer and/or a programming device.

Still further, it is noted that non-audio inputs, such as geographic location, could also be utilized with the machine learning algorithms detailed herein. By way of example, continuing with the scenario associated with the bossa nova music as a new scene, an exemplary scenario can entail obtaining geographic location data indicating that the recipient is at a bossa nova music club or a Brazilian and/or West African ancestry club. In this regard, a machine learning algorithm and/or a genetic algorithm could utilize this input to increase a probability that a scene classifier system will identify this new scene is a bossa nova scene. By way of example only and not by way limitation, if the scene classification algorithm resulted in a determination that there is a 53% likelihood that the scene is speech in noise and a 47% likelihood that the scene is jazz with vocals, the locational data would push the classification to jazz with vocals, and thus adopt a signal processing regime for such a scene. Even though bossa nova music is not jazz with vocals, the signal processing regime for jazz with vocals is likely to be much more utilitarian than that with respect to the signal processing regime for speech and noise. In an exemplary embodiment, this extra audio data can be utilized to influence the decision of a decision tree under certain scenarios and not others. By way of example only and not by way of limitation, in a scenario where the classification algorithm resulted in a determination that there was a 61% likelihood that the scene is speech and noise, and a 39% likelihood that the scene is jazz with vocals, a threshold of a 20 percentage point spread might be utilized to negate the input of the locational data.

Note also that the extra audio/non-audio inputs could also be input relating to other phenomenon or can be obtained through other data obtaining methods. By way of example only and not by way of limitation, the prosthesis can be interactive with other media devices, such as the recipient's email account and/or the recipients texting account. If, for example, within a period of a week, there is communication to or from the recipient indicating an event that is likely to correspond to some form of environment in which the recipient may be located, the prosthesis or other system can utilize that to influence the algorithm of the scene classifier system. For example, if the recipient received an email about a bossa nova band (an advertisement, an invitation, etc.), the prosthesis or other system can utilize this fact to influence the algorithm. Again with the above 53/47 percentile scenario, by way of example only and not by way of limitation, recognition by the prosthesis or other system that the recipient was associated in some form or another with the words bossa nova, would sway the decision tree to classify the scene as bossa nova music even though the percentages would push the classification away from such. Note also that some exemplary embodiments can be utilized in terms of analyzing recipients past actions to influence or otherwise adjust the decision tree of the scene classification algorithm. In an exemplary scenario, again where the recipient is exposed to bossa nova music in view of the aforementioned 53/47 percentile scenario, if the recipient had looked up bossa nova music or Brazilian music or West African music utilizing his or her smart phone or the like within a predetermined period of time prior to the exposure to the bossa nova music, such fact can be utilized to influence the decision to a selection of bossa nova music. Any input that is extra audio/non-audio that can be utilized in the scene classification system can be utilized in at least some exemplary embodiments.

Figure 21B:
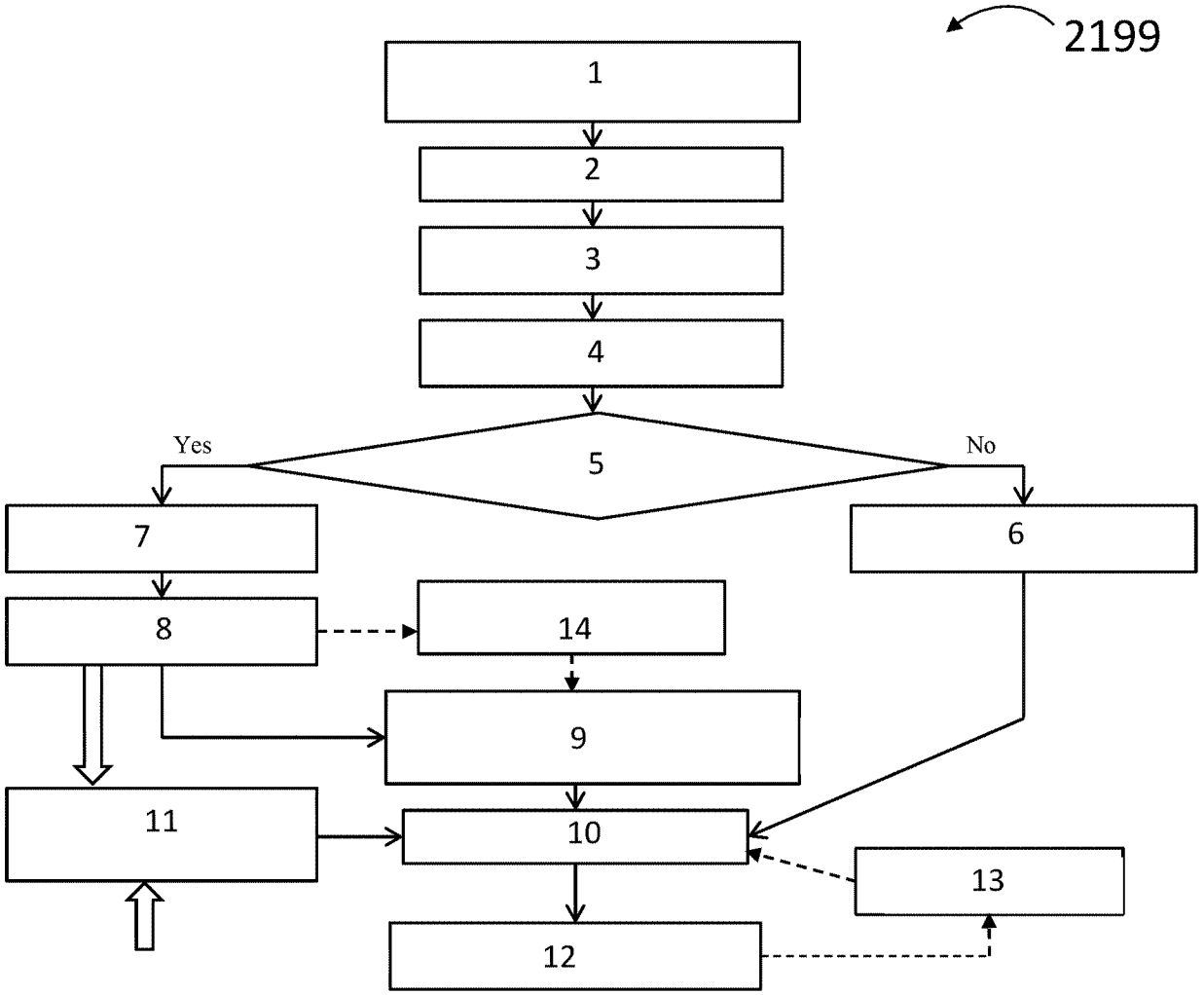
FIG. 21B presents another exemplary flowchart for an exemplary method according to an exemplary embodiment.

FIG. 21B presents an exemplary flowchart for an exemplary method 2199 that combines some of the various teachings detailed herein. With respect to method 2199, block 1 entails extracting a large set of features from scene frames. With respect to the teachings detailed herein, block 1 can entail obtaining the features of the superset detailed above. Block 2, the features obtained in block one are stored in a user log of the prosthesis or otherwise another component thereof or in another system. Block 3 entails encountering a given scene (new or otherwise—more on this below). Block 4 entails running through an analysis on at least a subset of features of the superset extracted in block 1. After completing the actions of blocks 1 to 4, at decision block 5, a query is made as to whether a new environment has been identified. If no, the algorithm proceeds to block 6, where the current classifier configuration is maintained, followed by the execution of block 10, which entails assigning a signal processing regime for the scene. In an exemplary embodiment, because the scene is not a new scene, the signal processing for the scene as that which was previously utilized. The algorithm then proceeds to block 12, where the signal processing for the scene is implemented so as to provide a sensory percept to the recipient.

Returning back to decision block 5, in a scenario where the new environment is identified (or unrecognized) the algorithm proceeds to block 7, which entails adding this new scene to the active scene list of the prostheses. Block 8 entails determining/developing the utilitarian features to utilize to classify this scene and/or determining/developing the utilitarian algorithm to classify this new scene. Block 8 can be executed utilizing any of the teachings detailed herein and/or variations thereof for this given scene. Subsequent block 8, the algorithm proceeds to block 9, block 10 and then block 12.

As can be seen in FIG. 21B, there is a block 11 which entails the utilization of extra audio features (in the case of a hearing prosthesis), such as age, location, etc., in accordance with the teachings detailed herein.

It is noted that block 13 entails user feedback, where the user feedback is based on the results of the signal processing of block 12. Still further, block 14 also entails user feedback, where the user feedback is based on the results of the determination of the best features and algorithm utilized block 8. Both of these user feedback blocks are optional in at least some exemplary embodiments.

Figure 22:
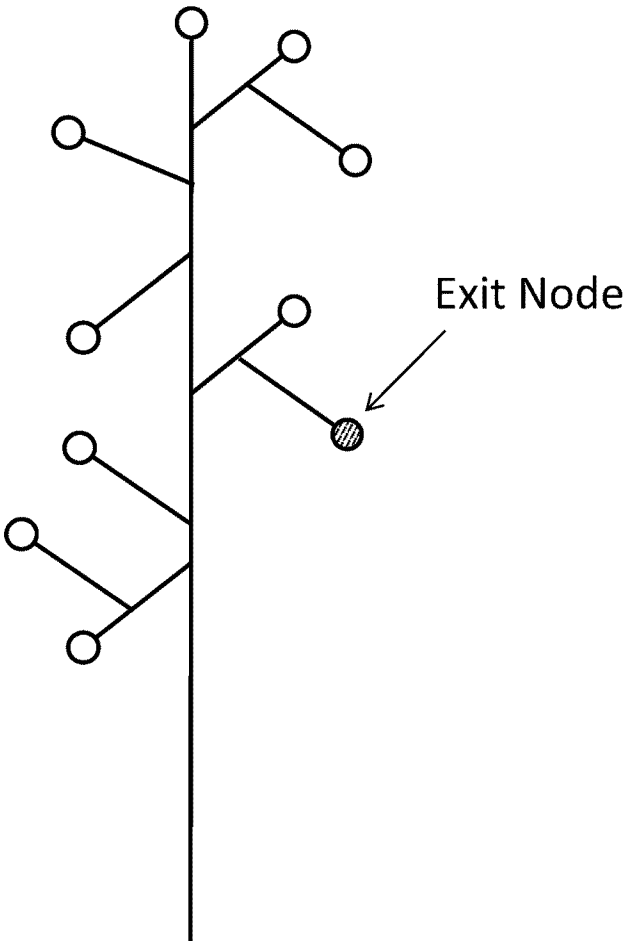
FIG. 22 presents a conceptual decision tree of a prosthesis.
Figure 23:
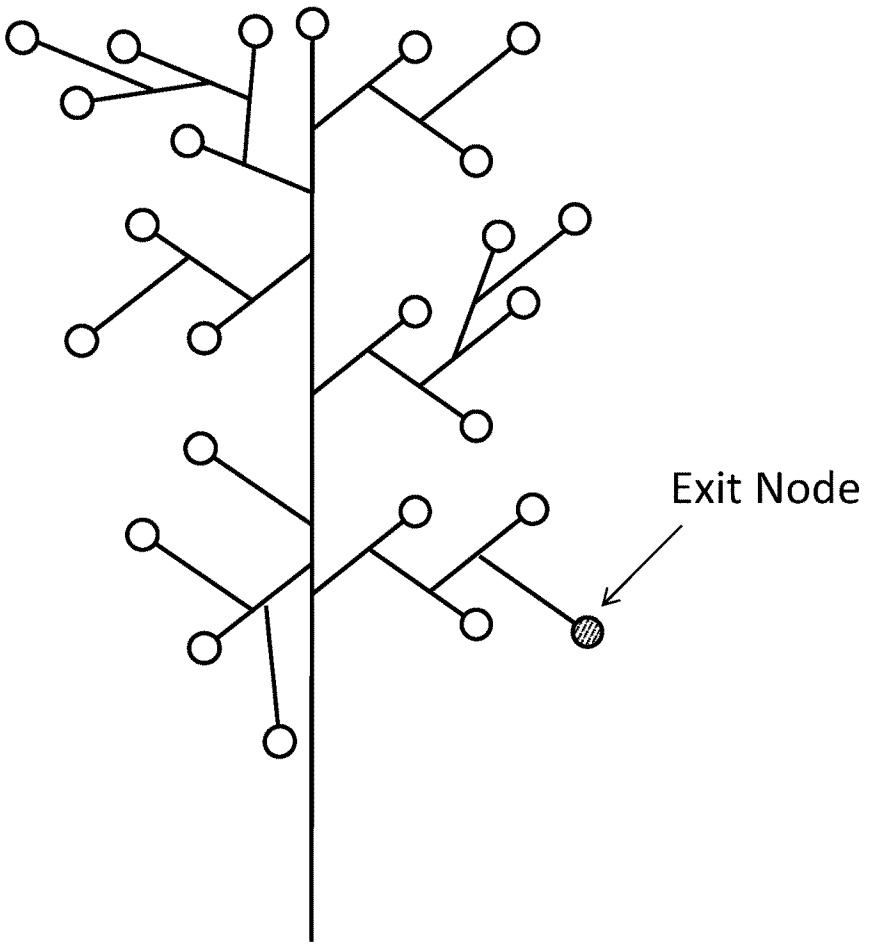
FIG. 23 presents another conceptual decision tree of a reference classifier.
Figure 24:
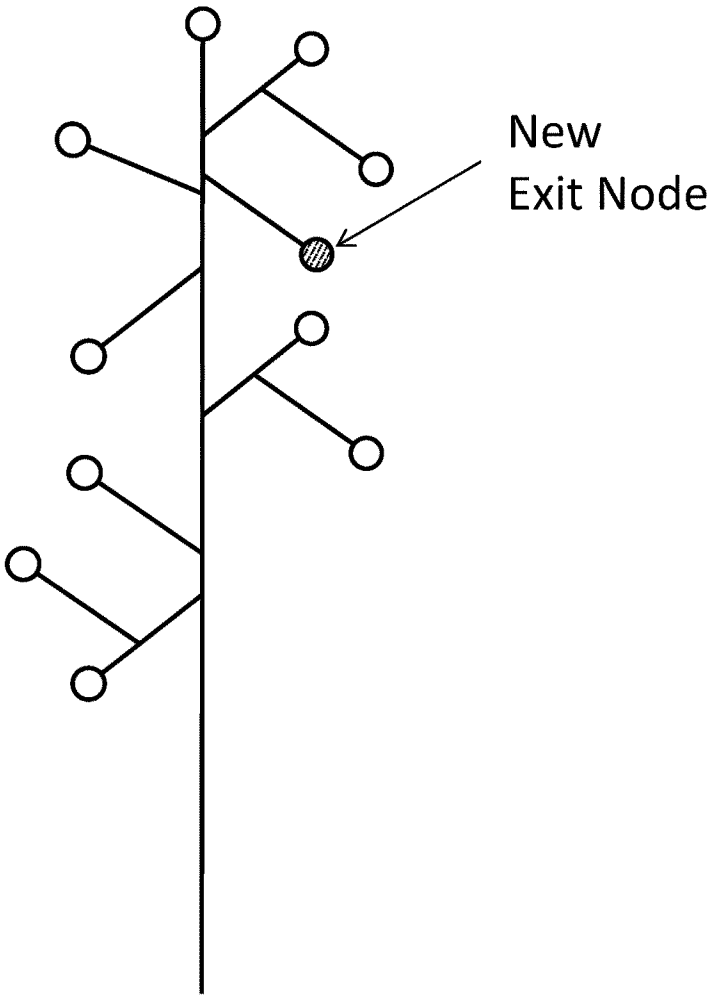
FIG. 24 presents a conceptual decision tree of a prosthesis modified based on the tree of FIG. 23.
Figure 25A:
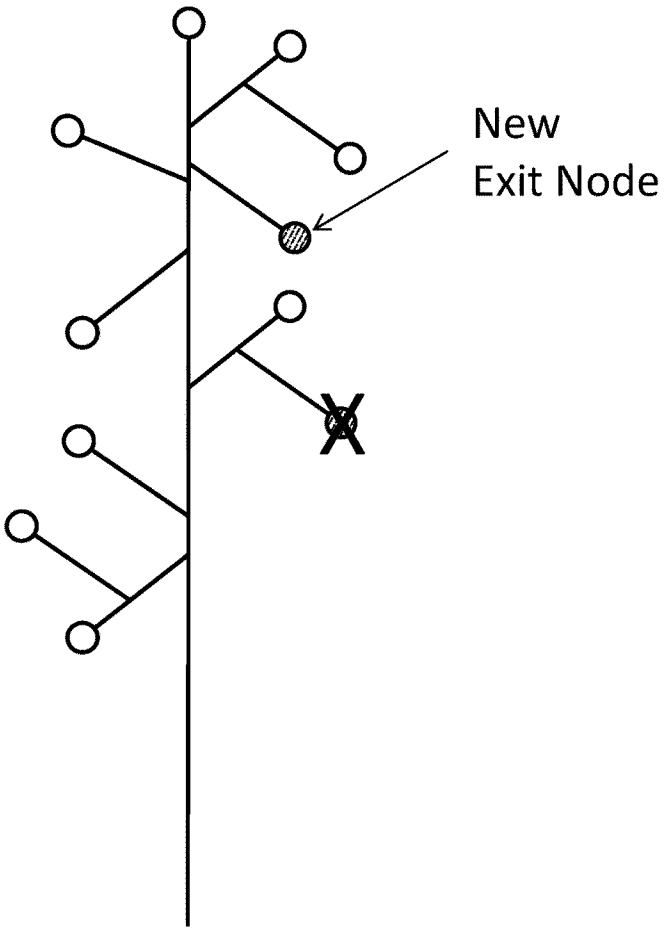
FIG. 25A presents another conceptual decision tree of a prosthesis modified based on the tree of FIG. 23.

Still with respect to embodiments that utilize a decision tree algorithm or the like, an exemplary embodiment includes the restructuring of the decision tree based on feedback or otherwise based on corrective input. By way of conceptual exemplary embodiment, FIG. 22 presents a decision tree for an exemplary classifier system used by an algorithm of a classifier system of a hearing prosthesis. As can be seen, an exit node is identified. In an exemplary embodiment, the decision tree is followed based on the features of the given scene. In this exemplary scenario, the identified exit node is identified as the point where the decision tree ends, and the scene classifier system identifies a given scene or otherwise applies a given signal processing regime based on the features associated with this scene. Subsequent to such identification, this ultimate decision by the scene classifier system is compared to that which would result from the reference classifier. FIG. 23 presents an exemplary reference classifier decision tree. As can be seen, the decision tree is both more detailed, and different than that of the classifier tree of the prosthesis. In any event, as can be seen, the exit node of the reference classifier tree is different than that of the recipient's classifier tree of the prostheses. In an exemplary scenario of use, the exit node determined by the classifier tree of the recipient's prosthesis is compared to that of the reference classifier. Because in at least some exemplary embodiments, the reference classifier is deemed to be the definitive classifier, the prosthesis or other system determines that the classifier tree/algorithm utilized to classify the scene utilized by the prosthesis is not as utilitarian as otherwise may be the case. Thus, the prosthesis and/or other system adjusts the algorithm/classifier tree so that the new exit node is added to the decision tree. As can be seen in this embodiment, the prior false exit node is still retained, as that can have utilitarian value with respect to another exemplary scenario. That said in an alternate embodiment, that exit node is completely removed, as is conceptually represented by FIG. 25A.

It is further noted that while these exemplary conceptual embodiments associated with the decision trees have been described in terms of utilizing a reference classifier to adjust or otherwise adapt the scene classification system of a hearing prosthesis, in alternate embodiment, recipient feedback as detailed herein can be utilized. Any device, system, and/or method that can enable the adjustment of the decision tree to develop a new exit node that enables the scene classifier system to more accurately classify the scene can be utilized in at least some exemplary embodiments.

Figure 25B:
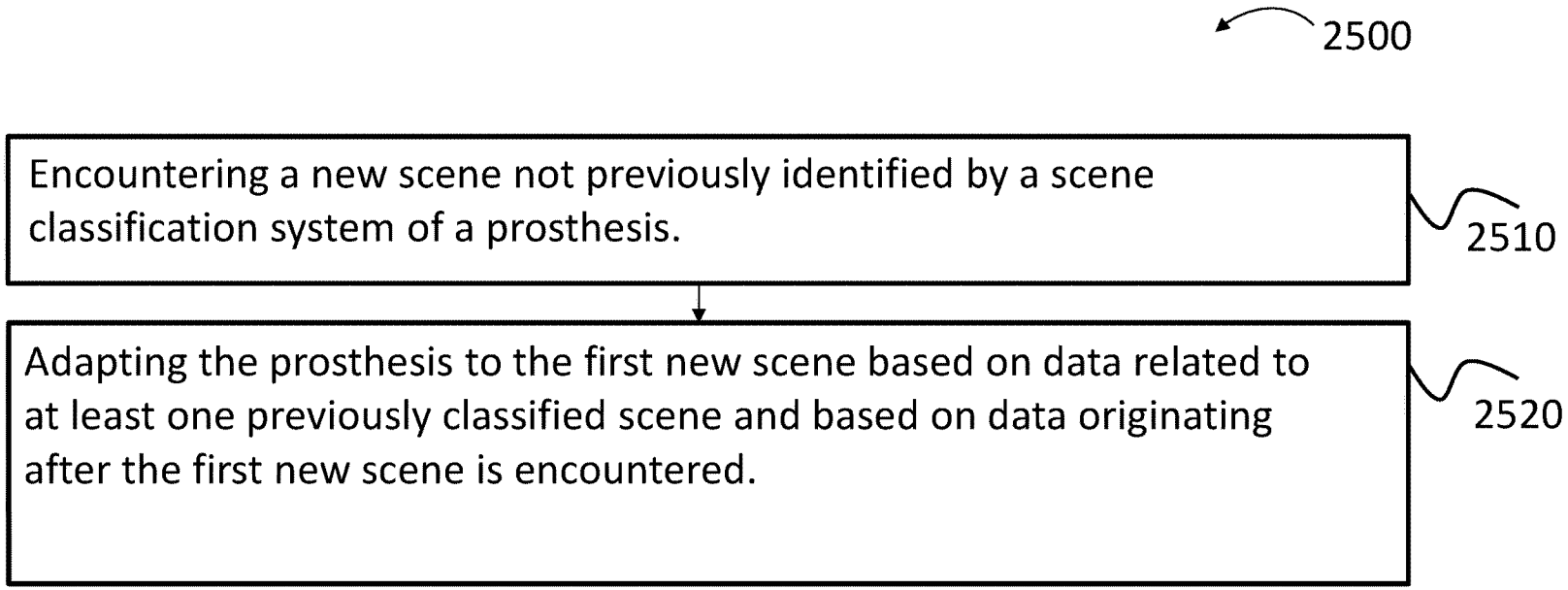
FIG. 25B presents an exemplary flowchart for an exemplary method.

In view of the above, now with reference to FIG. 25B, which presents an exemplary flowchart for an exemplary method 2500, it can be understood that in an exemplary embodiment, there is a method which comprises method action 2510, which entails encountering a new scene not previously identified by a scene classification system of a prosthesis. This action can correspond to any of the teachings detailed herein and/or variations thereof that are concomitant with this method action. Method 2500 further includes method action 2520, which entails adapting the prosthesis to the new scene based on data related to at least one previously classified scene and based on data originating after the new scene is encountered.

With respect to the former, the data related to at least one previously classified scene, this can correspond to data related to a scene that is similar to the new scene, again in accordance with the teachings detailed herein. In an exemplary embodiment, this can correspond to the feature sets or the like that are utilized by the scene classifier system to classify the similar scene (e.g., the data related to at least one previously classified scene is a feature regime of the scene classifier system.). Still further, in an exemplary embodiment, the data related to at least one previously classified scene can correspond to a signal processing regime utilized by the prosthesis to process data from the similar scene to evoke a sensory percept (and in an exemplary embodiment, the adapted scene classification system regime is a new signal processing regime of the prosthesis that is used by the prosthesis to process data from the new scene). In an exemplary embodiment, method 2500 includes the action of selecting the at least one previously classified scene based on a similarity to the new scene. Any data that is related to at least one previously classified scene can be utilized in at least some exemplary embodiments.

With respect to the latter (the post new scene encounter data), this can correspond to recipient feedback of a signal processing regime applied to the new scene in accordance with the teachings detailed herein and/or variations thereof. Still further, in an exemplary embodiment, this can correspond to randomized data in accordance with a genetic algorithm (e.g., analogous to the utilization of the genetic algorithm disclosed in US Patent Application Publication Number 20050107845, as noted above). Indeed, in an exemplary embodiment, method 2500 further includes the action utilizing such random data to modify the data related to the at least one previously classified scene, wherein the action of adapting the prosthesis comprises using the modified data to operate the scene classifier system.

Any data that can be utilized to adapt the prosthesis to the new scene which originated after the new scene is encountered (as opposed to, for example, data associated with the new scene, which necessarily corresponds to data that originates at the time of encountering the new scene) can be utilized in at least some exemplary embodiments.

Consistent with the teachings detailed above, in an exemplary embodiment, the action of adapting the prosthesis comprises generating new scene classifier system settings via a machine learning algorithm that uses the data related to at least one previously classified scene and the data originating after the new scene is encountered. In an exemplary embodiment, the machine learning algorithm can be a genetic algorithm. It is noted that these new scene classifier system settings can be new settings for a signal processing regime and/or settings for the scene classifier and/or any other settings that can have utilitarian value, providing that such settings adapt the prostheses in accordance with method action numeral 2520.

Thus, in an exemplary embodiment, the data related to at least one previously classified scene is a signal processing regime of the prosthesis (e.g., one used to process sound of the previously classified scene) and the action of adapting the prosthesis to the new scene entails developing a new signal processing regime of the prosthesis that is used by the prosthesis to process data from the new scene. Consistent with the embodiments detailed herein, this action of developing the new signal processing regime could entail utilizing the old signal processing regime and modifying that signal processing regime utilizing a random variation.

Figure 25C:
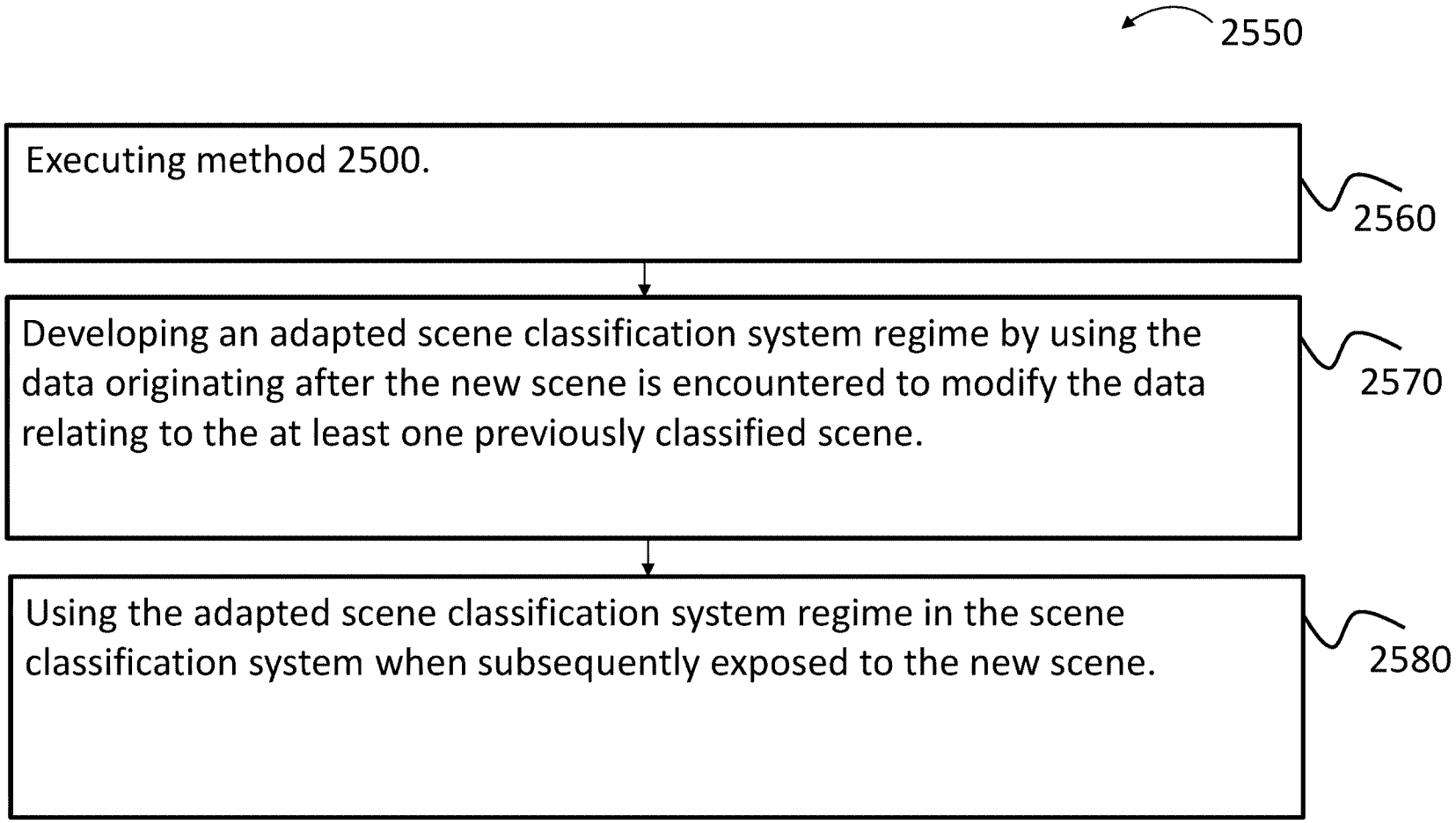
FIG. 25C presents an exemplary flowchart for another exemplary method.

That said, referring back to the teachings at the beginning of this disclosure vis-à-vis feature regimes, in some exemplary embodiments, the data related to at least one previously classified scene can be a feature regime of the scene classifier system. Further in this vein, FIG. 25C presents another exemplary method, 2550, which entails method action 2560, which entails executing method 2500. Method 2550 further includes method action 2570, which entails developing an adapted scene classification system regime by using the data originating after the new scene is encountered to modify the data relating to the at least one previously classified scene. Method 2550 also includes method action 2580, which entails using the adapted scene classification system regime in the scene classification system when subsequently exposed to the new scene.

Figure 25D:
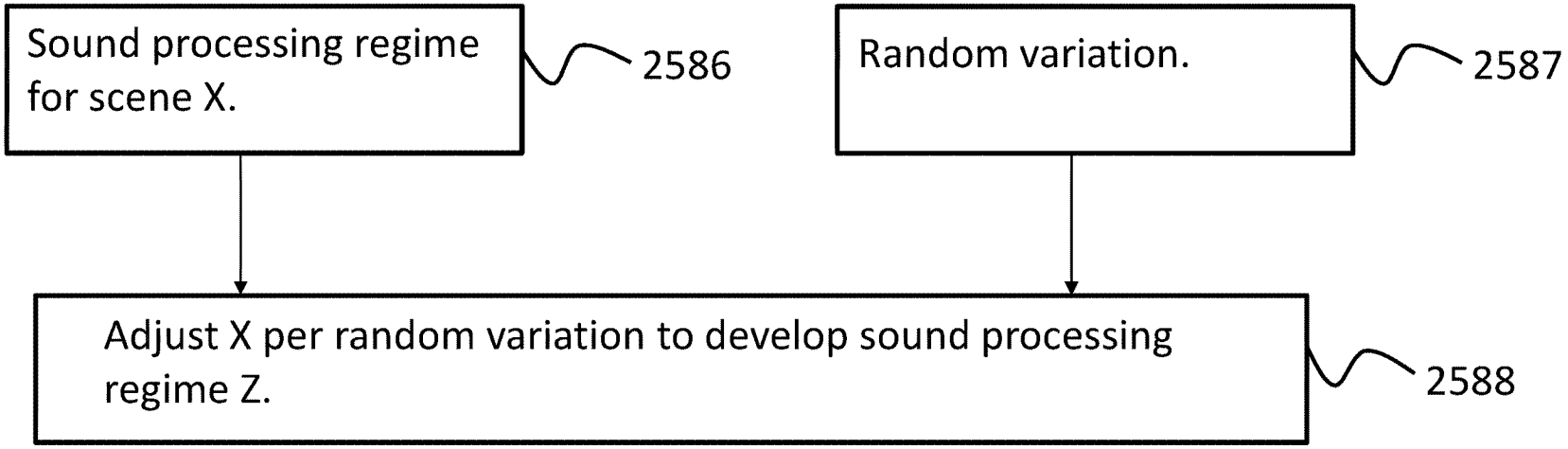
FIGS. 25D-F present exemplary conceptual block diagrams representing exemplary scenarios of implementation of some exemplary teachings detailed herein.

FIG. 25D depicts an exemplary block diagram of an exemplary scenario utilizing random variation. In an exemplary embodiment, a new scene is countered, where, for the purposes of this paragraph, such new scene will be called scene Z, which is a sound scene in this embodiment (although in other embodiments, the scene could be a light scene or another type of scene etc.). The current state of the hearing prosthesis such that there exists a processing regime for scene X. In this exemplary scenario, the prosthesis or other system determines that scene X is the closest scene to scene Z. The state of the prosthesis is such that there exists a sound processing regime for scene X. this is represented by block 2586. The prosthesis or other system selects the sound processing algorithm/the sound processing regime for scene X as the regime to be modified or otherwise the sound processing regime from which to build a new processing regime Z to process the new scene Z. Block 2587 represents the random variation, and block 2588 represents the adjustment of X per the random variation to develop sound processing regime Z.

Figure 25E:
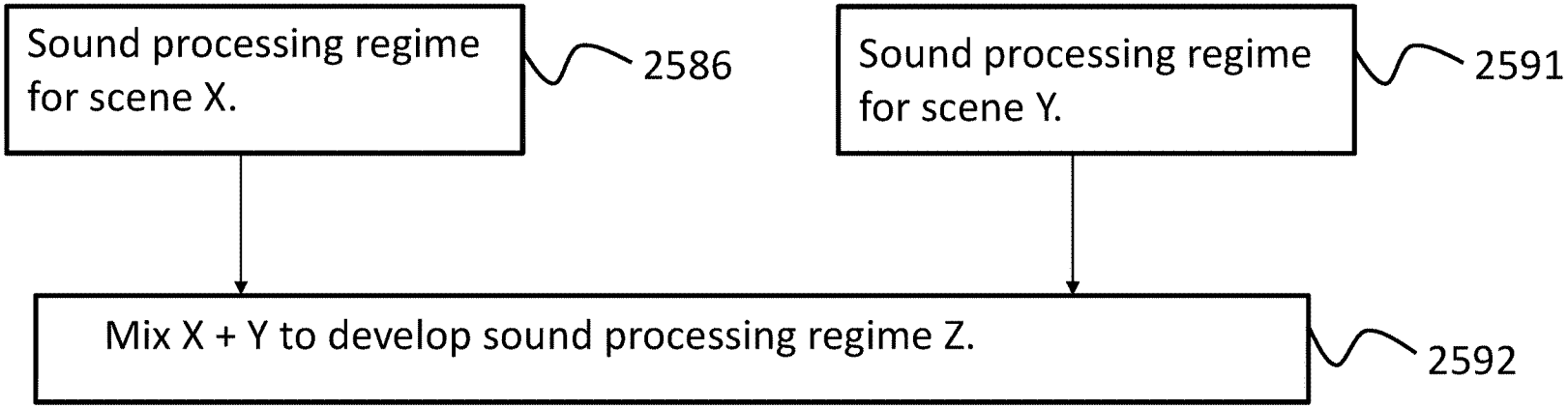
Figure 25F:
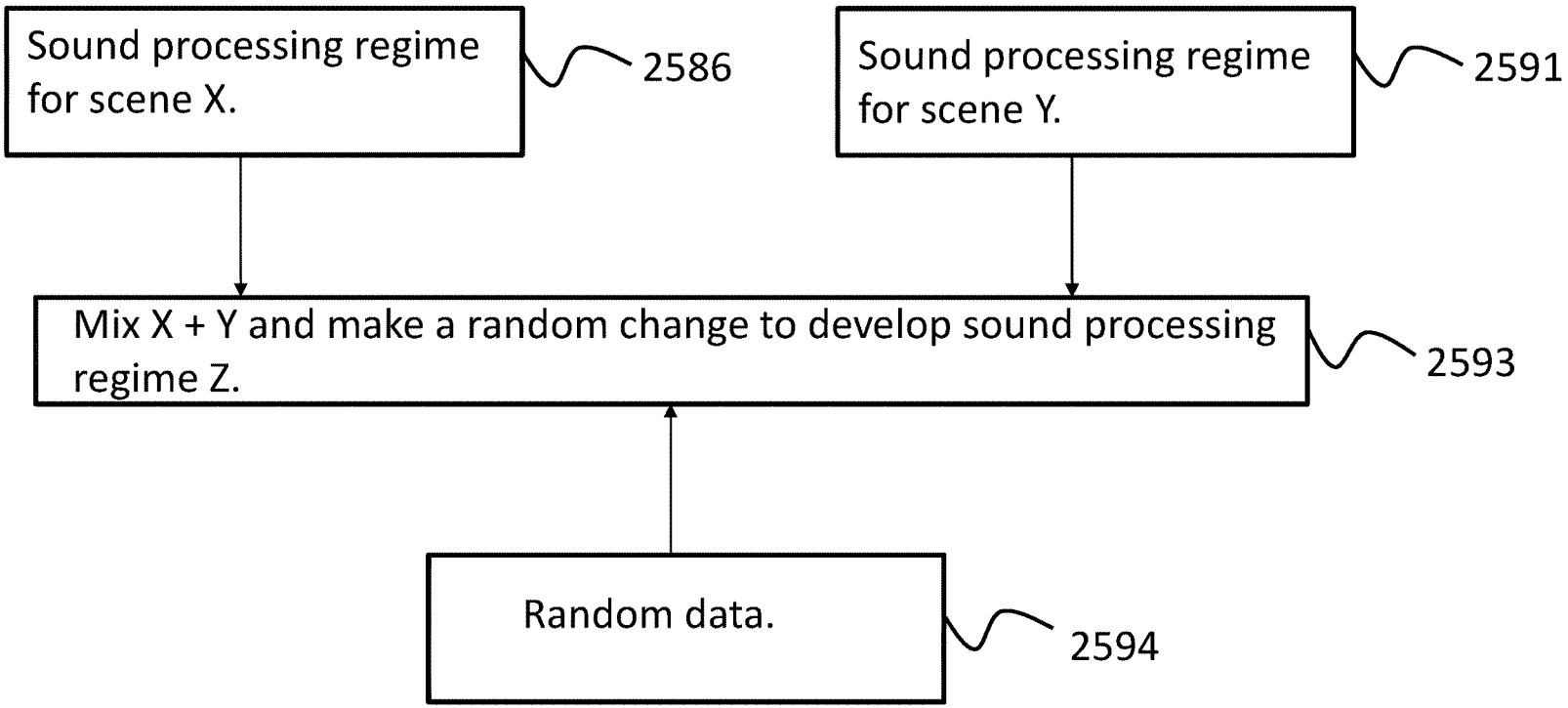

It is noted that some exemplary embodiments of the teachings detailed herein can be implemented based on more than one sound processing regime/utilizing more than one processing regime from which to work. This is represented in a conceptual manner by FIG. 25E. As can be seen, the state of the prosthesis corresponds to that detailed above these of the scene X. Still further, the state of the prosthesis is such that there exists a sound processing regime for scene Y, represented by block 2591. In an exemplary scenario, the prosthesis determines (or other system) that the new scene Z is close to scene X and scene Y (or is the closest to those two scenes in an embodiment where an algorithm used by the prosthesis or other system picks the two closest scenes instead of the closest scene, as opposed to another exemplary embodiment where the algorithm utilized by the prosthesis or other system picks the three closest scenes or the four closest scenes etc.). In an exemplary embodiment, the prosthesis or other system determines that new scene Z is in between scene X and scene Y. At Block 2592, the prosthesis or other system mixes X and Y together to develop the sound processing regime Z. In an exemplary embodiment, the algorithm utilized by the system mixes the two sound processing regimes in a random manner (e.g., picking some features from each regime in a random manner and merging those randomly selected features to form the regime for Z, randomly modifying the features of the regime for X based on a randomly selected feature of Y to form the features of Z, etc.). That said, in an alternate embodiment, the actions that are executed with respect to block 2592 can further include inserting an additional random feature unrelated to either of the sound processing regimes for the scene X and the scene Y (e.g. increasing or otherwise changing the gain of certain frequency bands relative to others with respect to the resulting sound processing regime that results from the mixing of regime X and regime Y, etc.). This is represented by way of example with respect to FIG. 25F, where Block 2594 constitutes the random data, and block 2593 entails mixing the regimes for scene X and scene Y and also making a random change based on the random date of block 2594. Note also that in an exemplary embodiment, the combination of the sound processing regime for scene X with the sound processing regime for scene Y can be performed according to a nonrandom algorithm/nonrandom manner, where the randomization occurs after the two regimes are merged.

Figure 26:
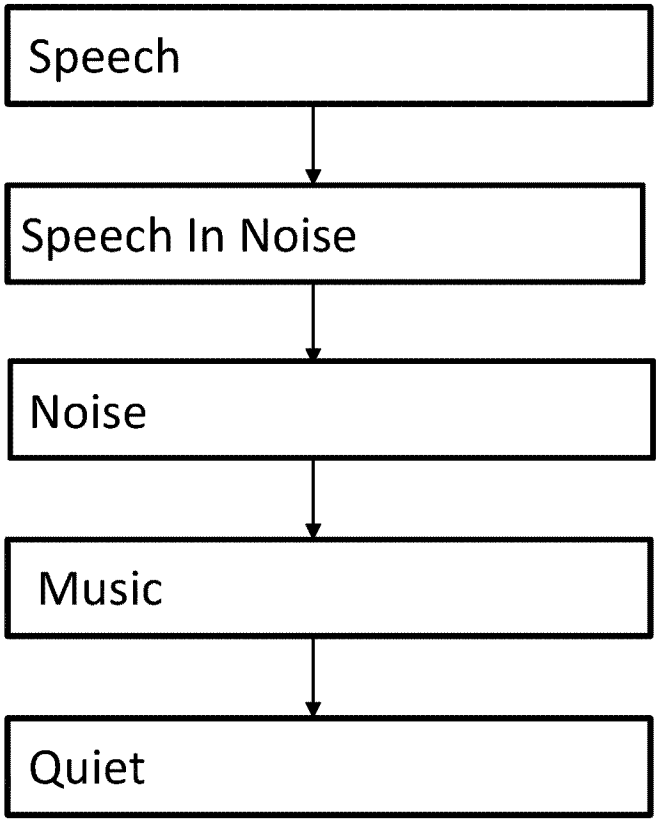
FIG. 26 presents a portion of an exemplary scene classification algorithm.
Figure 27:
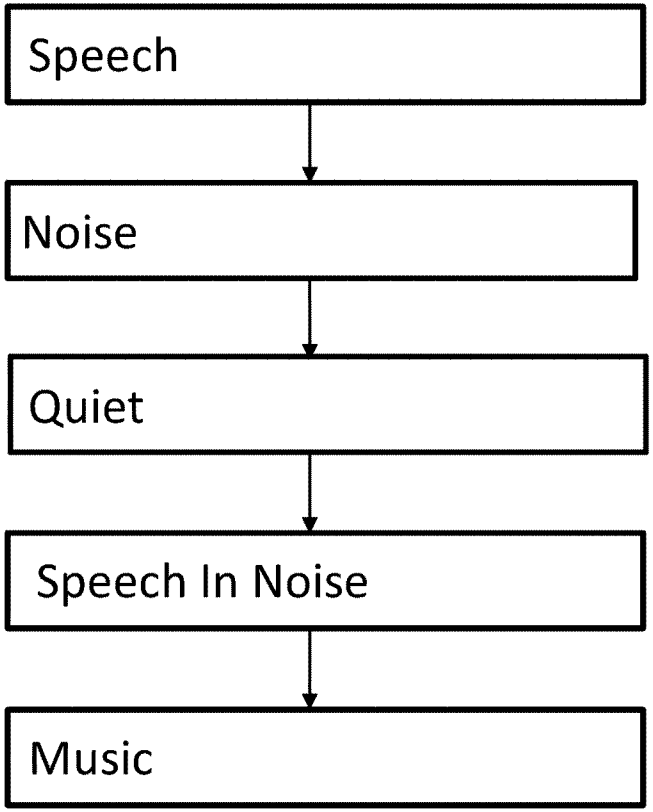
FIG. 27 presents another portion of an exemplary scene classification algorithm.

As noted above, embodiments of the teachings detailed herein can utilize the amount of time that a recipient spends or otherwise is exposed to a given scene environment to adapt the scene classifier system. FIG. 26 presents an exemplary proto-algorithm for a scene classifier system corresponding to that which can be programmed or otherwise set at the factory or otherwise initial fitting of the prosthesis. FIG. 26 presents a general primacy of some exemplary scenes in a given scene classifier algorithm, in this case, as this exemplary scenario is directed towards a hearing prosthesis, as those scenes are initially weighted in the scene classifier system. By way of example, in a given scenario of use by the prosthesis, the scene classifier system is set so as to first evaluate whether a scene corresponds to speech, then to evaluate whether a scene corresponds to speech and noise, then evaluate whether the scene corresponds to noise, then evaluate whether the scene corresponds to music, then evaluate whether the scene corresponds to quiet, in that order. This is another way of saying that in at least some exemplary scenarios, the classifier system is set under the presumption that it is more likely that a given scene will be considered speech relative to any other single possible scene currently that is part of the set of scenes in the scene classifier system, and then that a given scene will be considered speech and noise relative to any other single possible scene currently that is part of the set of scenes in the scene classifier system other than speech, etc. However, after the prosthesis is used for a given period of time, the primacy of those scenes of the set of scenes could be reordered based on the amount of time that the recipient is exposed there to. Thus, FIG. 27 represents a reordered set of scenes with respect to primacy of a given scene as it relates to the scene classification algorithm. As can be seen, the scene classifier has adapted itself so as to place noise and quiet above speech in noise and to move music to the last position.

Figure 28:
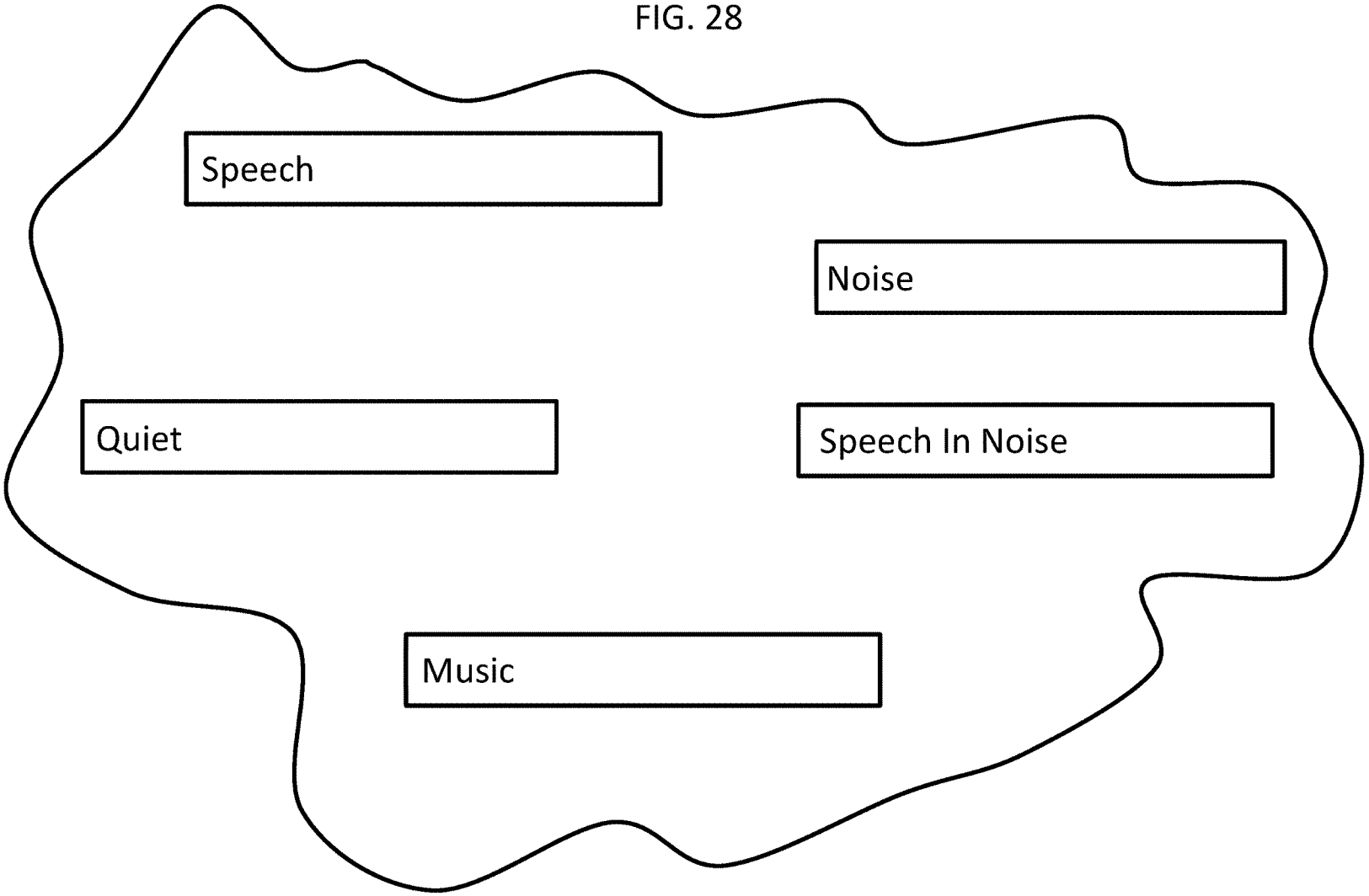
FIG. 28 presents an exemplary scene classification set.

It is briefly noted that while FIGS. 26 and 27 (and the other related figures) are presented in terms of primacy of a given scene with respect to a given algorithm, in alternative embodiments, these simply represent a set of scenes that the classifier will identify based on a given feature set (including those developed according to the teachings detailed herein) and/or based on the given algorithm utilized to classify auditory scenes (including those resulting from adjustments to the adaptive subsystem, etc.). That is, while the following teachings will be presented in terms of a primacy of a decision algorithm, such primacy may not be used in some alternate embodiments, and instead, the pure results of a given analysis based on feature sets and/or algorithms will be utilized. FIG. 28 functionally represents this concept. Accordingly, any disclosure herein with respect to a set of scenes that has a primacy feature associated therewith corresponds to a disclosure of a set of scenes that corresponds to a set without primacy.

Figure 29:
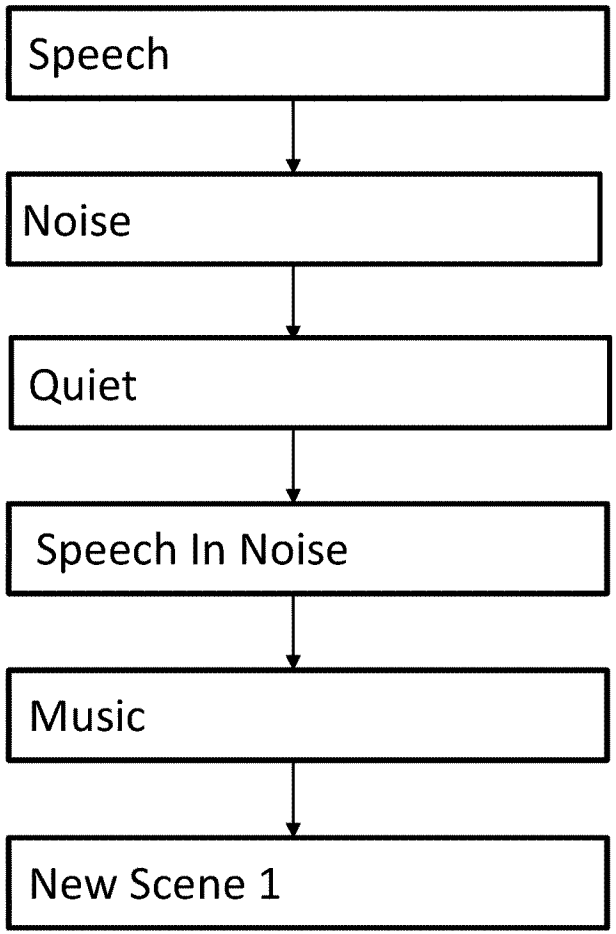
FIG. 29 presents another portion of an exemplary scene classification algorithm.
Figure 30:
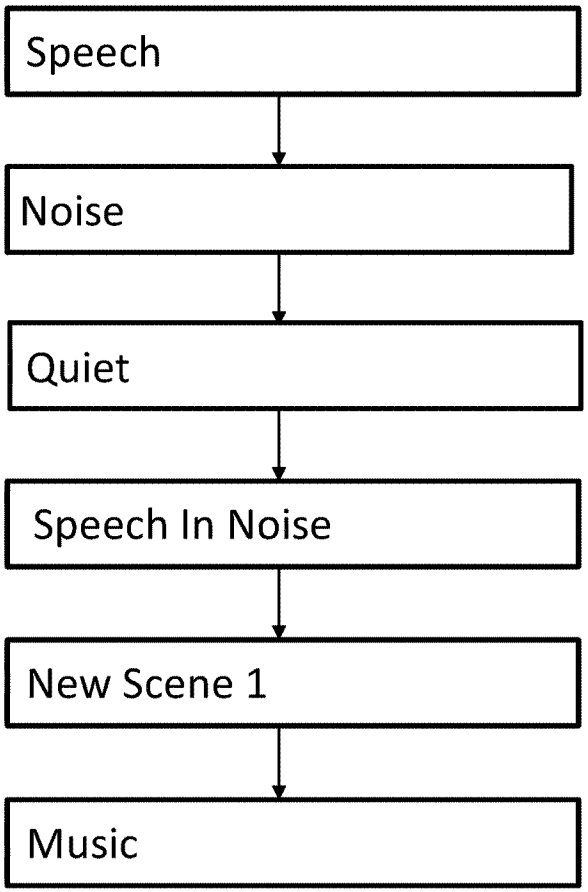
FIG. 30 presents another portion of an exemplary scene classification algorithm.

Subsequent to the adaptation of the scene classifier system to result in the primacy of the given scenes according to that represented in FIG. 27 (or FIG. 28), a new scene is experienced, new scene 1. This new scene is added to the set of scenes, but it is added in the last place in view of the fact that it is new, as can be seen in FIG. 29. That said, in an alternate scenario, this new scene can replace a scene that has never been experienced by the recipient, even though such is within the standard set of scenes. For example, FIG. 30 represents an alternate scenario where music is relegated to the last place on the decision tree algorithm, and the new scene 1 is located in its place. This could occur because the standard music scene has never been experienced, or because this new scene is exposed to the prosthesis for such a long period of time that the decision tree logic provides for primacy of the scene relative to that of another scene. Note further that in an exemplary embodiment, such could result in a scenario where over a period of time, this new scene surpasses the standard music scene because the frequency of occurrence of exposure to this new scene warrants such.

Figure 31:
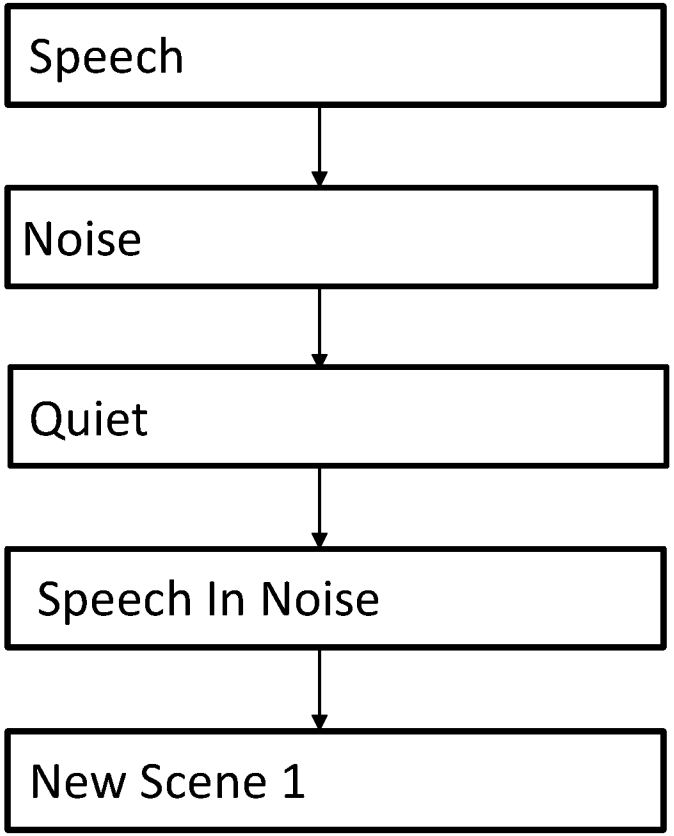
FIG. 31 presents another portion of an exemplary scene classification algorithm.

Note also that in an exemplary embodiment, the classifier system can be adapted so as to remove scenes that are infrequently experienced. For example, FIG. 31 depicts a decision algorithm where music (the conventional/standard scene setting) is removed from the algorithm. In an exemplary embodiment, a statistical analysis of the environments to which the prosthesis is exposed can reveal that the recipient rarely or never listens to traditional music. Indeed, in an exemplary embodiment, new scene 1 can be bossa nova music, thus the traditional music scene is replaced with a bossa nova music scene. Thus, the traditional music scene is completely removed from the algorithm. In an exemplary embodiment, this can have utilitarian value with respect to not only improving decision speed (e.g., because the algorithm will never consider the scene because it is statistically speaking never encountered), but also because the likelihood of a non-efficacious scene classification will be reduced (removing the possibility from the scene classifier system of classifying a scene that is almost never experienced).

Figure 32:
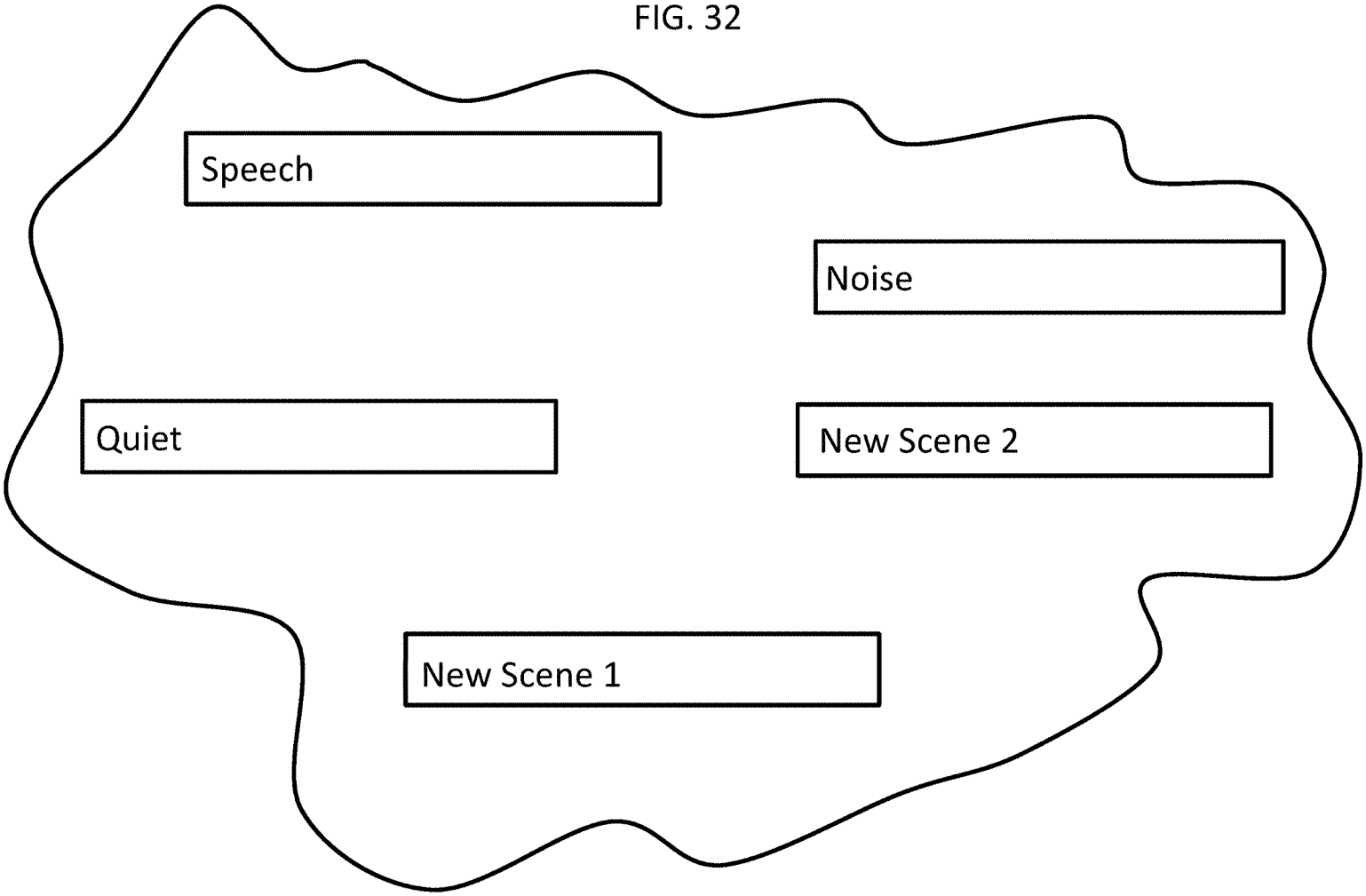
FIG. 32 presents another exemplary scene classification set.

Note further that there can be utilitarian value with respect to having a limited set of scenes from which the scene classifier system can choose by way of example, there can be utilitarian value with respect to only permitting five different scenes from being classified by the scene classifier system. Accordingly, in an exemplary embodiment, the period of time spent in a given scene can be utilized to determine whether a scene should be preserved. FIG. 32 represents an exemplary set of scenes where the recipient experiences two different new scenes on a more frequent basis than speech in noise Accordingly, it is to be understood that at least some exemplary embodiments provide adaptation to the scene classifier system such that scenes can be classified in a faster or more efficient manner because fewer reference scenes must be evaluated (e.g., with respect to the above exemplary embodiment, speech and noise is not evaluated or otherwise considered or alternatively, is the last reference scene considered). Corollary to this is that the overall confidence in the scene classification system can be increased. By eliminating statistically insignificant scenarios, the likelihood that the scene classifier system will result in a determination of the correct scene is increased.

Thus, an exemplary embodiment entails linking method actions associated with scene classification to long-term device usage data. By way of example only and not by way of limitation, in an exemplary embodiment where a given scene of the scene sets is not encountered for a period of a few days, a given scene may be removed from the populations of scenes from which the scene classifier will classify scene. In an exemplary embodiment, such can be the case where a scene is not encountered for at least one week, or at least two weeks, or at least three weeks, or at least four weeks, or at least five weeks, or at least six weeks, or at least two months, or at least three months, or at least four months, or at least five months, or at least six months, or at least nine months, or at least a year, or more. Still further, in an exemplary embodiment, such scene elimination can be limited to scenarios where new scenes are encountered within the period of times. For example, even though a scene is not encountered for a three-month period, that scene will be preserved in the scene classifier system unless a new scene is encountered during that period of time. In an exemplary embodiment, the given scene will be replaced with this new scene.

Note that the above aforementioned timescales are not only applicable to the limited embodiment of scene elimination/scene supplementation, but also with respect to the aforementioned development of new feature subsets for the feature superset and the general adjustment of the adaptation sub-set. Thus, in an exemplary embodiment, by way of example only and not by way of limitation, (i) the adjustments to the adaptation sub-system can occur at least after a period of a few days since the scene classifier was first used to classify a scene (which can be a new scene), (ii) a subsequent adjustment to the adaptation sub-system can occur after a period of a few days since the scene classifier was last adjusted and/or (iii) an adaptation of the scene classifier system can occur at least after a period of a few days since the last adaptation. In an exemplary embodiment, such can be the case after a week has elapsed, or after the elapsation of at least two weeks, or at least three weeks, or at least four weeks, or at least five weeks, or at least six weeks, or at least two months, or at least three months, or at least four months, or at least five months, or at least six months, or at least nine months, or at least a year, or more.

It is noted that in at least some exemplary embodiments, implementation of the teachings detailed herein detailed herein does not constitute a mere initial training of the scene classifier system, after which the scene classifier system is frozen or the like. Instead, the teachings detailed herein are utilized in at least a semi-continuous manner.

Note also that in addition to or alternatively to the utilization of temporal aspects associated with a various environment, other factors can be utilized to determine primacy and/or otherwise develop a set of scenes for the scene classifier system. For example, there can exist a scenario where the recipient finds it very comfortable or otherwise utilitarian to "manually" adjust the prosthesis when exposed to a given scene. For example, a machinist may always set the prosthesis to a sound processing regime that he or she finds utilitarian for that environment when starting work for the day. Indeed, it very well may be that this is the most prevalent scene that the recipient experiences. However, the recipient simply does not want the scene classifier system to attempt to classify noise because he or she already does that on a manual basis, or more accurately, the results of such classification are implemented by the recipient on a manual basis. Thus, the scene classifier system could be such that the noise environment is not part of the possible scenes. This could be a result of a machine learning algorithm where regardless of how the prosthesis adjusts the signal processing regime, the recipient makes a subsequent adjustment. That is, the scene classification system can have the ability to determine that it is a "waste of time"/that it should give up trying to classify a given scene and/or trying to apply a given sound processing regime to the noise environment. Thus, the scene classification system will have assets that are free to apply to other types of classification where the recipient may want or otherwise find such classification utilitarian.

It is briefly noted that at least some exemplary embodiments include exemplary methods where a scene classifier system regime that is developed for a first prosthesis is transferred in whole or in part to a subsequent/different prosthesis. By way of exemplary scenario, and an exemplary embodiment, the teachings detailed herein are applied utilizing a hearing prosthesis that has a first behind the ear device, which behind the ear device includes at least a portion of the scene classifier system. For various reasons, the recipient obtains a new behind the ear device (a second behind the ear device), which is to replace the first behind the ear device. In an exemplary scenario, the second behind the ear device is a newer model with improved capabilities. By way transferring the scene classifier system regime developed for the first prosthesis to the second prostheses, such as by transfer from the first behind the ear device to the second behind the ear device, the personalize features of the scene classifier system developed for that recipient are maintained and are enabled to be utilized in the second hearing prostheses.

It is noted that any method detailed herein also corresponds to a disclosure of a device and/or system configured to execute one, or more, or all of the method actions and/or scenario actions associated therewith detailed herein. In an exemplary embodiment, this device and/or system is configured to execute one, or more, or all of the method actions and/or scenario actions in an automated fashion. In this regard, exemplary embodiments include circuitry and/or circuit systems and/or processors and/or computers with software and/or firmware that will enable such to be executed in the aforementioned automated fashion. That said, in an alternate embodiment, the device and/or system is configured to execute one, or more, or all of the method actions after being prompted by the recipient or by another human.

It is further noted that any disclosure of a device and/or system herein further includes a disclosure of a method of utilizing that device and/or system, as well as a method corresponding to the functionality of those devices and/or systems when such devices and/or systems are utilized to achieve the disclosed functionality. It is also noted that any disclosure of a device and/or system herein further corresponds to a disclosure of a method of manufacture of that device and/or system. Corollary to this is that any disclosure of a method action associated with making or otherwise establishing a device and/or system corresponds to a disclosure of a device and/or system resulting from that method action.

In an exemplary embodiment, there is a method comprising adapting a scene classifier system of a prosthesis configured to sense a range of data based on input based on data external to the range of data. In an exemplary embodiment, there is a method as described above and/or below, wherein the prosthesis is a hearing prostheses. In an exemplary embodiment, there is a method as described above and/or below, where the prosthesis is a retinal prostheses. In an exemplary embodiment, there is a method as described above and/or below, wherein the input is input based on hearing test performance of a recipient of the hearing prostheses. In an exemplary embodiment, there is a method as described above and/or below, wherein the input is event non-occurrence based data. In an exemplary embodiment, there is a method as described above and/or below, where the input is temporal based data. In an exemplary embodiment, there is a method as described above and/or below, wherein the action of adapting the scene classifier system entails utilizing a different feature set to classify future scenes than that which was the case prior to the adaptation.

In an exemplary embodiment, there is a prosthesis, comprising:

a scene classifier system; and an output unit configured to evoke a sensory percept of a recipient, wherein scene classifier system includes an adaption sub-system that enables adaptation of an operation of the scene classifier system, and the prosthesis is configured to:

receive input indicative of an evaluation of an adaption of the scene classifier; and enable adjustment of the adaptation sub-system.

In an exemplary embodiment, there is a prosthesis as described above and/or below, wherein the prosthesis is configured to automatically adjust the adaptation sub-system based on the received input. In an exemplary embodiment, there is a system comprising the prosthesis as described above and/or below, further including a remote device, wherein the remote device is configured to generate the input indicative of the evaluation received by the sense prosthesis. In an exemplary embodiment, there is a prosthesis as described above and/or below, wherein the prosthesis is configured to maintain a scene log and the prosthesis is configured to enable a remote device to access the scene log.

In an exemplary embodiment, there is a prosthesis, comprising:

a scene classifier system; and an output unit configured to evoke a sensory percept of a recipient, wherein scene classifier system includes an adaption sub-system that enables adaptation of an operation of the scene classifier system, and the prosthesis is configured to:

receive input indicative of an evaluation of an adaption of the scene classifier; and enable adjustment of the adaptation sub-system.

In an exemplary embodiment, there is a prosthesis as described above and/or below, wherein the prosthesis is configured to automatically adjust the adaptation sub-system based on the received input. In an exemplary embodiment, there is a prosthesis as described above and/or below, wherein the prosthesis is configured to automatically adjust the adaptation sub-system based on received input based on non-audio phenomena. In an exemplary embodiment, there is a prosthesis as described above and/or below, wherein the received input is input from a recipient of the prosthesis. In an exemplary embodiment, there is a prosthesis as described above and/or below, wherein the received input is input from a remote reference classifier. In an exemplary embodiment, there is a prosthesis as described above and/or below, wherein the prosthesis is configured to maintain a log of an operation of the adaptation sub-system, enable remote access to the log and enable remote adjustment of the adaptation sub-system of the scene classifier system based on the log.

In an exemplary embodiment, there is a system comprising a prosthesis as described above and/or below, and a remote reference classifier, wherein the remote reference classifier is configured to compare the log to data stored in the reference classifier and execute an evaluation of an operation of the adaptation sub-system, and, based on the comparison, generate output corresponding to the input indicative of an evaluation of an adaption of the scene classifier.

In an exemplary embodiment, there is a prosthesis as described above and/or below, wherein the prosthesis is configured to adapt the prosthesis to newly encountered scenes to which the prosthesis is exposed by assigning for use by a signal processor respective signal processing regimes via the use of a machine learning algorithm supplemented by extra-prosthesis data. In an exemplary embodiment, there is a prosthesis as described above and/or below, wherein the machine learning algorithm is a genetic algorithm. In an exemplary embodiment, there is a prosthesis as described above and/or below, wherein the machine learning algorithm takes into account temporal and repetitive aspects of the newly encountered scenes In an exemplary embodiment, there is a prosthesis as described above and/or below, wherein the prosthesis is configured to compare results of the machine learning algorithm to the extra-prosthesis data to determine success of results of the machine learning algorithm, and if unsuccessful, change a portion of the algorithm of the machine learning algorithm.

In an exemplary embodiment, there is a method comprising encountering a new scene not previously identified by a scene classification system of a prosthesis; and adapting the prosthesis to the new scene based on data related to at least one previously classified scene and based on data originating after the new scene is encountered.

In an exemplary embodiment, there is a method as described above and/or below, wherein the action of adapting the prosthesis comprises generating new settings for the scene classifier system via a machine learning algorithm that uses the data related to at least one previously classified scene and the data originating after the new scene is encountered In an exemplary embodiment, there is a method as described above and/or below, wherein the action of adapting the prosthesis comprises generating new settings for the scene classifier system via a genetic algorithm that uses the data related to at least one previously classified scene and the data originating after the new scene is encountered.

In an exemplary embodiment, there is a method as described above and/or below, wherein the data originating after the new scene is encountered is input from a recipient of the prosthesis indicative of an efficacy of a signal processing regime of the prosthesis applied to evoke a sensory percept based on the new scene.

In an exemplary embodiment, there is a method as described above and/or below wherein data originating after the new scene is encountered is random data, the method further comprises using the random data to modify the data related to the at least one previously classified scene; and the action of adapting the prosthesis comprises using the modified data to operate the scene classifier system.

In an exemplary embodiment, there is a method as described above and/or below, wherein the data related to at least one previously classified scene is a signal processing regime of the prosthesis, and the action of adapting the prosthesis to the new scene entails developing a new signal processing regime of the prosthesis that is used by the prosthesis to process data from the new scene. In an exemplary embodiment, there is a method as described above and/or below, wherein the data related to at least one previously classified scene is a feature regime of the scene classifier system.

In an exemplary embodiment, there is a method as described above and/or below, further comprising the action of developing an adapted scene classification system regime by using the data originating after the new scene is encountered to modify the data relating to the at least one previously classified scene; and using the adapted scene classification system regime in the scene classification system when subsequently exposed to the new scene.

In an exemplary embodiment, there is a method as described above and/or below, further comprising the action of selecting the at least one previously classified scene based on a similarity to the new scene.

In an exemplary embodiment, there is a sense prosthesis, comprising:

a signal processor configured to process signals emanating from respective scenes to which the sense prosthesis is exposed; and a stimulator component configured to evoke a sensory percept of a recipient based on operation of the signal processor, wherein the sense prosthesis is configured to adapt the sense prosthesis to newly encountered scenes to which the sense prosthesis is exposed by assigning for use by the signal processor respective signal processing regimes according to a machine learning algorithm supplemented by extra-prosthesis data.

In an exemplary embodiment, there sense prosthesis as described above and/or below, wherein the machine learning algorithm is a genetic algorithm. In an exemplary embodiment, there is a sense prosthesis as described above and/or below, wherein the extra-prosthesis data is respective recipient feedback based on the respective assigned respective signal processing regimes. In an exemplary embodiment, there is a sense prosthesis as described above and/or below, wherein the extra-prosthesis data is respective third-party feedback based on the respective assigned respective signal processing regimes. In an exemplary embodiment, there is a sense prosthesis as described above and/or below, wherein the machine learning algorithm takes into account temporal and repetitive aspects of the newly encountered scenes.

In an exemplary embodiment, there is a sense prosthesis as described above and/or below, wherein the sense prosthesis is configured to compare results of the machine learning algorithm to the extra-prosthesis data to determine success of results of the machine learning algorithm, and if unsuccessful, change a sub-algorithm of the machine learning algorithm.

It is noted that embodiments include non-transitory computer-readable media having recorded thereon a computer program for executing one or more or any of the method actions detailed herein. Indeed, in an exemplary embodiment, there is a non-transitory computer-readable media having recorded thereon, a computer program for executing at least a portion of at least one of the methods detailed herein/one or more or all method actions detailed herein.

It is further noted that any device and/or system detailed herein also corresponds to a disclosure of a method of operating that device and/or using that device. Furthermore, any device and/or system detailed herein also corresponds to a disclosure of manufacturing or otherwise providing that device and/or system.

Also, it is noted that in at least some exemplary embodiments, any singular teaching detailed herein can be combined in whole or in part with any other singular teaching detailed herein unless otherwise specified.

While various embodiments of the present invention have been described above, it should be understood that they have been presented by way of example only, and not limitation. It will be apparent to persons skilled in the relevant art that various changes in form and detail can be made therein without departing from the spirit and scope of the invention.

What is claimed is:

1. A method, comprising:

capturing first sound with a hearing prosthesis;

classifying the first sound using the hearing prosthesis according to a first feature regime;

capturing second sound with the hearing prosthesis; and classifying the second sound using the hearing prosthesis according to a second feature regime different from the first feature regime, wherein the first feature regime utilizes at least one of mel-frequency cepstral coefficients, spectral sharpness, zero-crossing rate, or spectral roll-off frequency, and the second feature regime does not utilize at least one of mel-frequency cepstral coefficients, spectral sharpness, zero-crossing rate, or spectral roll-off frequency.

2. The method of claim 1, wherein:

the actions of classifying the first sound and classifying the second sound are executed by a sound classifier system of the hearing prosthesis; and the actions of capturing first sound, classifying the first sound, capturing the second sound and classifying the second sound are executed during a temporal period free of sound classifier system changes not based on recipient activity.

3. The method of claim 1, wherein:

the first feature regime includes a feature set utilizing a first number of features; and the second feature regime includes a feature set utilizing a second number of features different from the first number.

4. The method of claim 1, wherein:

the first feature regime is qualitatively different than the second feature regime.

5. The method of claim 1, further comprising:

between classifying of the first sound and the classifying of the second sound, creating the second feature regime by eliminating a feature from the first feature regime.

6. The method of claim 1, further comprising:

between classifying of the first sound and the classifying of the second sound, creating the second feature regime by adding a feature to the first feature regime.

7. The method of claim 1, further comprising, subsequent to the actions of capturing first sound, classifying the first sound, capturing the second sound and classifying the second sound:

executing an "i"th action including:

capturing ith sound with the hearing prosthesis; and classifying the ith sound using the hearing prosthesis according to an ith feature regime different from the first and second feature regimes;

re-executing the ith action for ith=ith+1 at least three times, where the ith+1feature regime is different from the first and second feature regimes and the ith feature regime.

8. The method of claim 7, wherein, the ith actions are executed within 2 years.

9. The method of claim 1, further comprising, subsequent to the actions of capturing first sound, classifying the first sound, capturing the second sound and classifying the second sound:

executing an "i"th action including:

capturing ith sound with the hearing prosthesis; and classifying the ith sound using the hearing prosthesis according to an ith feature regime different from the first and second feature regimes;

capturing an ith+1 sound with the hearing prosthesis; and classifying the ith+1 sound using the hearing prosthesis according to an ith+1feature regime different from the ith feature regime;

re-executing the ith action for ith=ith+1 at least three times.

10. A method, comprising:

classifying a first sound scene to which a hearing prosthesis is exposed according to a first feature subset during a first temporal period;

classifying the first sound scene according to a second feature subset different from the first feature subset during a second temporal period of exposure of the hearing prosthesis to the first sound scene;

classifying a plurality of sound scenes according to the first feature subset for a first period of use of the hearing prosthesis; and classifying a plurality of sound scenes according to the second feature subset for a second period of use of the hearing prosthesis, wherein the second period of use extends temporally at least five times longer than the first period of use.

11. The method of claim 10, further comprising:

developing the second feature subset based on an evaluation of the effectiveness of the classification of the sound scene according to the first feature subset.

12. The method of claim 11, wherein the evaluation of the effectiveness of the classification of the sound scene is based on one or more latent variables.

13. The method of claim 11, wherein the evaluation of the effectiveness of the classification of the sound scene is based on direct user feedback.

14. The method of claim 10, further comprising:

classifying the first sound scene according to a third feature subset different from the second feature subset during a third temporal period of exposure of the hearing prosthesis to the first sound scene; and developing the third feature subset based on an evaluation of the effectiveness of the classification of a second sound scene different from the first sound scene, wherein the second sound scene is first encountered subsequent to the development of the second feature subset.

15. The method of claim 10, further comprising, subsequent to the actions of classifying the first sound scene according to the first feature subset and classifying the first sound scene according to the second feature subset:

classifying an ith sound scene according to the second feature subset, wherein the ith sound scene is different from the first and second sound scenes;

executing an "i"th action, including:

classifying the ith sound scene according to a jth feature subset different from the first feature subset and the second feature subset;

classifying an ith+1 sound scene according to the jth feature subset, wherein the ith+1 sound scene is different than the ith sound scene;

re-executing the ith action where ith=the ith+1 and jth=jth+1 at least three times.

16. A method, comprising:

capturing first sound with a hearing prosthesis;

classifying the first sound using the hearing prosthesis according to a first pre-existing feature regime;

capturing second sound with the hearing prosthesis; and classifying the second sound using the hearing prosthesis according to a second pre-existing feature regime different from the first feature regime.

17. The method of claim 16, wherein:

the actions of classifying the first sound and classifying the second sound are executed by a sound classifier system of the hearing prosthesis; and the actions of capturing first sound, classifying the first sound, capturing the second sound and classifying the second sound are executed during a temporal period free of sound classifier system changes not based on recipient activity.

18. The method of claim 16, wherein:

the first feature regime includes a feature set utilizing a first number of features; and the second feature regime includes a feature set utilizing a second number of features different from the first number.

19. The method of claim 16, wherein:

the first feature regime is qualitatively different than the second feature regime.

20. The method of claim 16, further comprising:

between classifying of the first sound and the classifying of the second sound, creating the second feature regime by eliminating a feature from the first feature regime.

21. The method of claim 16, further comprising:

between classifying of the first sound and the classifying of the second sound, creating the second feature regime by adding a feature to the first feature regime.

22. The method of claim 16, further comprising, subsequent to the actions of capturing first sound, classifying the first sound, capturing the second sound and classifying the second sound:

executing an "i"th action including:

capturing ith sound with the hearing prosthesis; and classifying the ith sound using the hearing prosthesis according to an ith feature regime different from the first and second feature regimes;

re-executing the ith action for ith=ith+1 at least three times, where the ith+1 feature regime is different from the first and second feature regimes and the ith feature regime.

23. The method of claim 22, wherein, the ith actions are executed within 2 years.

24. The method of claim 16, further comprising, subsequent to the actions of capturing first sound, classifying the first sound, capturing the second sound and classifying the second sound:

executing an "i"th action including:

capturing ith sound with the hearing prosthesis; and classifying the ith sound using the hearing prosthesis according to an ith feature regime different from the first and second feature regimes;

capturing an ith+1 sound with the hearing prosthesis; and classifying the ith+1 sound using the hearing prosthesis according to an ith+1 feature regime different from the ith feature regime;

re-executing the ith action for ith=ith+1 at least three times.

* * * * *